United States Patent [19]

Bracha et al.

[11] 4,198,051

[45] Apr. 15, 1980

[54] COMPUTERIZED PIN BALL MACHINE

[75] Inventors: Marion F. Bracha, Chicago; William H. Englehardt, Skokie, both of Ill.

[73] Assignee: Bally Manufacturing Corporation, Chicago, Ill.

[21] Appl. No.: 633,470

[22] Filed: Nov. 19, 1975

[51] Int. Cl.[2] ..... A63F 7/00

[52] U.S. Cl. ..... 273/121 A

[58] Field of Search ..... 273/1 E, 85 R, 54 C, 273/118 A, 119 A, 121 A, 122 A, 125 A, 126 A, DIG. 28; 235/1 B, 92 GA, 156; 445/1; 340/172.5, 323, 337

[56] References Cited

U.S. PATENT DOCUMENTS

| | | | |
|---|---|---|---|
| 2,806,701 | 9/1957 | Durant | 273/125 A X |
| 3,703,288 | 11/1972 | Vogel et al. | 273/126 A X |
| 3,874,669 | 4/1975 | Ariano | 273/DIG. 28 |
| 3,889,956 | 6/1975 | Castle | 273/1 E X |
| 3,907,290 | 9/1975 | Fischer et al. | 235/92 GA X |
| 3,973,244 | 8/1976 | Lovercheck et al. | 364/200 |
| 4,008,893 | 2/1977 | Yoseloff | 273/85 R |
| 4,026,555 | 5/1977 | Kirschner et al. | 273/102.2 B X |
| 4,069,510 | 1/1978 | Carlow et al. | 364/200 |
| 4,093,232 | 6/1978 | Nutting et al. | 273/121 A |

OTHER PUBLICATIONS

*MCS-4 TM Microcomputer Set Users Manual;* Intel Corporation; Jan. 1972; pp. 44–47, 54–58, 60, 61.

*Electronics;* "Shrinking Cost, Growing Reliability Make More Things Happen," Oct. 25, 1973; pp. 71–105.

*Electronics;* "Microcomputers Muscle in;" Mar. 1, 1973; pp. 63–64.

*EE/Systems Engineering Today;* " Electronics Plays the Pins;" Nov. 1973; pp. 37–41.

*Electronic Design;* "Ease Multiplexing and A/D Conversion;" Apr. 12, 1973; pp. 84–89.

*Process Instruments and Controls Handbook;* McGraw-Hill; 1957; pp. 8–34, to 8–47.

*Electronics;* "Scamp Microprocessor Aims to Replace Mechanical Logic;" Sept. 18, 1975; pp. 81–87.

Popular Electronics; "Altair 8800 Minicomputer, Part I;" Jan. 1975; pp. 33–38.

*Primary Examiner*—Vance Y. Hum

*Attorney, Agent, or Firm*—Fitch, Even & Tabin

[57] ABSTRACT

A pin ball machine which incorporates a micro processor instead of relays and hard wiring wherein the processor is programmed such that when the coin switches, the flipper switches and the various scoring switches of the machine are energized the computer accumulates and drives indicators to indicate the score as well as drives the flippers, the sling shots and other units of the playfield to provide an improved machine.

22 Claims, 32 Drawing Figures

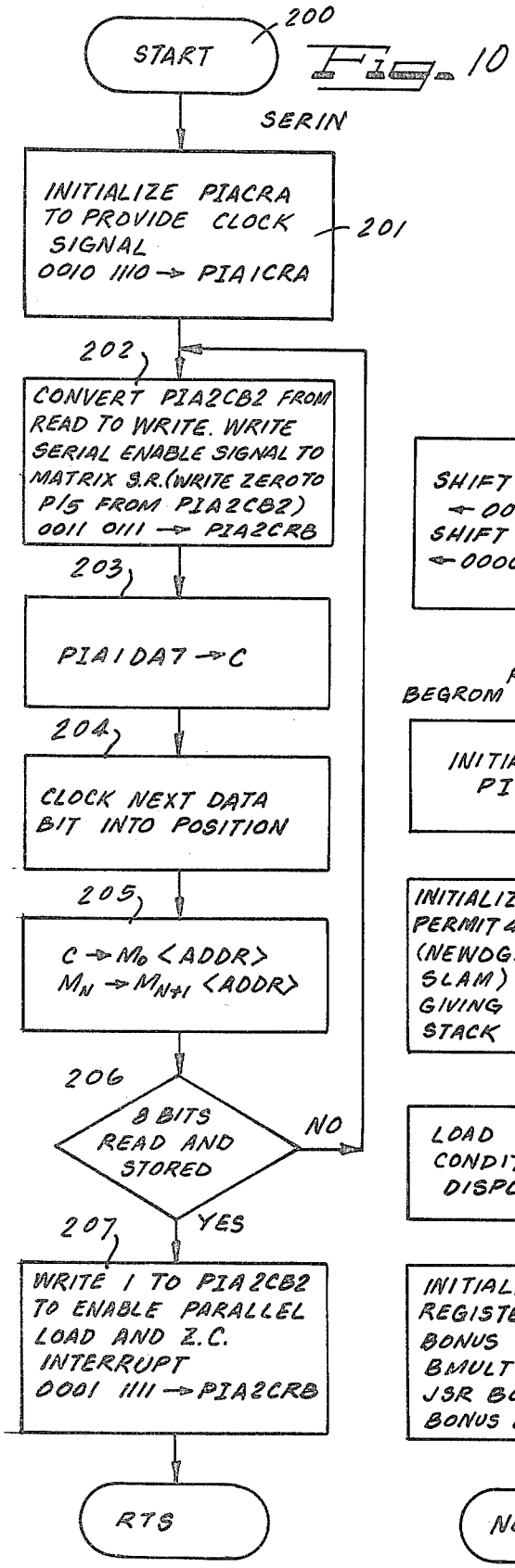
Fig. 10
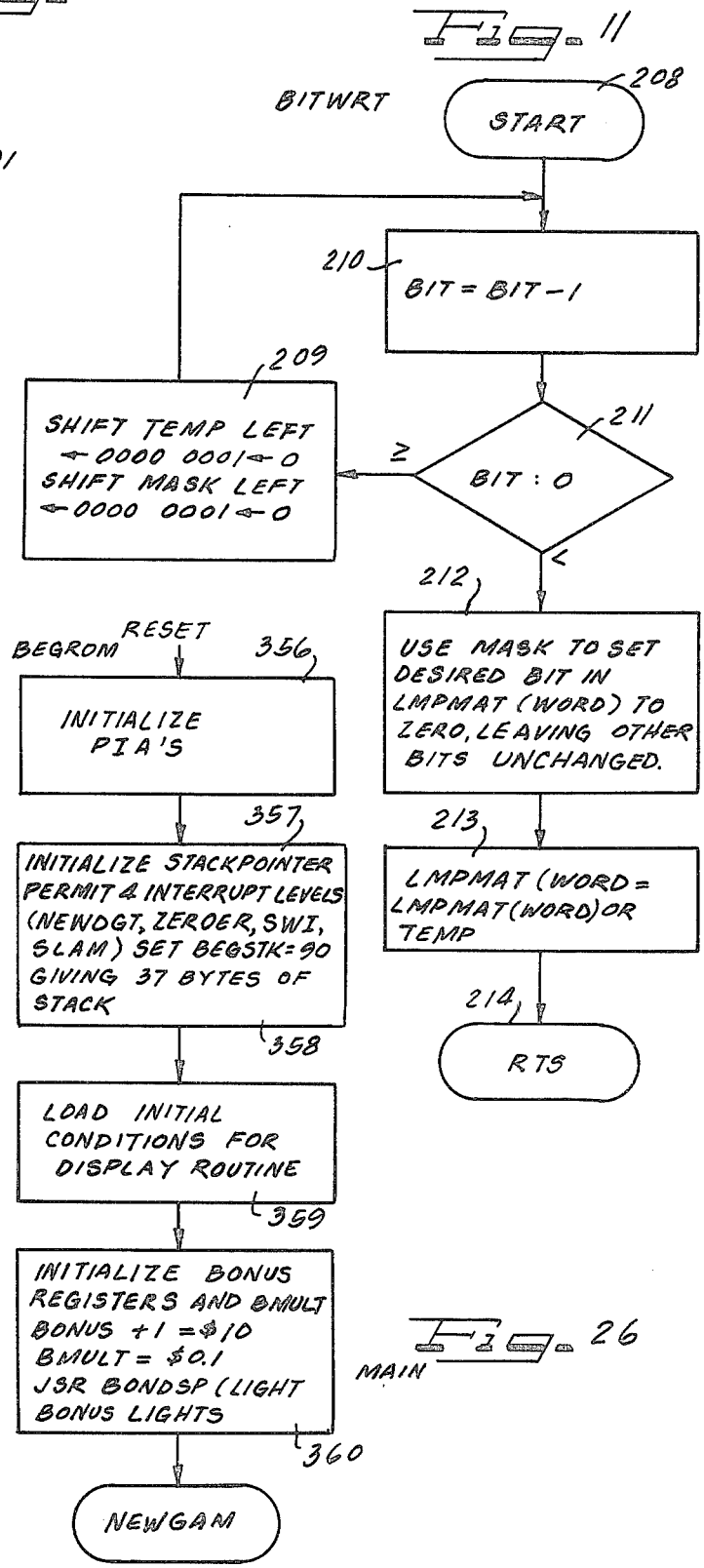
Fig. 11
Fig. 26
MAIN

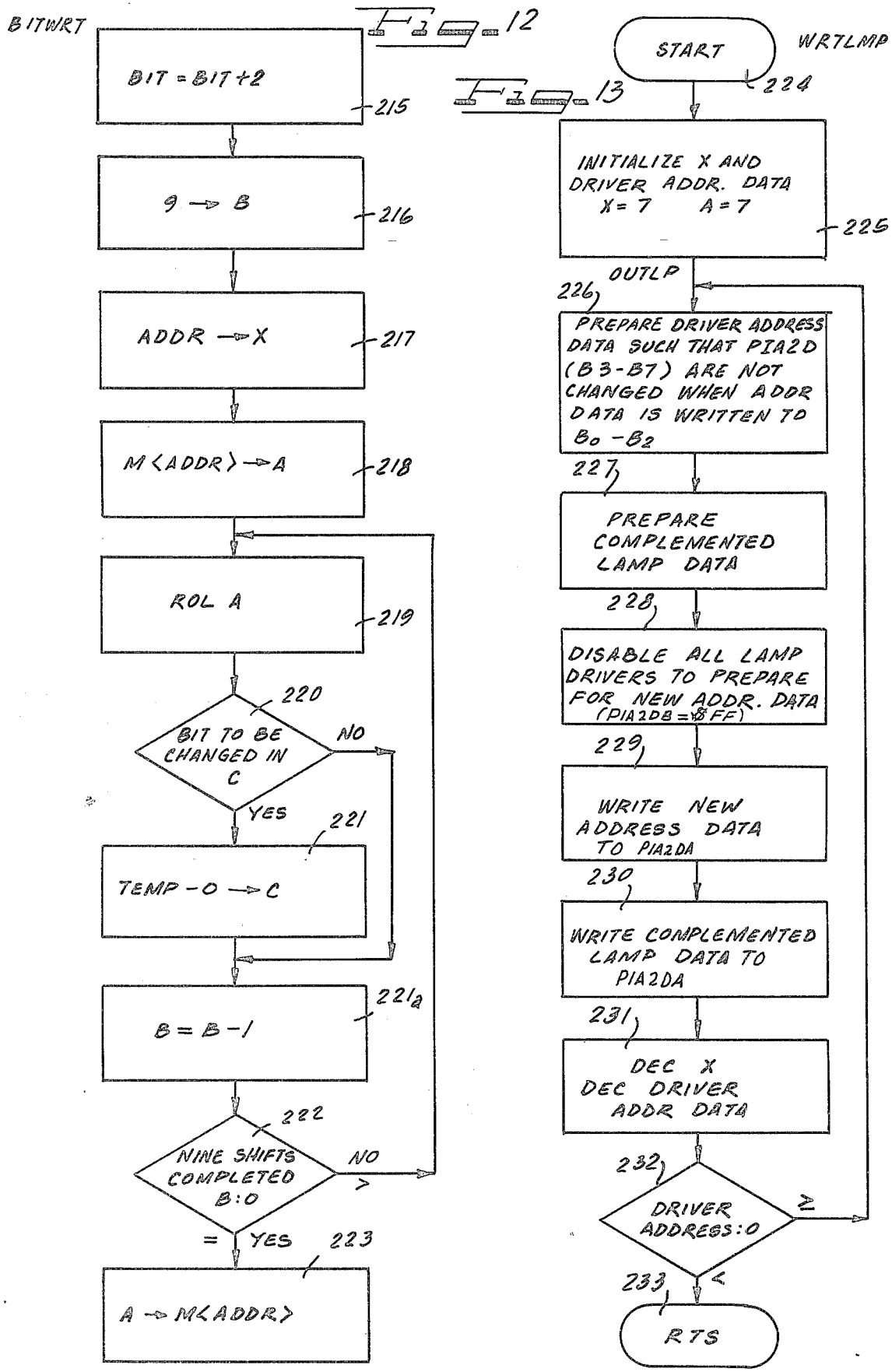
BITWRT
FIG. 12
BIT = BIT + 2
215
9 → B
216
ADDR → X
217
M<ADDR> → A
218
ROL A
219
220
BIT TO BE CHANGED IN C
NO
YES
221
TEMP - 0 → C
B = B - 1
221a
222
NINE SHIFTS COMPLETED B:0
NO
>
=
YES
223
A → M<ADDR>
FIG. 13
START
WRTLMP
224
INITIALIZE X AND DRIVER ADDR. DATA X = 7 A = 7
225
OUTLP
226
PREPARE DRIVER ADDRESS DATA SUCH THAT PIA2D (B3-B7) ARE NOT CHANGED WHEN ADDR DATA IS WRITTEN TO B0 - B2
227
PREPARE COMPLEMENTED LAMP DATA
228
DISABLE ALL LAMP DRIVERS TO PREPARE FOR NEW ADDR. DATA (PIA2DB = $FF)
229
WRITE NEW ADDRESS DATA TO PIA2DA
230
WRITE COMPLEMENTED LAMP DATA TO PIA2DA
231
DEC X
DEC DRIVER ADDR DATA
232
DRIVER ADDRESS:0
≥
<
233
RTS

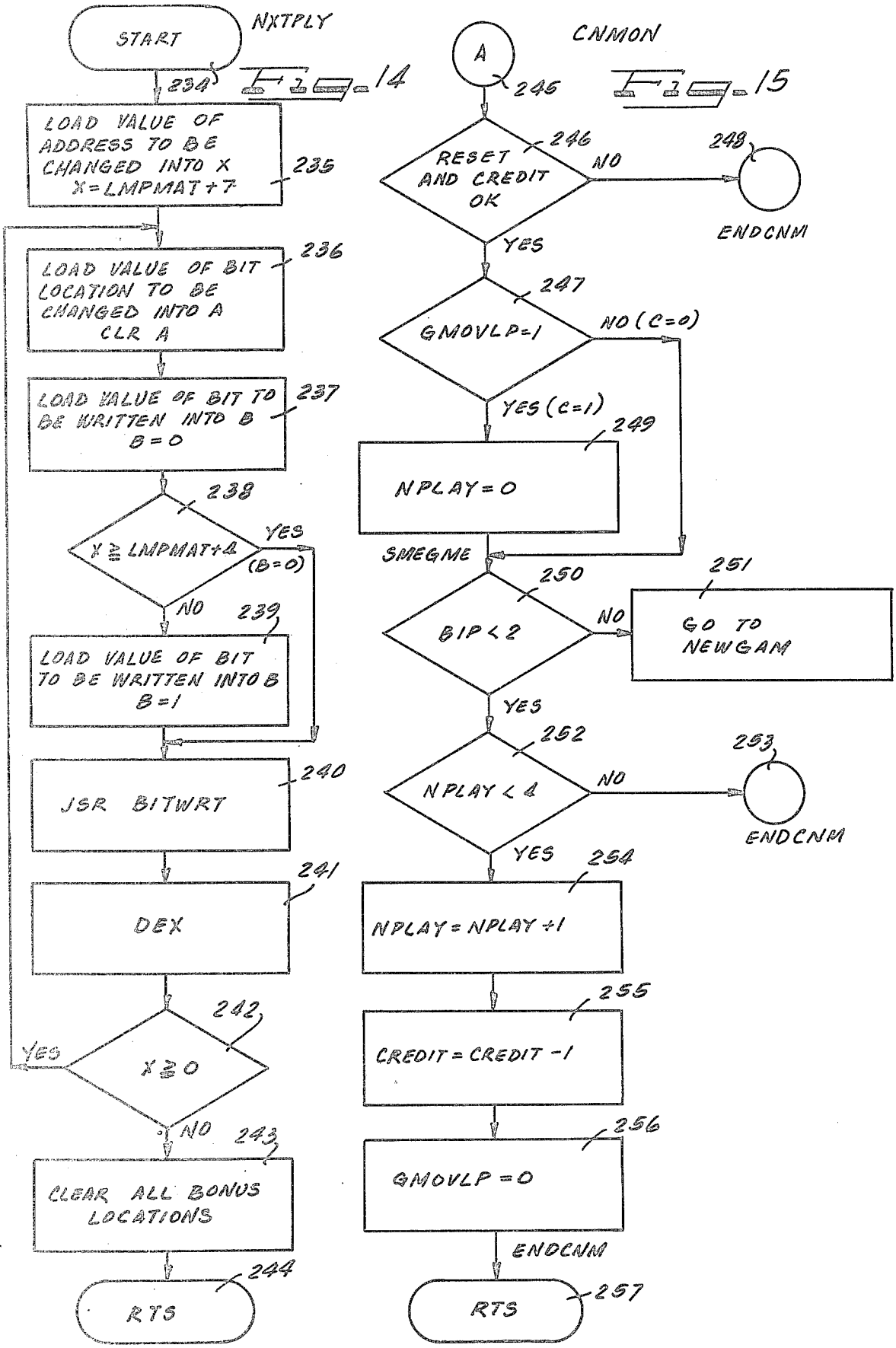
START
NXTPLY
234
Fig. 14
LOAD VALUE OF ADDRESS TO BE CHANGED INTO X X=LMPMAT+7
235
LOAD VALUE OF BIT LOCATION TO BE CHANGED INTO A CLR A
236
LOAD VALUE OF BIT TO BE WRITTEN INTO B B=0
237
238
X ≧ LMPMAT+4
YES (B=0)
NO
239
LOAD VALUE OF BIT TO BE WRITTEN INTO B B=1
JSR BITWRT
240
DEX
241
242
X ≧ 0
YES
NO
243
CLEAR ALL BONUS LOCATIONS
244
RTS
A
CNMON
245
Fig. 15
246
RESET AND CREDIT OK
NO
248
ENDCNM
YES
247
GMOVLP=1
NO (C=0)
YES (C=1)
249
NPLAY=0
SMEGME
250
BIP < 2
NO
251
GO TO NEWGAM
YES
252
NPLAY < 4
NO
253
ENDCNM
YES
254
NPLAY=NPLAY+1
255
CREDIT=CREDIT-1
256
GMOVLP=0
ENDCNM
257
RTS START
258
CNMON
SET CNBIT 1, CNBIT 2, AND RESET BIT FROM XEDGE (3) AND LOAD INTO B
259
CNBIT 1 = 1
260
NO
YES
INC CNCNT 1
261
CNCNT 1 = COINS 1
262
NO
YES
CREDIT = CREDIT + GAMES 1
263
CLR CNCNT 1
264
BYPCN1
CNBIT 2 = 1
265
NO
YES
INC CNCNT 2
266
CNCNT 2 = COINS
267
NO
YES
CREDIT = CREDIT + GAMES 2
268
CLR CNCNT 2
269
A
270
INTERRUPT
INADD = 00H
1 → C
I = 0
271
PIADB = INADD
272
XWORD = PIAIDA
273
CALL EDGEDET(I)
274
I ≥ 4
275
NO
YES
ROL (IN ADD, 1)
I = I + 1
276
RETURN
277

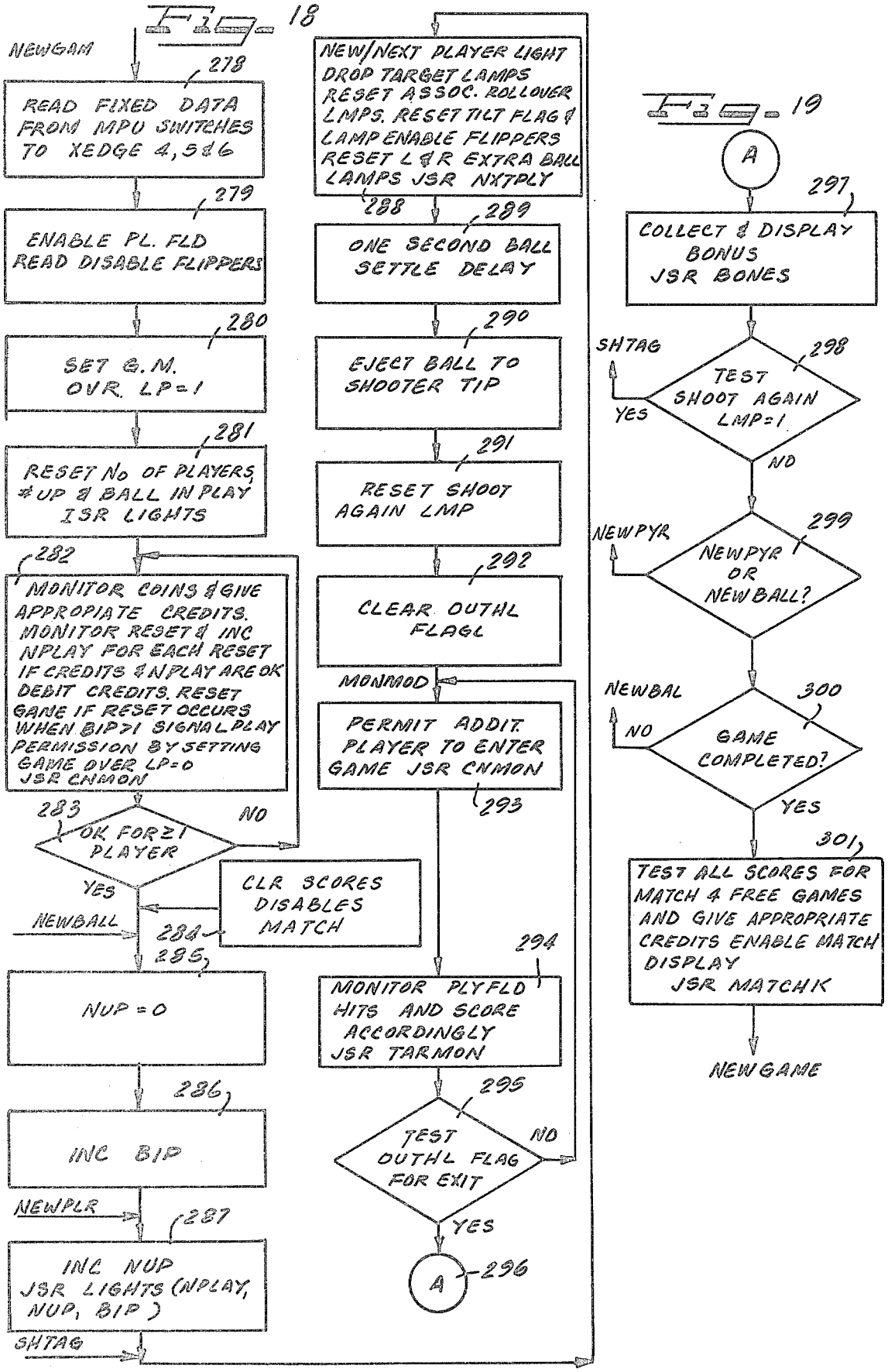
FIG. 18
NEWGAM
278
READ FIXED DATA FROM MPU SWITCHES TO XEDGE 4,5&6
279
ENABLE PL. FLD READ DISABLE FLIPPERS
280
SET G.M. OVR. LP=1
281
RESET No OF PLAYERS, #UP & BALL IN PLAY ISR LIGHTS
282
MONITOR COINS & GIVE APPROPIATE CREDITS. MONITOR RESET & INC NPLAY FOR EACH RESET IF CREDITS & NPLAY ARE OK DEBIT CREDITS. RESET GAME IF RESET OCCURS WHEN BIP>1 SIGNAL PLAY PERMISSION BY SETTING GAME OVER LP=0 JSR CNMON
283
OK FOR≥1 PLAYER
NO
YES
CLR SCORES DISABLES MATCH
NEWBALL
284
285
NUP=0
286
INC BIP
NEWPLR
287
INC NUP JSR LIGHTS (NPLAY, NUP, BIP)
SHTAG
NEW/NEXT PLAYER LIGHT DROP TARGET LAMPS RESET ASSOC. ROLLOVER LMPS. RESET TILT FLAG & LAMP ENABLE FLIPPERS RESET L&R EXTRA BALL LAMPS JSR NXTPLY
288
289
ONE SECOND BALL SETTLE DELAY
290
EJECT BALL TO SHOOTER TIP
291
RESET SHOOT AGAIN LMP
292
CLEAR OUTHL FLAGL
MONMOD
PERMIT ADDIT. PLAYER TO ENTER GAME JSR CNMON
293
294
MONITOR PLYFLD HITS AND SCORE ACCORDINGLY JSR TARMON
295
TEST OUTHL FLAG FOR EXIT
NO
YES
A
296
FIG. 19
A
297
COLLECT & DISPLAY BONUS JSR BONES
SHTAG
298
TEST SHOOT AGAIN LMP=1
YES
NO
NEWPYR
299
NEWPYR OR NEW BALL?
NEWBAL
300
GAME COMPLETED?
NO
YES
301
TEST ALL SCORES FOR MATCH 4 FREE GAMES AND GIVE APPROPRIATE CREDITS ENABLE MATCH DISPLAY JSR MATCHK
NEW GAME RDMAT INTERRUPT
LOAD ACCA WITH FIRST MATRIX ADDR ACCA = 0100 0000
311
SET INDEX COUNTER X = 6
312
WRITE ADDRESS TO MATRIX
313
READ MATRIX INPUT TO XWD
314
ACCA 0001 0000
315
<
>
ENTDAT
316
PLYFLD:0
YES
NO
317
PLYFLD:0
NO
YES
318
EDGE DET CALC LSTXWD(X) LST SET (X), XEDGE(X)
319
XEDGE (X) = XWD
RTALL
320
X = X-1 LSR ACCA
321
ACCA:0
>
≤
322
END

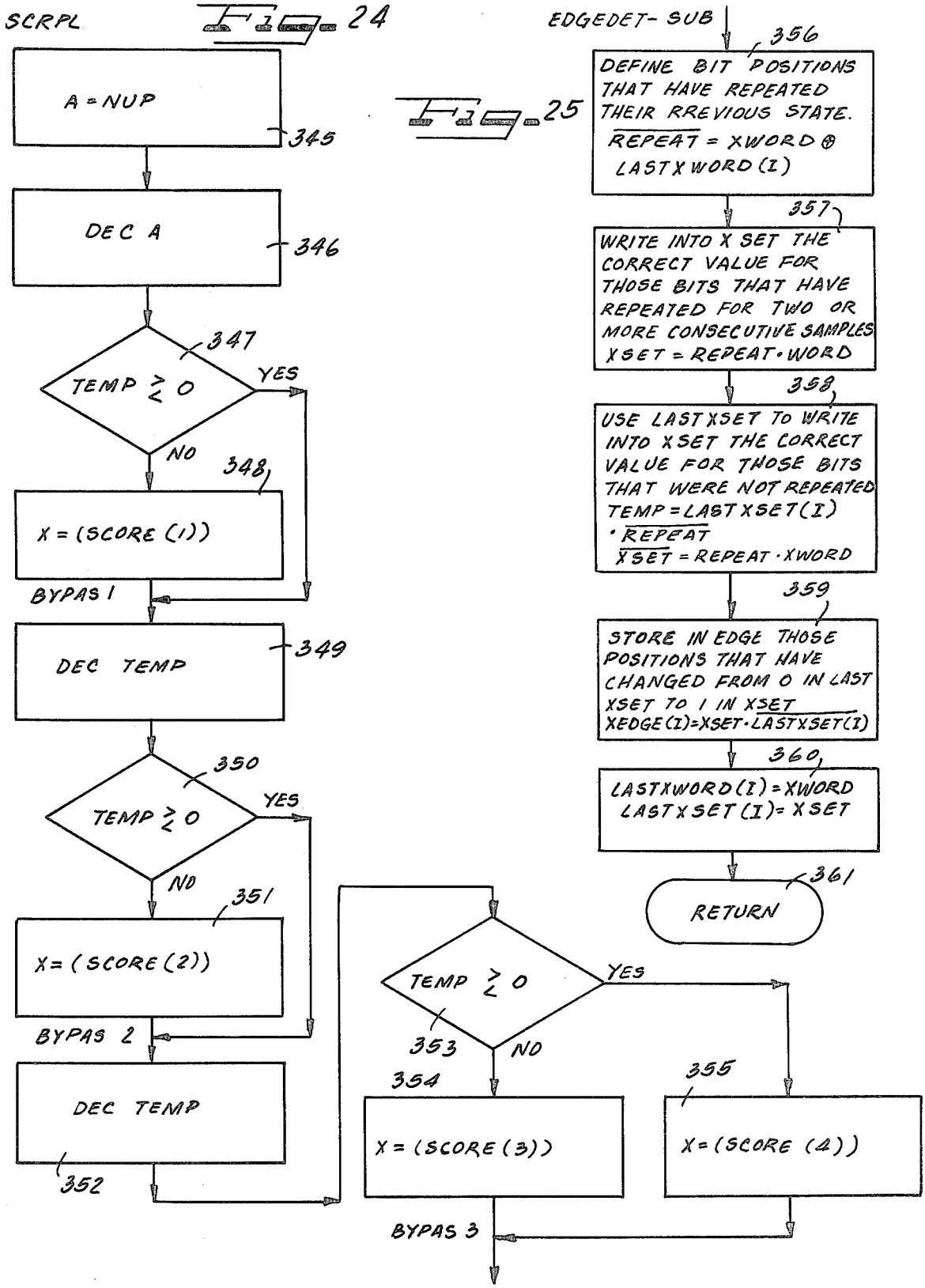
SCRPL
Fig. 24
A = NUP
345
DEC A
346
TEMP ≷ 0
347
YES
NO
348
X = (SCORE (1))
BYPAS 1
DEC TEMP
349
TEMP ≷ 0
350
YES
NO
351
X = (SCORE (2))
BYPAS 2
DEC TEMP
352
TEMP ≷ 0
353
YES
NO
354
X = (SCORE (3))
355
X = (SCORE (4))
BYPAS 3
EDGEDET- SUB
Fig. 25
356
DEFINE BIT POSITIONS THAT HAVE REPEATED THEIR PREVIOUS STATE.
REPEAT = XWORD ⊕ LASTXWORD (I)
357
WRITE INTO X SET THE CORRECT VALUE FOR THOSE BITS THAT HAVE REPEATED FOR TWO OR MORE CONSECUTIVE SAMPLES
XSET = REPEAT · WORD
358
USE LASTXSET TO WRITE INTO XSET THE CORRECT VALUE FOR THOSE BITS THAT WERE NOT REPEATED
TEMP = LASTXSET (I) · REPEAT
XSET = REPEAT · XWORD
359
STORE IN EDGE THOSE POSITIONS THAT HAVE CHANGED FROM 0 IN LAST XSET TO 1 IN XSET
XEDGE (I) = XSET · LASTXSET (I)
360
LASTXWORD (I) = XWORD
LASTXSET (I) = XSET
361
RETURN N = 0
B = 0
375
DISABLE READIN INTERR.
376
READ XEDGE (N)
377
374
GO TO THE INSTRUCTION SET ASSOCIATED WITH N, B; EXECUTE AND RETURN
YES
BIT B = 1
378
NO
379
XEDGE (N) = 0
380
B ≥ 7
NO
385
B = B+1
YES
381
ENABLE READIN INTERR.
382
N ≥ 4
NO
384
N = N+1
YES
383
RETURN

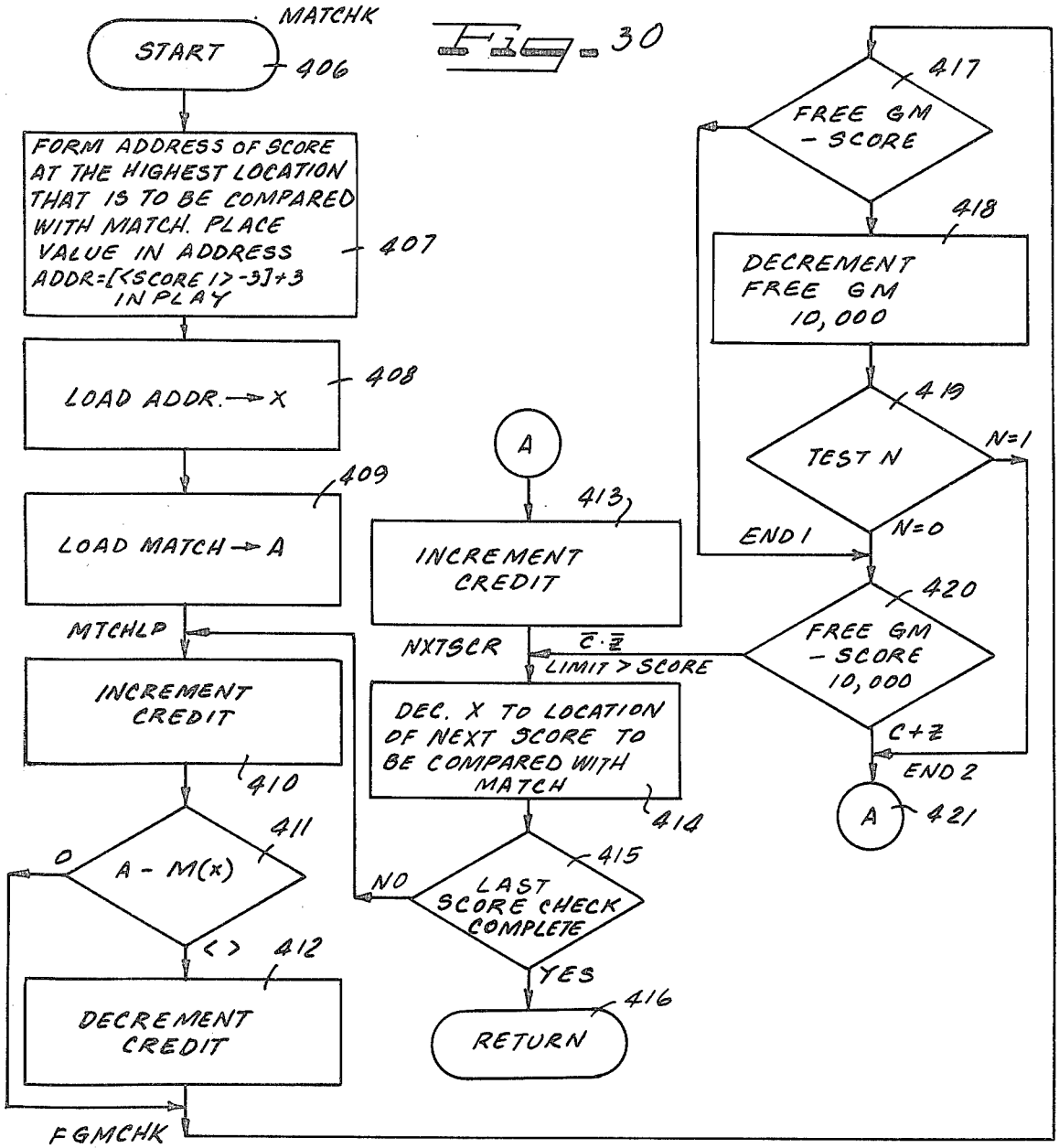
MATCHK
START
406
FIG. 30
FORM ADDRESS OF SCORE AT THE HIGHEST LOCATION THAT IS TO BE COMPARED WITH MATCH. PLACE VALUE IN ADDRESS ADDR=[<SCORE 1> -3]+3 IN PLAY
407
LOAD ADDR. → X
408
LOAD MATCH → A
409
MTCHLP
INCREMENT CREDIT
410
A - M(x)
411
0
<>
412
DECREMENT CREDIT
FGMCHK
A
413
INCREMENT CREDIT
NXTSCR
DEC. X TO LOCATION OF NEXT SCORE TO BE COMPARED WITH MATCH
414
LAST SCORE CHECK COMPLETE
415
NO
YES
RETURN
416
FREE GM - SCORE
417
DECREMENT FREE GM 10,000
418
TEST N
419
N=1
N=0
END 1
FREE GM - SCORE 10,000
420
C·Z
LIMIT > SCORE
C+Z
END 2
A
421

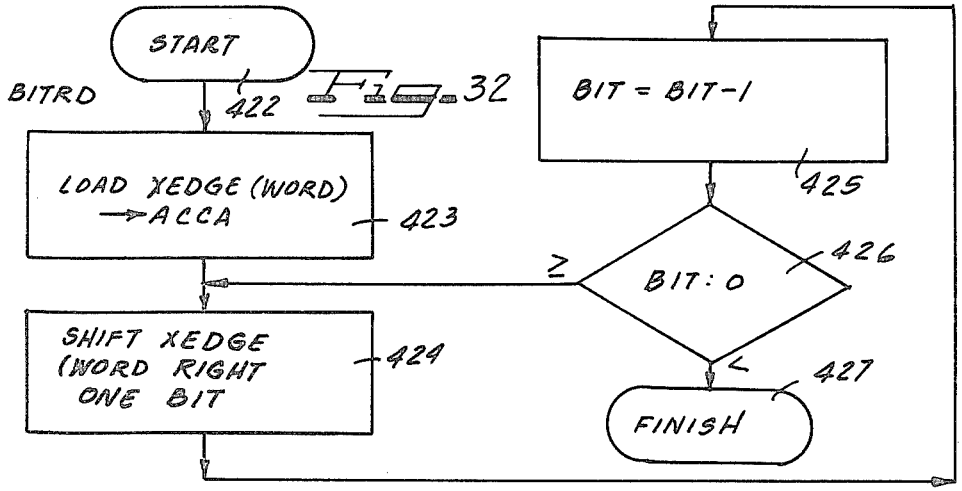
START
BITRD
422
FIG. 32
LOAD XEDGE (WORD) → ACCA
423
SHIFT XEDGE (WORD RIGHT ONE BIT
424
BIT = BIT-1
425
BIT : 0
426
>
<
FINISH
427

COMPUTERIZED PIN BALL MACHINE

BACKGROUND OF THE INVENTION

1. Field of the Invention

This invention relates in general to amusement machines of the pin ball type and in particular to an improved computerized pin ball machine.

2. Description of the Prior Art

Pin ball machines of the prior art have utilized switches which actuate relays so as to accumulate and drive indicators, chimes, lights and other units of the machine.

SUMMARY OF THE INVENTION

The present invention incorporates a micro processor which is operated by a suitable program according to the invention and receives inputs from the playfield wiring of a pin ball machine and provides outputs to drive solenoids on the playfield such as the right flipper, the left flipper, the right sling shot, the left sling shot, the thumper, a top hole, an out hole and a knocker as well as indicator lamps to indicate the score and wherein the micro processor is programmed to produce the proper operation of the units on the playfield as well as indicate the score of each player.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, in which:

BRIEF DESCRIPTION OF THE DRAWINGS

FIGS. 10 through 32 illustrate flow charts for various programs and subprograms of the invention.

DESCRIPTION OF THE PREFERRED EMBODIMENTS

The present invention comprises a novel computerized pin ball machine wherein the conventional relays which are actuated by switches on the playfield are energized so as to store information as to which of the particular switches has been actuated by the balls as they roll on the playfield of the machine are replaced by a minicomputer which has been programmed by the novel program of the invention to control the operation and scoring and other functions of the machine without the hard wiring and relays of the prior art. The micro computer of the invention is connected to switches and indicators on the playfield of the machine and to the indicators on an indicating support member as well as to indicator lights mounted on the playfield or other portions of the machine. The micro computer also receives inputs from the coin receiving switches of the machine. The micro computer comprises a single micro processing unit, a clock and a number of read only memories, random access memories and peripheral interface adapters.

The program for the micro computer is incorporated in this application and provides the soft ware for operation, control address and output of the micro computer.

Figure 1:
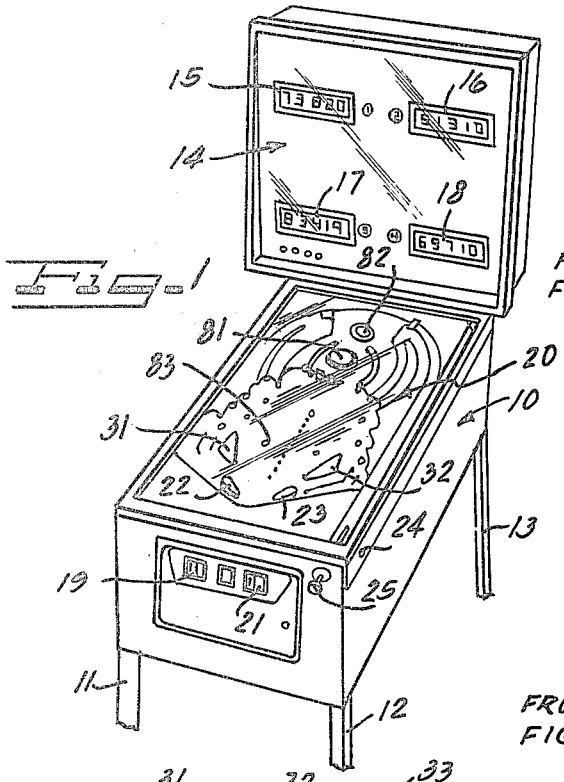
FIG. 1 is a prospective view of the invention.

FIG. 1 illustrates a pin ball machine 10 according to the invention which is mounted on legs 11, 12, 13 and on a fourth leg. A display region 14 at one end of the machine has display area 15, 16, 17 and 18 for indicating the scores of 1 to 4 players. A pair of coin slots 19 and 21 are provided. The playing field 20 of the machine 10 is provided with a number of switches and actuators so as to interact with balls on the playfield. The balls are propelled by a ball shooter 25, actuated by a player onto the playfield 20 and due to the momentum of the ball and the tilting surface of the playfield, the ball moves about the playfield to engage various switches, flippers, slingshots and Thumper Bumpers on the playfield. It should be realized that the arrangement of the playfield may differ. The machine illustrated in FIG. 1 has the Boomerang playfield manufactured by the Bally Manufacturing Corporation.

A tophole 82 is provided with an opening with a switch therein which will energize the scoring and further is provided with a solenoid so as to kick the ball out of the hole. The Thumper Bumper 81 can be energized by the ball as can the left Sling Shot 31 and the right Sling Shot 32. A pair of pivoted flippers 22 and 23 can be actuated under control of flipper switches 26 and 24, respectively. Numerous lights, chimes and action mechanisms are mounted on the playing field and are well known to those skilled in the art.

Figure 5:
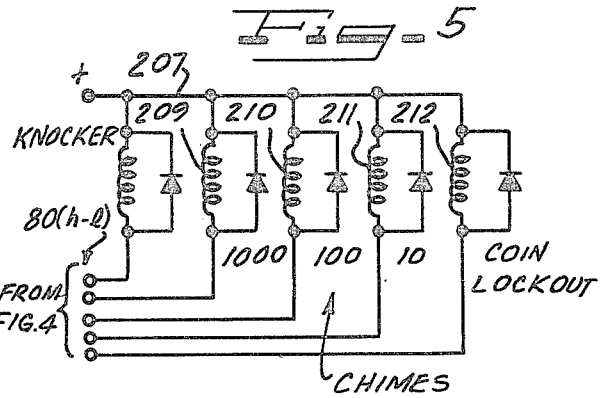
FIG. 5 illustrates units driven by solenoid drive circuits.
Figures 2A, 9:
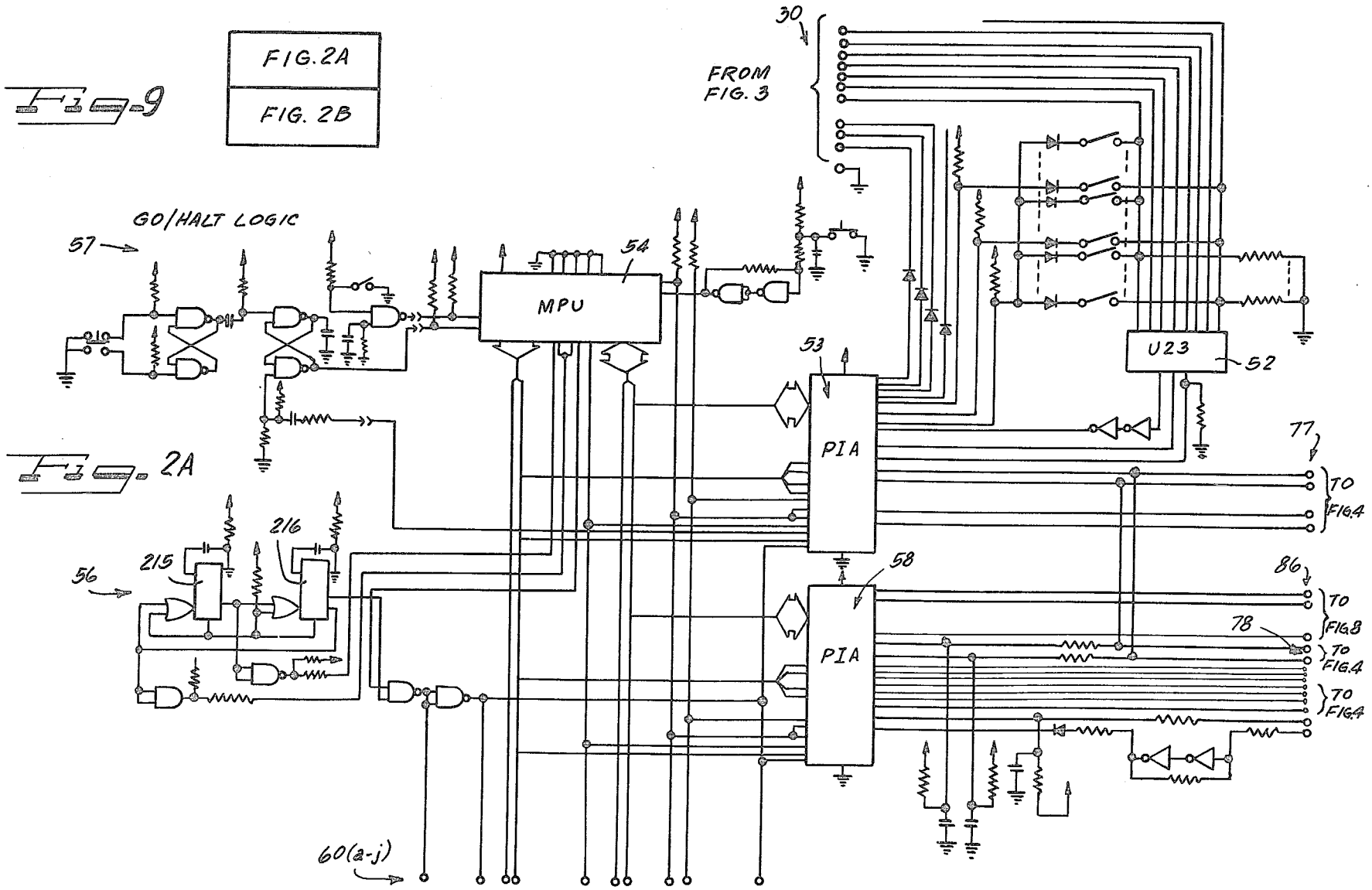
FIGS. 2A and 2B are schematic views of the computer with its inputs and outputs.
FIG. 9 illustrates the relationship of FIGS. 2A and 2B of the drawings.
Figures 2B, 4:
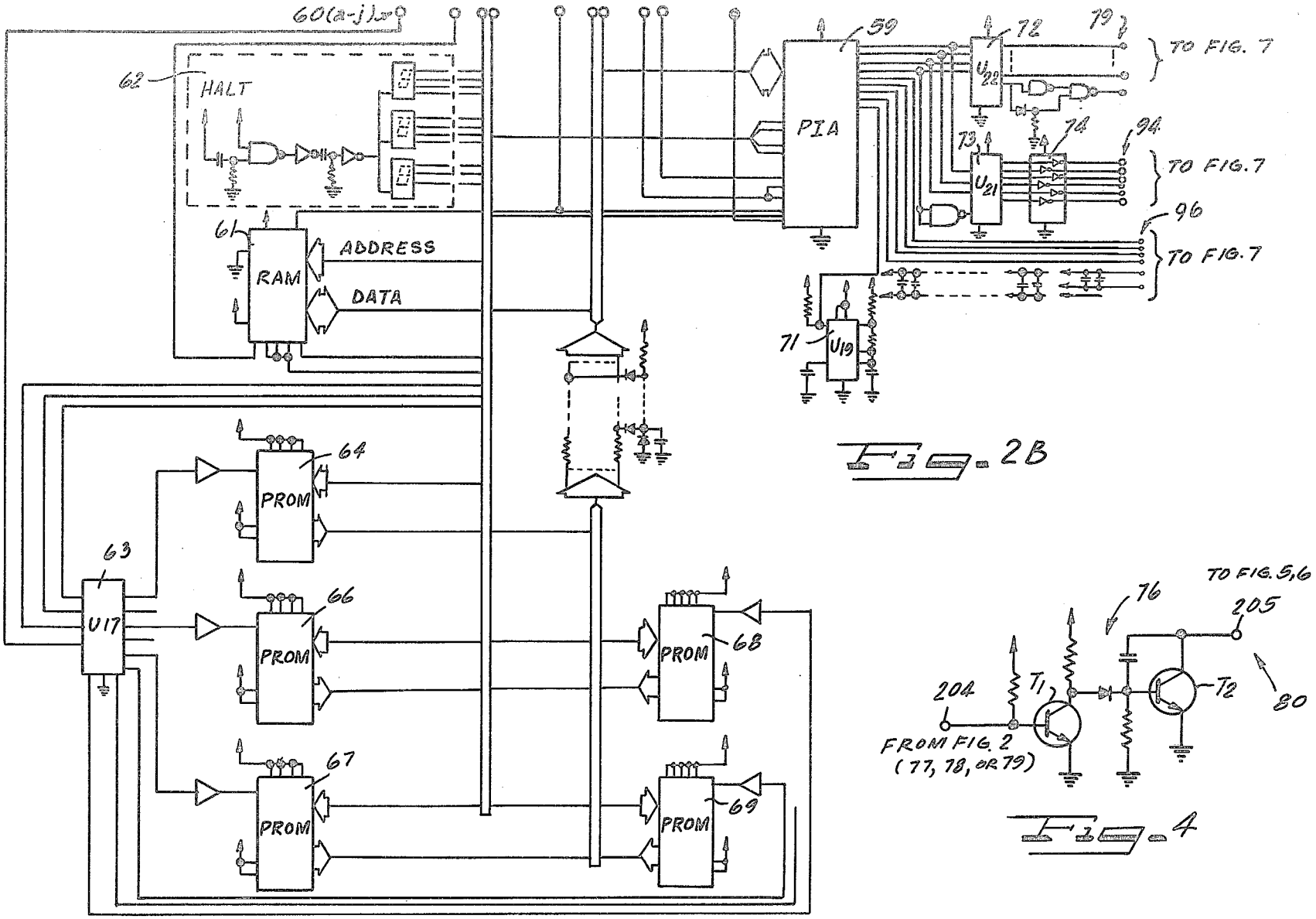
FIG. 4 illustrates a single solenoid drive circuit.
Figure 7:
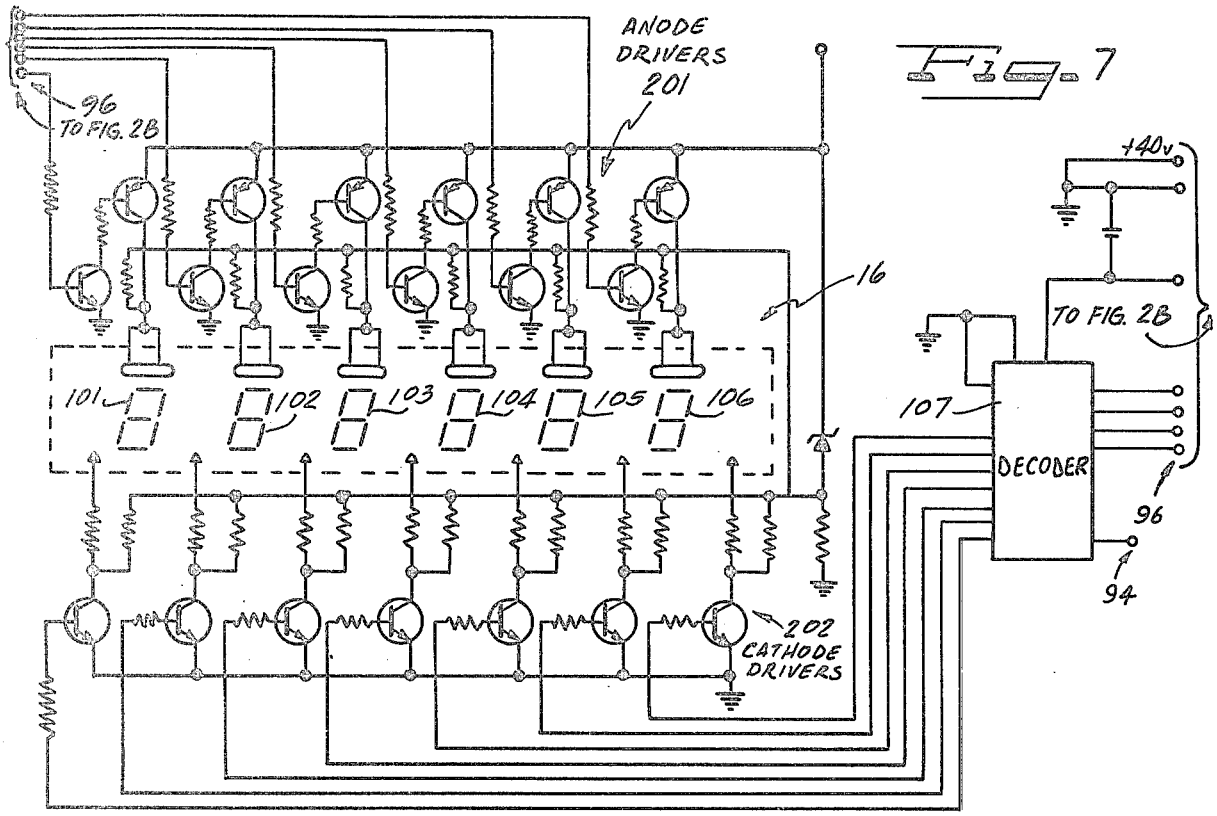
FIG. 7 illustrates digital score indicators driven by the computer.
Figure 8:
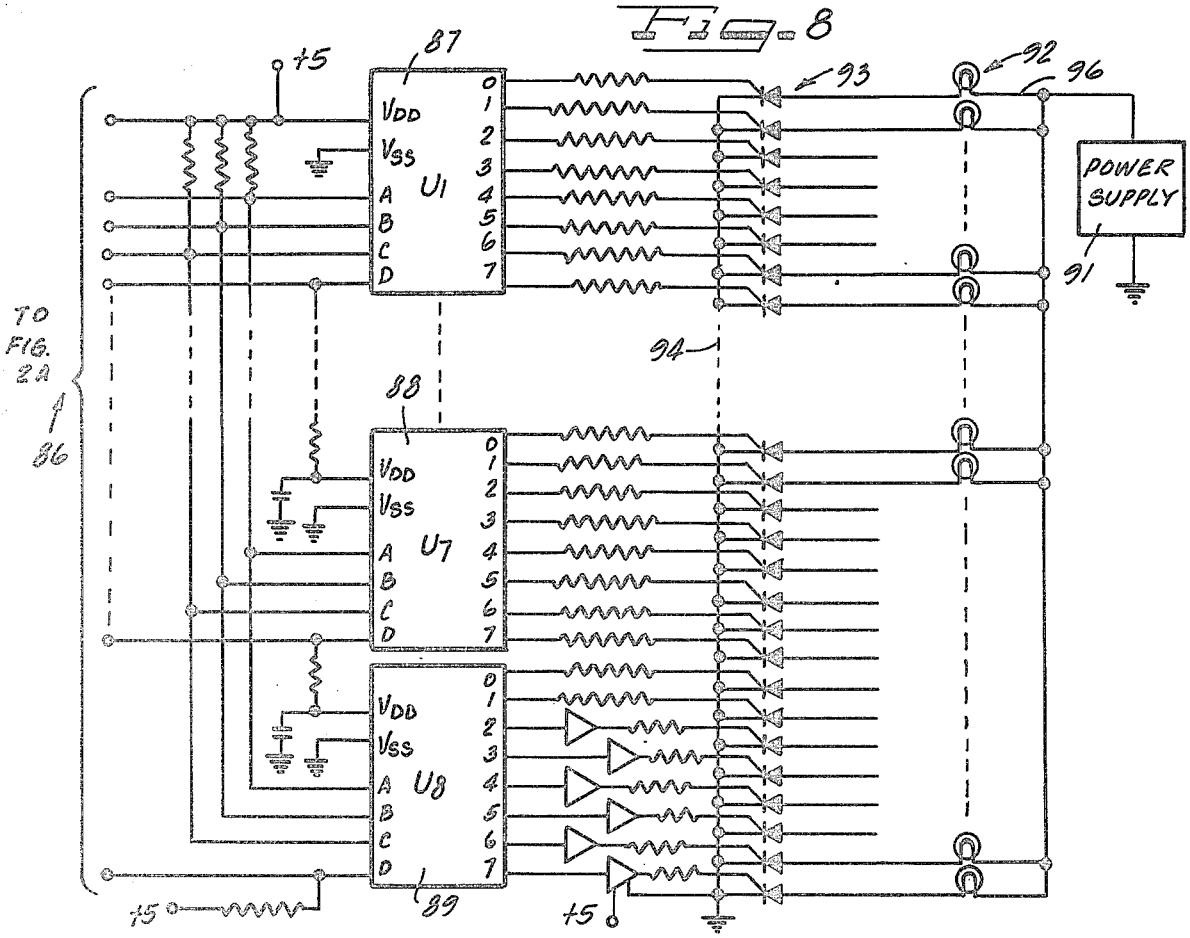
FIG. 8 illustrates various lights driven by the computer.

In prior art devices the various switches located on the playing field 20 have directly energized relays and switches so as to illuminate various lights, chimes and drum indicators, but in the present invention the switches on the playfield 20 provide inputs to a micro computer such as illustrated in FIGS. 2A and 2B which includes a microprocessing unit 54 which might be of a type M 6800 unit manufactured by Motorola Semi-Conductor Products, Inc. For example, the Micro Processing Unit 54 receives inputs from the playfield through the peripheral interface adapter 53 and provides output to drive various indicating lights 92 through the peripheral interface adapter 58. Also, the indicator units 15, 16, 17 and 18 are driven by the computer 54 through the peripheral interface adapter 59. The computer 54 also drives a plurality of solenoid drivers 76 illustrated in FIG. 4. The solenoid drivers 76 are connected to various actuated devices illustrated in FIGS. 5 and 6. It should be realized that there is a solenoid driver for each of the elements of FIGS. 5 and 6. The indicator units 15, 16, 17 and 18 are illustrated in FIG. 7 and are driven by the output of the computer 54 through the peripheral interface adapter 59. A plurality of indicator units 92 illustrated in FIG. 8 are driven by the computer through the peripheral interface adapter 58 by the computer.

Figure 3:
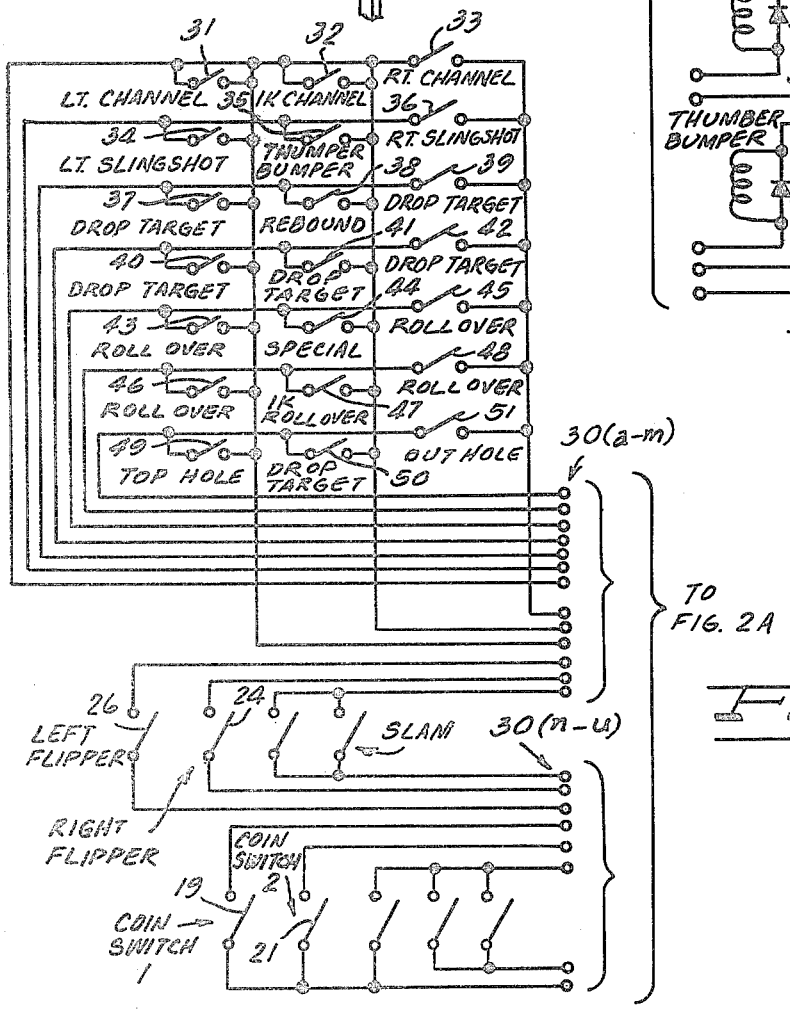
FIG. 3 illustrates the input switches to the computer.

The inputs of the computer are illustrated in FIG. 3 and comprise a first coin switch 19 and a second coin switch 21 and also comprise a left flipper switch 26 which can be actuated by the operator of the pin ball machine and a right flipper switch 24. The coin switches 19 and 21 actuate the machine upon the deposit of a coin in the coin slots of the machine so as to reset the indicators 15 through 18 to 0 and enable the machine for a new game. Upon the deposit of a coin credit is given to the player for a number of balls which are automatically supplied to the ball ejector 25 one after the other so that they can be shot onto the playfield.

Mounted on the playfield are a number of ball actuated switches such as the switches 31 through 51 illustrated in FIG. 3. For example, the switch 31 is the LT 500 point channel switch. The switch 32 is the 1,000 point channel. The switch 33 is the right 500 point channel switch. The switch 34 is the left Sling Shot switch. The switch 35 is the Thumper Bumper switch. The switch 36 is the right Sling Slot switch. The switch 37 is the drop target "A" switch. The switch 38 is the rebound 10 switch. The switch 39 is the drop target "D". The switch 40 is the drop target "B". The switch 41 is the drop target 100 point switch. The switch 42 is the drop target "C", the switch 46 is the roll over "A" switch and the switch 48 is a special switch. The switch 45 is a roll over "D". The switch 46 is a roll over "B". The switch 47 is a 1,000 roll over switch and the switch 48 is a roll over "C". The switch 49 is a tophole, 3,000 point switch, the switch 50 is a drop target 500 point switch and switch 51 is an outhole switch.

The switches 19, 21, 24, 26 and 31 through 51 are connected to output terminals 30*a* through U which are supplied to the central processor 54 through the peripheral interface adapter 53 and the unit 52 identified as U23 and which may be a type CD 4,021 AE unit manufactured by Motorola. The input of switches of FIG. 3 are fed into the computer which stores, processes and provides control outputs to light indicators and solenoid drive switches to actuate various devices in the machine.

For example, the plurality of indicator lights 92 shown in FIG. 8 are driven by the computer and have first sides 96 connected to a power supply 92 which has its other side grounded and the lights have their second sides connected to ground through a plurality of SCR's 93 as shown in FIG. 8 such that if the SCRs 93 are gated to the "on" condition the SCRs will conduct allowing current to pass from the power supply through the lights 92 to ground to complete the circuit thus illuminating the lights. The gates of the SCRs 93 are connected to a plurality of one of eight decoders 87, 88 and 89 which receive inputs from terminals 86 which are also shown in FIG. 2A and are connected to the peripheral interface adapter 58. Thus, the provision of the peripheral decoder adapters 87, 88 and 89 allow a large number of lights 92 to be driven by a smaller number of input leads connected to the terminals 86.

FIG. 7 illustrates one of the indicators such as 15, 16, 17 and 18 which might be a Burrough's type BR08571 indicator having a plurality of indicator units 101 through 106 and having a plurality of anode drivers 201 which are respectively connected to anodes of one of the indicators 101 through 106 and receive inputs at terminals 79 which are connected to the output of a decoder 72 whose input is connected to the output of the peripheral interface adapter 59 illustrated in FIG. 2B. The plurality of cathode drivers 202 are connected through a decoder unit 107 which might be a type MC14543 CP type and which receives inputs from terminals 96 illustrated in FIG. 2B as connected to the peripheral interface adapter 59 of the computer. The decoder unit 107 also receives an input from a terminal 94 illustrated in FIG. 2*b* as connected through inverter 74 to the output of a decoder 73 which has inputs connected to the output of the peripheral interface adapter 59. It is to be realized, of course, that the other four indicators are also driven by the output of the computer in the same fashion as the indicator 16.

FIG. 4 illustrates a single solenoid driver 76 which has an input terminal 204 which receives inputs from terminals 77, 78 or 79 of the computer illutrated in FIGS. 2A and 2B. The solenoid driver has a pair of transistors T1 and T2 and has an output terminal 205. It is to be realized that there is a solenoid driver such as 76 for each of the units illustrated in FIGS. 5 and 6. For example, in FIG. 5 the terminal 80*h* through *k* are each connected to the output terminal 205 of a solenoid driver 76 such as shown in FIG. 4 such that when the transistor T2 is turned on terminal 205 is connected to ground thus supplying power from positive terminal 207 through the energizing winding of the solenoids of the respective units. For example, terminal 80*k* is connected to a Knocker winding to energize a Knocker. Terminal 80*i* is connected to a 1,000 solenoid 209. Terminal 80*j* is connected to a 100 solenoid 210. Terminal 80*k* is connected to a 10 solenoid 211 and terminal 801 is connected to a coin lockout solenoid 212.

Figure 6:
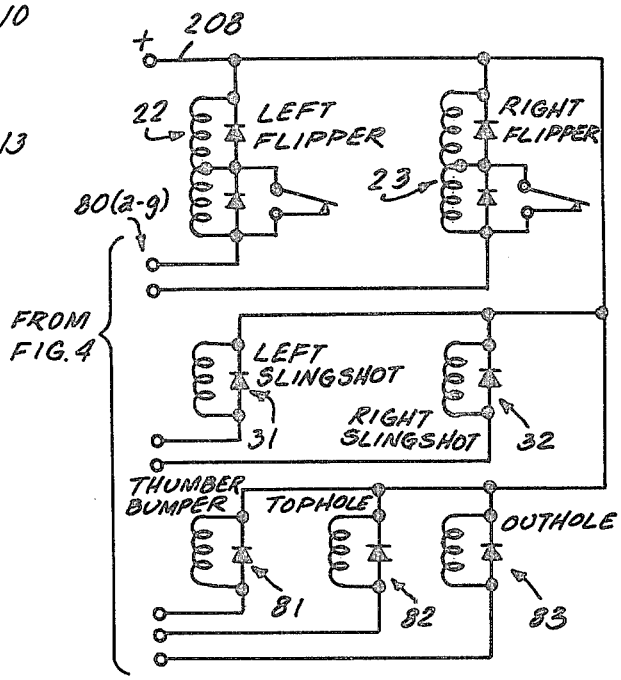
FIG. 6 illustrates units driven by solenoid drive circuits.

FIG. 6 illustrates terminals 80*a* through g with terminal 80*a* through *g*, respectively, connected to an output terminal of a solenoid driver such as 76 in FIG. 4 which has an output terminal 205 such that if the particular solenoid driver is energized, ground is applied to terminal 205 so as to complete the circuit from power lead 208 through the solenoids and transistors T2.

The solenoid 22 controls the left flipper. The solenoid 23 controls the right flipper. The solenoids 31 and 32, respectively, control the left and right Slingshots. Solenoid 81 controls the Tumper Bumper, the solenoid 82 controls the tophole solenoid and the solenoid 83 controls the outhole.

The computer illustrated in FIGS. 2A and 2B include a random access memory which may be a type MCM 6810 and designated by 61 in FIG. 2B. The computer also includes a number of programmable read only memories 64, 66, 67, 68 and 69 which might be type 1702A. A unit 71 connected to the unit 59 may be the type NE555. The unit 63 connected to the memory 64 through 69 may be type CD4028B/MC1402B. Components of the clock 56 indicated by 215 and 216 may be type 9602.

Attached and made a part hereof is the program for the computer so as to provide software for the computer such that it actuates the proper output indicators and solenoids to operate the pinball machine.

FIGS. 10 through 30 illustrate various flow charts for the program and subprograms of the computer.

FIG. 10 illustrates a subroutine program which reads serial data presented at peripheral interface adapter 58 and clocks 8 bits of data. PIA2CA2 is the shift register clock signal. After the start signal 200 is received the peripheral interface adapter 58 receives a clock signal in step 201. Steps 202 through 207 complete the flow chart.

FIG. 11 is a routine for writing a bit to a specified position in LMPMAT (word). Steps 208 through 214 define this program.

FIG. 12 illustrates a routine which writes a bit to M(ADDR) at bit position bit. TEMP holds the bit to be written in position 0. Only the specified bit is affected, all other bits in M(ADOR) are unchanged, inputs are bit (07), ADDR (0–64K), and TEMP (0 or 1). This program is represented by blocks 215 through 223.

FIG. 13 illustrates a subroutine which writes the LMPMAT to the peripheral interface adapter 58. The output data is formated for use by 8 channel demultiplexer. This subroutine is represented by blocks 224 through 233.

FIG. 14 is a subroutine for NXTPLY and is represented by blocks 234 through 244.

FIG. 15 illustrates a subroutine used for checking the credit when a coin is deposited in the machine.

Figures 16, 17:
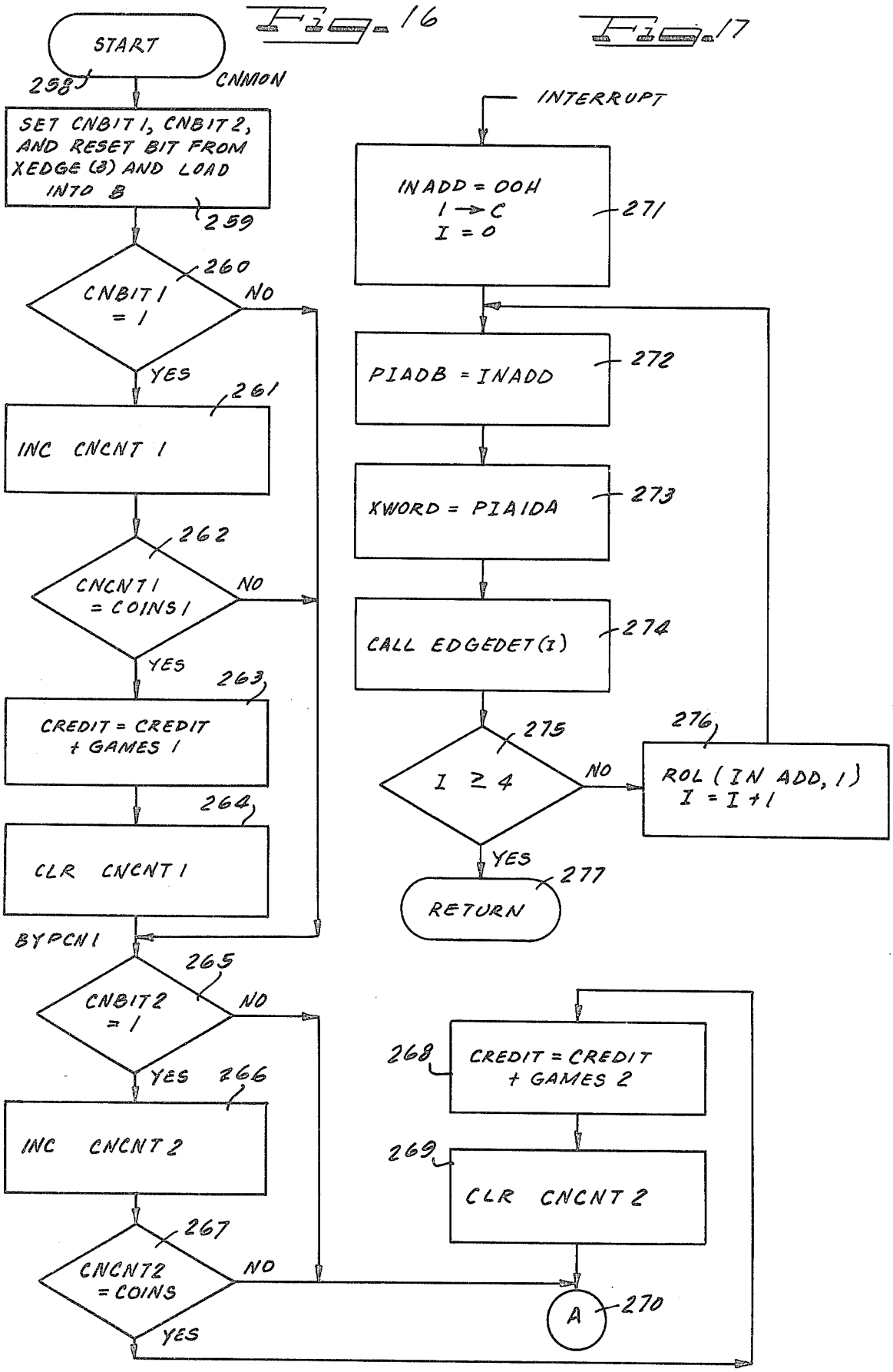

FIG. 16 is a subroutine used to monitor coins and give appropriate credit.

FIG. 17 illustrates a subroutine for interrupt which is initiated by a 120 cycle per second signal which reads the 5 bit byte by 8 bite input matrix and processes the input data using EDGEDET.

FIG. 18 is a new game routine.

FIG. 19 illustrates a routine for collecting display of bonus.

Figure 21:
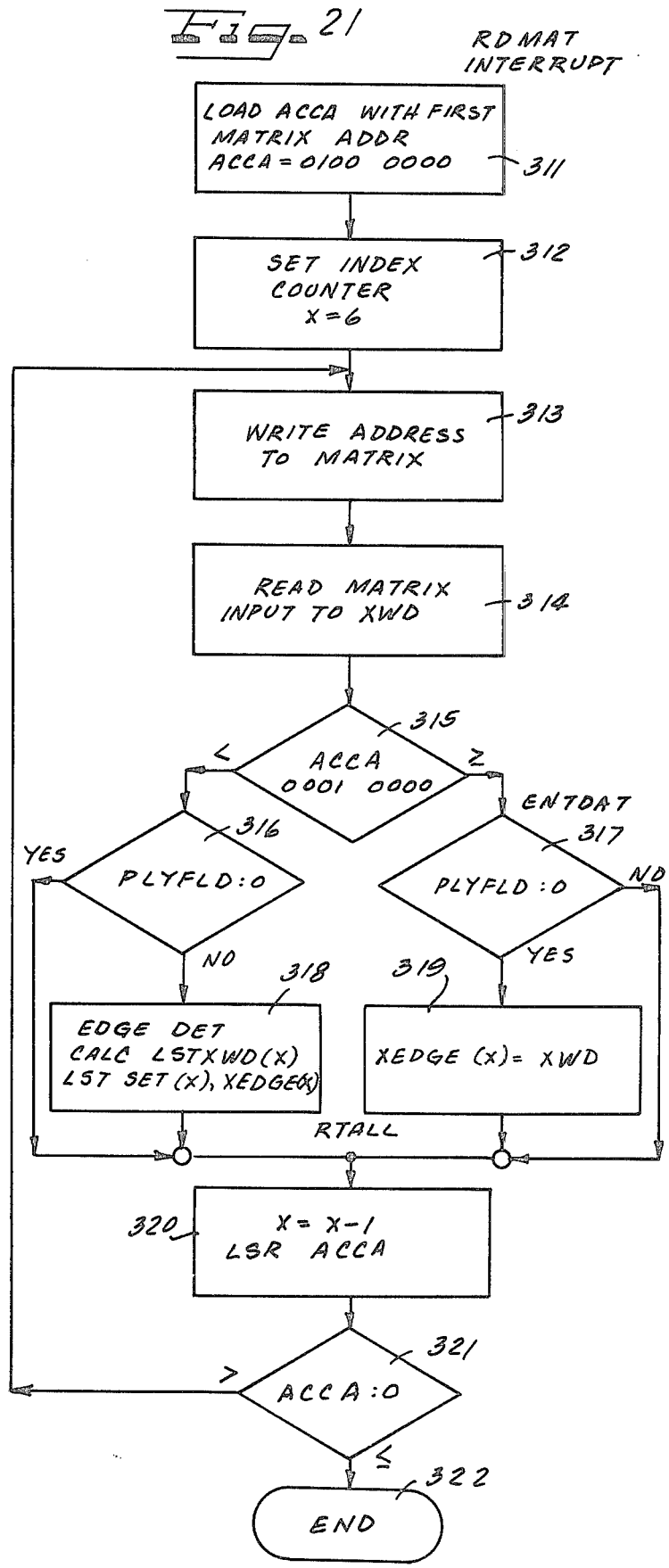

FIG. 21 illustrates the routine which reads data from 7 by 8 input matrixes.

Figures 22, 23:
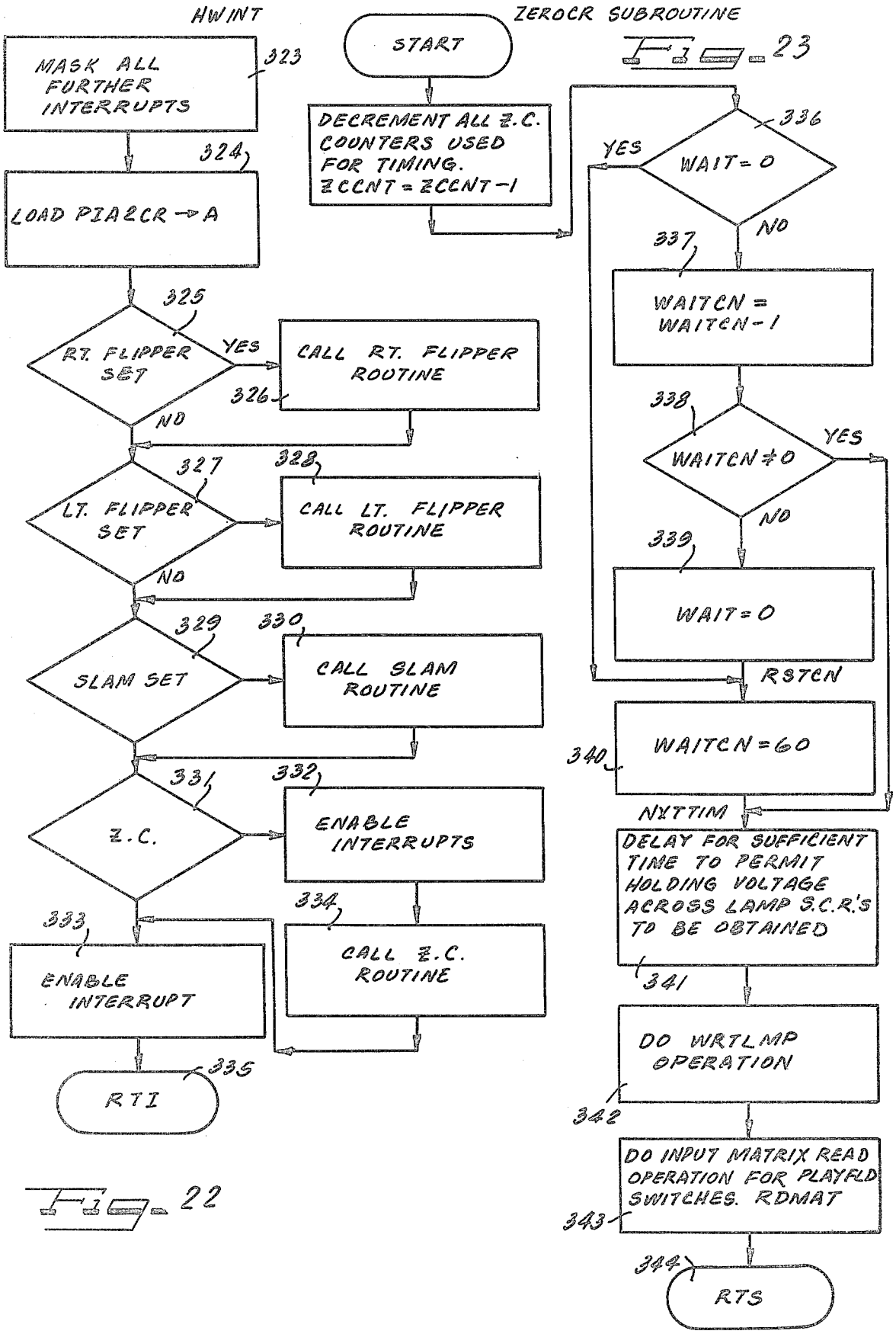

FIG. 22 illustrates the routine which identifies the active interrupt port and transfers control to an appropriate routine.

FIG. 23 illustrates the zero credit subroutine.

FIG. 24 illustrates the subroutine for scoring.

FIG. 25 is a subroutine for checking various values that have changed states.

FIG. 26 illustrates a routine for lighting bonus lights.

Figures 27, 31:
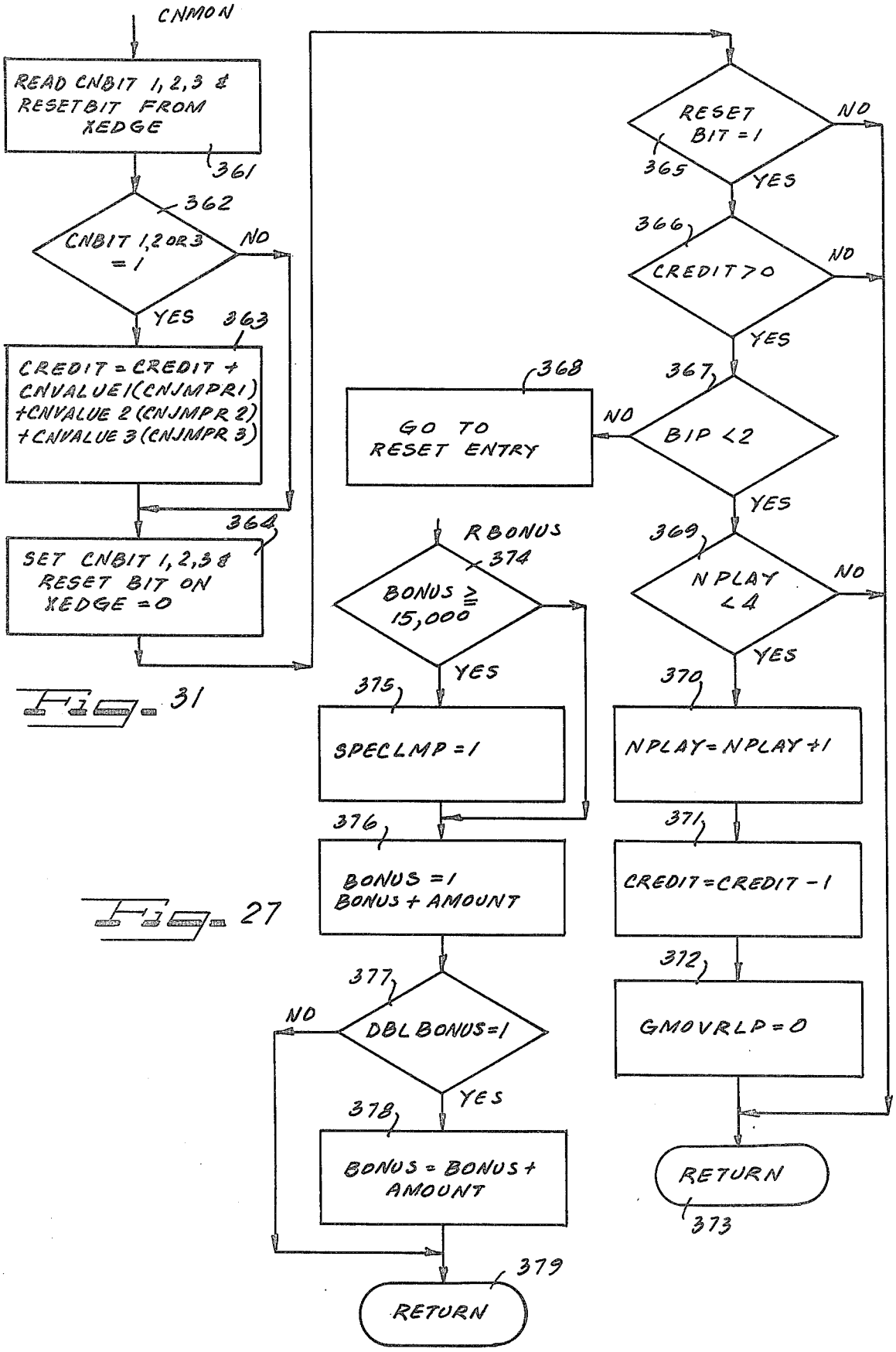

FIG. 27 is a bonus amount subroutine which is used to register the amount of bonus after a target is hit.

Figure 28:
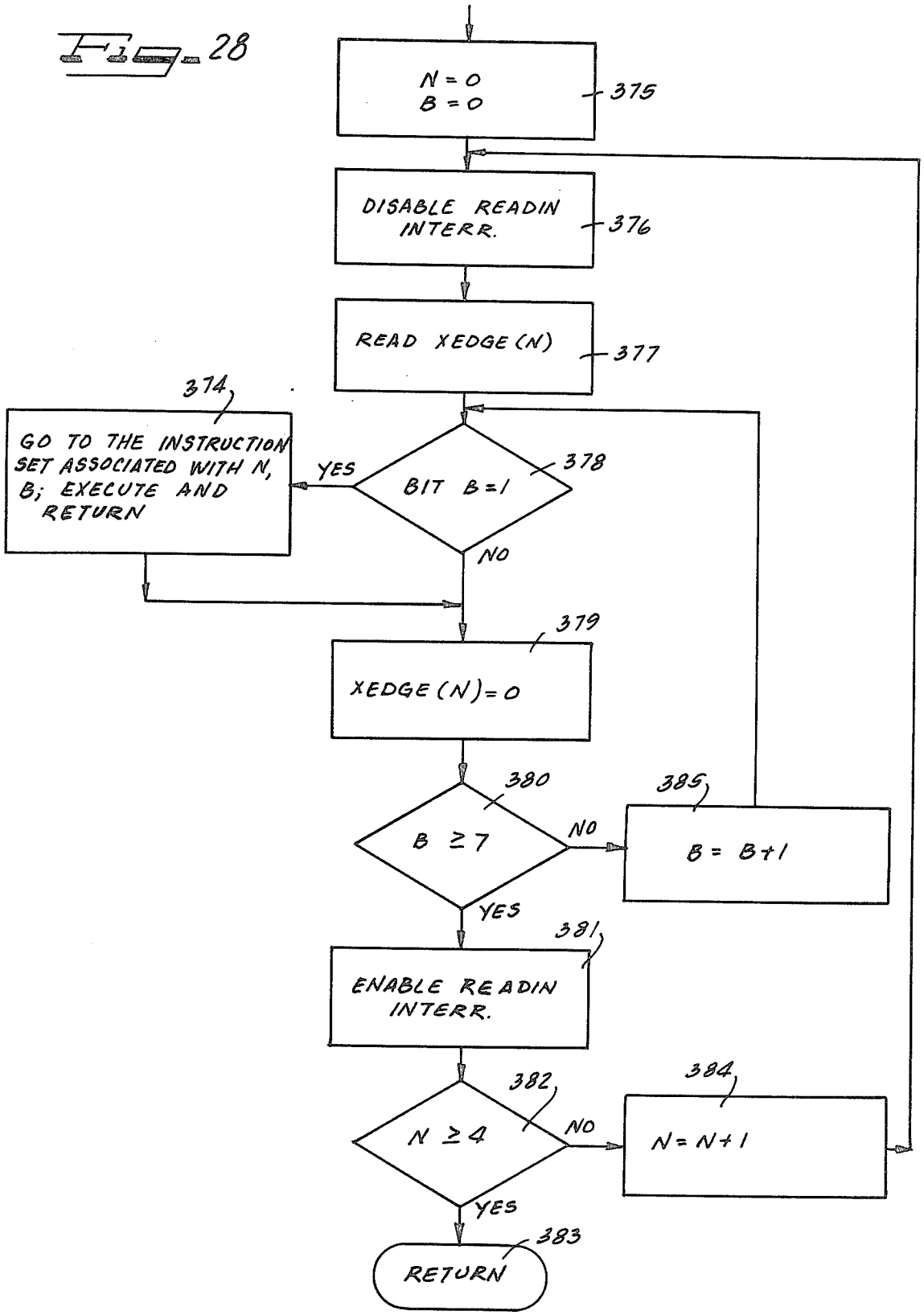

FIG. 28 is a subroutine for monitoring the target hits and scores accordingly.

Figure 29:
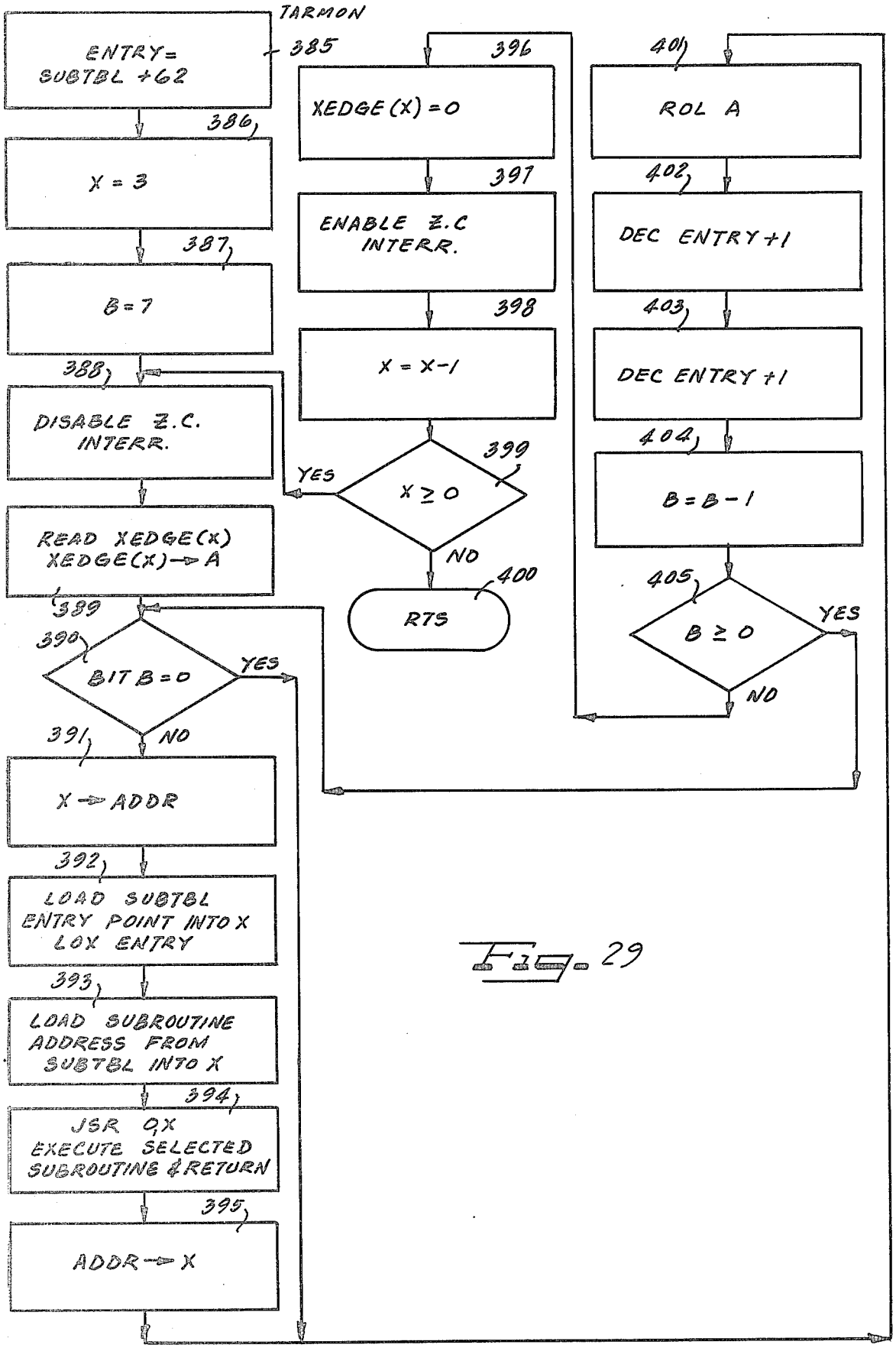

FIG. 29 is a routine for monitoring the target hits. This routine scans each bit of the words jumping to a designated subroutine when a bit is set.

FIG. 30 illustrates a routine to determine free game threshold.

FIG. 31 is an alternative subroutine for monitoring coins and giving appropriate credit.

FIG. 32 is a routine to shift a specified bit to the carry flag position.

Although this invention has been described with respect to preferred embodiments, it is not to be so limited as changes and modifications may be made which are within the full intended scope as defined by the appended claims.

PROGRAM FOR MPU

OF INVENTION

```
00100                    NAM     FOURTH
00110                    OPT     DB16,MEM,SYMBOL
01001              * F R O N T
01002              *RAM LABEL ASSIGNMENTS
01005      005A    BEGSTK EQU     90        LOAD ADDR. FOR BEGIN STACK.
01010      0048    RESRAM EQU     BEGSTK-18   STRT.RESV.RAM AREA
01015              *STARTING AREA
01035              *PIA LABEL ASSINGMENTS
01040      0034    PIAIDA EQU     $84
01045      0035    PIAICA EQU     PIA1DA+1
01050      0086    PIA1DB EQU     PIA1DA+2
01055      0087    PIA1CB EQU     PIA1DA+3
01060      0088    PIA2DA EQU     $88
01065      0089    PIA2CA EQU     PIA2DA+1
01070      008A    PIA2DB EQU     PIA2DA+2
01075      008B    PIA2CB EQU     PIA2DA+3
01079      0090    PIA3DA EQU     $90
01080      0091    PIA3CA EQU     PIA3DA+1
01081      0092    PIA3DB EQU     PIA3DA+2
01082      0093    PIA3CB EQU     PIA3DA+3
01083              *ROM LABEL ASSIGNMENTS
01085      0800    BEGROM EQU     $0800
01090              *LAMP SYMBOL ASSIGNMENTS
01095      0000    DRLPA0 EQU     %00000000    A TARGET OFF
01100      0080    DRLPA1 EQU     %10000000    A TARGET ON
01105      0001    DRLPB0 EQU     %00000001    B TARGET OFF
01110      0081    DRLPB1 EQU     %10000001    B TARGET ON
01115      0002    DRLPC0 EQU     %00000010    C TARGET OFF
01120      0082    DRLPC1 EQU     %10000010    C TARGET ON
01125      0003    DRLPD0 EQU     %00000011    D TARGET OFF
01130      0083    DRLPD1 EQU     %10000011    D TARGET ON
01135      0004    RVLPA0 EQU     %00000100    A ROLLOVER OFF
```

```
01140   0084   RVLPA1 EQU   %10000100   A ROLLOVER ON
01145   0005   RVLPB0 EQU   %00000101   B ROLLOVER OFF
01150   0085   RVLPB1 EQU   %10000101   B ROLLOVER ON
01155   0006   RVLPC0 EQU   %00000110   C ROLLOVER OFF
01160   0086   RVLPC1 EQU   %10000110   C ROLLOVER ON
01165   0007   RVLPD0 EQU   %00000111   D ROLLOVER OFF
01170   0087   RVLPD1 EQU   %10000111   D ROLLOVER ON
01175   0010   BL01K0 EQU   %00010000   1K BONUS OFF
01180   0090   BL01K1 EQU   %10010000   1K BONUS ON
01185   0011   BL02K0 EQU   %00010001   2K BONUS OFF
01190   0091   BL02K1 EQU   %10010001   2K BONUS ON
01195   0012   BL03K0 EQU   %00010010   3K BONUS OFF
01200   0092   BL03K1 EQU   %10010010   3K BONUS ON
01205   0013   BL04K0 EQU   %00010011   4K BONUS OFF
01210   0093   BL04K1 EQU   %10010011   4K BONUS ON
01215   0014   BL05K0 EQU   %00010100   5K BONUS OFF
01220   0094   BL05K1 EQU   %10010100   5K BONUS ON
01225   0015   BL05K0 EQU   %00010101   6K BONUS OFF
01230   0095   BL06K1 EQU   %10010101   6K BONUS ON
01235   0016   BL07K0 EQU   %00010110   7K BONUS OFF
01240   0096   BL07K1 EQU   %10010110   7K BONUS ON
01245   0017   BL08K0 EQU   %00010111   8K BONUS OFF
01250   0097   BL08K1 EQU   %10010111   8K BONUS ON
01255   0020   BL09K0 EQU   %00100000   9K BONUS OFF
01260   00A0   BL09K1 EQU   %10100000   9K BONUS ON
01265   0021   BL10K0 EQU   %00100001   10K BONUS OFF
01270   00A1   BL10K1 EQU   %10100001   10K BONUS ON
01275   0022   DBLBN0 EQU   %00100010   DOUBLE BONUS OFF
01280   00A2   DBLBN1 EQU   %10100010   DOUBLE BONUS ON
01285   0023   BL010  EQU   %00100011   INCREMENT BONUS 1 OFF
01290   00A3   BL011  EQU   %10100011   INCREMENT BONUS 1 ON
01295   0024   BL020  EQU   %00100100   INCREMENT BONUS 2 OFF
01300   00A4   BL021  EQU   %10100100   INCREMENT BONUS 2 ON
01305   0025   BL030  EQU   %00100101   INCREMENT BONUS 3 OFF
01310   00A5   BL031  EQU   %10100101   INCREMENT BONUS 3 ON
01315   0026   BL040  EQU   %00100110   INCREMENT BONUS 4 OFF
01320   00A6   BL041  EQU   %10100110   INCREMENT BONUS 4 ON
01325   0027   BL050  EQU   %00100111   INCREMENT BONUS 5 OFF
01330   00A7   BL051  EQU   %10100111   INCREMENT BONUS 5 ON
01335   0030   BL060  EQU   %00110000   INCREMENT BONUS 6 OFF
01340   00B0   BL061  EQU   %10110000   INCREMENT BONUS 6 ON
01345   0031   BL070  EQU   %00110001   INCREMENT BONUS 7 OFF
01350   00B1   BL071  EQU   %10110001   INCREMENT BONUS 7 ON
01355   0032   BL080  EQU   %00110010   INCREMENT BONUS 8 OFF
01360   00B2   BL081  EQU   %10110010   INCREMENT BONUS 8 ON
01365   0033   BL090  EQU   %00110011   INCREMENT BONUS 9 OFF
01370   00B3   BL091  EQU   %10110011   INCREMENT BONUS 9 ON
01375   0034   BL100  EQU   %00110100   INCREMENT BONUS 10 OFF
01380   00B4   BL101  EQU   %10110100   INCREMENT BONUS 10 ON
01385   0035   LXBLP0 EQU   %00110101   LT. EXTRA BALL OFF
01390   00B5   LXBLP1 EQU   %10110101   LT. EXTRA BALL ON
01395   0036   RXBLP0 EQU   %00110110   RT. EXTRA BALL OFF
01400   00B6   RXBLP1 EQU   %10110110   RT. EXTRA BALL ON
01405          * EQU %00110111
01410          * EQU %10110111
01415   0040   UP1LP0 EQU   %01000000   1 UP OFF
01420   00C0   UP1LP1 EQU   %11000000   1 UP ON
01425   0041   UP2LP0 EQU   %01000001   2 UP OFF
01430   00C1   UP2LP1 EQU   %11000001   2 UP ON
01435   0042   UP3LP0 EQU   %01000010   3 UP OFF
01440   00C2   UP3LP1 EQU   %11000010   3 UP ON
01445   0043   UP4LP0 EQU   %01000011   4 UP OFF
01450   00C3   UP4LP1 EQU   %11000011   4 UP ON
01455   0044   PLY1N0 EQU   %01000100   1 NO. OF PLAYERS OFF
01460   00C4   PLY1N1 EQU   %11000100   1 NO. OF PLAYERS ON
01465   0045   PLY2N0 EQU   %01000101   2 NO. OF PLAYERS OFF
```

```
00C5    PLY2N1 EQU    %11000101   2 NO. OF PLAYERS ON
0046    PLY3N0 EQU    %01000110   3 NO. OF PLAYERS OFF
00C6    PLY3N1 EQU    %11000110   3 NO. OF PLAYERS ON
0047    PLY4N0 EQU    %01000111   4 NO. OF PLAYERS OFF
00C7    PLY4N1 EQU    %11000111   4 NO. OF PLAYERS ON
0050    MTLP00 EQU    %01010000   00 MATCH OFF
00D0    MTLP01 EQU    %11010000   00 MATCH ON
0051    MTLP10 EQU    %01010001   10 MATCH OFF
00D1    MTLP11 EQU    %11010001   10 MATCH ON
0052    MTLP20 EQU    %01010010   20 MATCH OFF
00D2    MTLP21 EQU    %11010010   20 MATCH ON
0053    MTLP30 EQU    %01010011   30 MATCH OFF
00D3    MTLP31 EQU    %11010011   30 MATCH ON
0054    MTLP40 EQU    %01010100   40 MATCH OFF
00D4    MTLP41 EQU    %11010100   40 MATCH ON
0055    MTLP50 EQU    %01010101   50 MATCH OFF
00D5    MTLP51 EQU    %11010101   50 MATCH ON
0056    MTLP60 EQU    %01010110   60 MATCH OFF
00D6    MTLP61 EQU    %11010110   60 MATCH ON
0057    MTLP70 EQU    %01010111   70 MATCH OFF
00D7    MTLP71 EQU    %11010111   70 MATCH ON
0060    MTLP80 EQU    %01100000   80 MATCH OFF
00E0    MTLPS1 EQU    %11100000   80 MATCH ON
0061    MTLP90 EQU    %01100001   90 MATCH OFF
00E1    MTLP91 EQU    %11100001   90 MATCH ON
0062    BIPL10 EQU    %01100010   1 BALL IN PLAY OFF
00E2    BIPL11 EQU    %11100010   1 BALL IN PLAY ON
0063    BIPL20 EQU    %01100011   2 BALL IN PLAY OFF
00E3    BIPL21 EQU    %11100011   2 BALL IN PLAY ON
0064    BIPL30 EQU    %01100100   3 BALL IN PLAY OFF
00E4    BIPL31 EQU    %11100100   3 BALL IN PLAY ON
0067    BIPL40 EQU    %01100111   4 BALL IN PLAY OFF
00E5    BIPL41 EQU    %11100101   4 BALL IN PLAY ON
0066    BIPL50 EQU    %01100110   5 BALL IN PLAY OFF
00E6    BIPL51 EQU    %11100110   5 BALL IN PLAY ON
0067    GNILL1 EQU    %01100111
00E7    GNILL0 EQU    %11100111
        * EQU %01110000
        * EQU %11110000
        * EQU %01110001
        * EQU %11110001
        * EQU %01110010
        * EQU %11110010
        * EQU %01110011
        * EQU %11110011
0074    SPCLP0 EQU    %01110100   LT. AND RT. SPECIAL OFF
00F4    SPSLP1 EQU    %11110100   LT. AND RT. SPECIAL ON
0075    STAGN0 EQU    %01110101   SHOOT AGAIN OFF
00F5    STAGN1 EQU    %11110101   SHOOT AGAIN ON
0076    TLTLPG EQU    %01110110   TILT OFF
00F6    TLTLP1 EQU    %11110110   TILT ON
0077    GMOVR0 EQU    %01110111   GAME OVER OFF
00F7    GMOVR1 EQU    %11110111   GAME OVER ON
        *RAM ALLOCATIONS
0000            ORG   00
0000 0002       ADDR2 RMB   2
0002 0002       ADDR  RMB   2       BITRD,BITWRT
0004 0001       CHIME RMB   1
0005 0002       SCRWRD RMB  2
0007 0001       XWD   RMB   1       RDMAT
0008 0001       QLOOP RMB   1
0009 0001       XST   RMB   1       RDMAT
000A 0001       CURENT RMB  1
000B 0001       DESIRD RMB  1
000C 0001       REPEAT RMB  1       RDMAT
000D 0001       SEARCH RMB  1
```

```
01757 000E 0001      REPLCE RMB    1
01768 000F 0001      DISPLY RMB    1
01770 0010 0001      PLYFLD RMB    1        RDMAT
01771 0011 0002      ADDOFF RMB    2
01772 0013 0001      BMULT  RMB    1
01775 0014 0001      PCOUNT RMB    1
01775 0015 0008      LMPMAT RMB    8        WRTLMP, BITWRT
01780 001D 0001      TEMP   RMB    1        BITWRT
01790 001E 0002      ENTRY  RMB    2        TARMON
01795 0020 0001      ZCCNT  RMB    1        DELAY,ZEROCR
01800 0021 0001      BIP    RMB    1        MAIN
01805 0022 0001      NUP    RMB    1        MAIN
01810 0023 0001      NPLAY  RMB    1
01815 0024 0001      BITNUM RMB    1
01820 0025 0003      BONUS  RMB    3
01822 0028 0001      MATCH  RMB    1
01825 0029 0003      ADDEND RMB    3
01835 002C 0001      TILT   RMB    1
01840 002D 0001      OTHLFG RMB    1        OUTHL,MAIN
01845 002E 0001      WAIT   RMB    1        ZEROCR
01850 002F 0001      WAITCN RMB    1        SEROCR
01880 0030 0001      CNCNT1 RMB    1        CNMON
01884 0031 0001      DECADD RMB    1
01885 0032 0001      CHCNT2 RMB    1        CNMON
01895 0033 0004      LSTXWD RMB    4
01897 0037 0004      LSTXST RMB    4
01899 003B 0007      XEDGE  RMB    7
01905 0042 0003      SCORE1 RMB    3
01906 0045 0003      SCORE2 RMB    3
01907 0046 0003      SCORE3 RMB    3
01908 004B 0003      SCORE4 RMB    3
01909 004E 0001      CREDIT RMB    1
01910 004F 0001      DGTADD RMB    1
01911 0050 0001      MATCHD RMB    1
01912 0051 0002      XSTART RMB    2
01913 0053 0001      SHFTFG RMB    1
01920                *
01925                *
01930                *
01935                *
01940                *PIA INITIALIZATION
01945 0800                 ORG    BEGROM
01950                *BEGIN ACTIVE PROGRAM, ENTERED FROM RESTART INT.
01958 0800 86 7F     BEGROM LDA A  #%01111111
01960 0802 97 84           STA A  PIA1DA
01965 0804 73 0086         COM    PIA1DB
01970 0807 73 0088         COM    PIA2DA
01975 080A 73 008A         COM    PIA2DB
01976 080D 73 0090         COM    PIA3DA
01977 0810 73 0092         COM    PIA3DB
01980                *
01985 0813 86 2E           LDA A  #%00101110
01990 0815 97 85           STA A  PIA1CA
01995 0817 86 36           LDA A  #%00110110
02000 0819 97 87           STA A  PIA1CB
02005 081B 86 16           LDA A  #%00010110
02010 081D 97 89           STA A  PIA2CA
02012 081F 86 0D           LDA A  #%00001101
02013 0821 97 8B           STA A  PIA2CB
02014 0823 86 25           LDA A  #%00100101
02015 0825 97 91           STA A  PIA3CA
02016 0827 86 24           LDA A  #%00100100
02017 0829 97 93           STA A  PIA3CB
02015                *
02027                *INIT STACK POINTER
02028                *(SWI.Z.C.,DISPLAY,SLAM)
```

```
05445                *ALSO BONUS IF CORRESPONDING LAMP IS LIT.
05450                *
05455                *
05460 0948 CE 001B RLVSWC LDX      #LMPMAT+6  WORD LOCATION OF ROLLOVE
05465                *                  SW. LMP. C.
05470 094B 20 E3          BRA      RLVSWX
```

```
05485                *NAM RLVSWB
05490                *THIS ROUTINE IS ACTIVIATED BY THE B ROLLOVER BUTT
05495                *THE ROUTINE LOADS X WITH THE WORD LOCATION OF ROL
05500                *OVER SWITCH LAMP B AND CALLS RLVSWX (SUPPLIES
05505                *THE BIT LOCATION) TO INCREMENT SCORE BY 1000 AND
05510                *ALSO BONUS IF CORRESPONDING LAMP IS LIT.
05515                *
05520                *
05525 094D CE 001A RLVSWB LDX      #LMPMAT+5   WORD LOCATION OF ROLLOVE
05530                *                  SW. LMP. B.
05535 0950 20 DE          BRA      RLVSWX
0550                 *NAM RLVSWA
05555                *THIS ROUTINE IS ACTIVIATED BY THE A ROLLOVER BUTT
05560                *THE ROUTINE LOADS X WITH THE WORD LOCATION OF ROL
05565                *OVER SWITCH LAMP A AND CALLS RLVSWX (SUPPLIES
05570                *THE BIT LOCATION) TO INCREMENT SCORE BY 1000 AND
05575                *ALSO BONUS IF CORRESPONDING LAMP IS LIT.
05580                *
05585                *
05590 0952 CE 0019 RLVSWA LDX      #LMPMAT+4   WORD LOCATION OF
05595                                     ROLLOVER SW. LMP.A.
05600 0955 20 D9          BRA      RLVSWX
```

```
05615                *NAM RLVSW
05620                *THIS ROUTINE IS ACTIVATED BY THE FOUR 1K ROLLOVER
05625                *SWITCHES, NOT INCLUDING THOSE ASSOCATED WITH THE
05630                *A,B,C &D 1K DROP TARGETS. THE ROUTINE FORMS
05635                *SCORE(NUP)=SCORE(NUP)÷1000 AND BONUS=BONUS+1000.
05640                *THE ROUTINE IS ALSO ACTIVATED BY THE 1K CHANNEL
05645                *SWITCHES BECAUSE THEY HAVE THE SAME SCORING
05650                *REQUIREMENTS.
05655                *ADD 1000 TO SCORE
05660 0957 86 81   RLVSW  LDA A    #$81
05670 0959 BD 0DDC        JSR      SCOREX
05675                *INCREMENTS BONUS BY 1000
05680 095C 86 10          LDA A    #%00010000  (10 BCD)
05685 095E 97 2A          STA A    ADDEND+1
05690 0960 BD 0B8A        JSR      RBONUS
05695 0963 39             RTS
```

```
05705                *NAM REBOUN
05710                *THIS ROUTINE IS CALLED BY TARMON WHEN THE REBOUND
05715                *SENSOR IS HIT. THE ROUTINE INCREASES SCORE AND
05720                *MATCH BY 10. MATCH CONSISTS OF TWO HALF BYTES FOR
05725                *THE UNITS AND TENS POSITIONS.  THE REGISTER IS INCR
05730                *BY 10 FROM 0 TO 90 WITH NO CARRIES GENERATED TO
```

```
05735                *A FOLLOWING BYTE.
05740                *
05745                *
05750                *INCREMENT SCORE BY 10
05755 0964 86 01     REBOUN LDA A    #$01
05765 0966 BD 0DDC          JSR      SCOREX
05770                *ADD 10 TO MATCH (BCD)
05775 0969 86 10            LDA A    #%00010000
05780 096B 9B 28            ADD A    MATCH
05785 096D 19               DAA
05786 096E 97 28            STA A    MATCH
05790 0970 39                            RTS
05800                *NAM SPCIAL
05805                *THIS ROUTINE IS CALLED BY TARMON WHEN THE
05810                *SPECIAL IS HIT.THE ROUTINEINCREMENTS CREDIT
                     *IF BONUS=>
05815                *
05820                *
05825                *CHECK FOR BONUS=>15,000.TEST SPECIAL LAMP
05830 0971 CE 0019 SPCIAL LDX #LMPMAT+4  LOAD ADDRESS & BIT LOCAT
05835 0974 C6 07            LDA B #7
05840 0976 BD 0D38          JSR      BITRD
05845 0979 24 0B            BCC      BYPSPL BRANCH IS SPECIAL LAMP=0
05850 097B 7C 004E          LDA A    #1
                            ADD A    CREDIT
                            DAA
                          ) STA A    CREDIT
05851                *OPERATE KNOCKER
05852 097E CE 0086          LDX      #PIA1DB
05853 0981 86 07            LDA A    #7
05854 0983 BD 0AD0          JSR      SLNPLS
05855 0986 39        *BYPSPL RTS
05865                *NAM RSLGST
05870                *THIS ROUTINE IS CALLED BY TARMON WHEN THE RIGHT
05875                *SLING SHOT SENSOR IS HIT.THE ROUTINE IS
05880                *BYPASSED IF TILT=1.
05885                *
05890                *
05895                *BYPASS IF TILT=1
05900 0987 7D 002C RSLGST TST       TILT
05905 098A 26 0D            BNE      ENDRSL
05908                *PULSE RIGHT SLINGSHOT SOLENOID
05909 098C                  LDX      #PIA1DB  LOAD ADDR. P BIT LOCATION
05910 098F                  LDX A    #2
05911 0991                  JSR      SLNPLS
05912                *ADD 10 TO SCORE
05915 0094 86 01            LDA A    #$01
05925 0996 BD 0DDC          JSR      SCOREX
05950 0999 39        ENDRSL RTS


05960                *NAM LSLGST
05965                *THIS ROUTINE IS CALLEDBYTARMON WHEN THE LEFT
05970                *SLINGSHOT SENSOR IS HIT.
05975                *
05980                *
05985                *BYPASS IF TILT=1
05990 099A 7D 002C LSLGST TST       TILT
05995 099D 26 0D            BNE      ENDLSL
05998                *PULSE LEFT SLINGSHOT SOLENOID
05999 099F                  LDX      #PIA1DB  LOAD ADDR. P BIT LOCATION
06000 09A2 86 03            LDA  A   #3
06001 09A4                  JSR      SLNPLS
06002                *ADD 10 TO SCORE
06005 09A7 86 01            LDA A    #$01
```

```
03540 08E7 49                ROL A
03545 08E8 49                ROL A
03550 08E9 49                ROL A
0355 08EA 8B 03              ADD A    #3 CONVERT CONTROL BIT TO MAX.
03560 08EC 91 21             CMP A    BIP
03565 08EE 22 A6             BHI      NEWBAL GO TO NEXT BALL
03570                 *NO REMAINING BALLS GAME IS OVER
03575                 *TEST ALL SCORES FOR MATCH AND FREE GAME.
03577                 *GIVE APPROPRIATE CREDITS.
03580 08F0 BD 0C0A           JSR      MATCHK
03585                 *BRANCH TO NEW GAME
03590 08F3 7E 085A           JMP      NEWGAM
03595                 *
03600                 *
03605                 *
03610                 * E N T E R S U B R O U T I N E S
05000                 * P L Y S U B


05005                 *NAM TOPHOL
05010                 *THIS ROUTINE INCREMENTS CURRENT PLAYERS SCORE
05015                 *BY PULSES BALL EJECT SOLENOID AFTER 300MS DELAY
05020                 *AND DISABLES THE TOP HOLE SENSOR FOR 0.5SEC
                      *AFTER BAL
05025                 *
05030                 *
05035                 *TEST FLAG WAIT FOR 0.5 SEC DISABLE CONDITION
05040                 *AND SKIP ROUTINE IF WAIT=1.
04034 08F6 7D 002E TOPHOL TST      WAIT
05050 08F9 26 13             BNE      BYPSHL
05055                 *INCREMENT SCORE BY 3000
05060 08FB 86 83             LDA A    #$83
05070 08FD BD 0DDC           JSR      SCOREX
05075                 *WAIT 300MS FOR BALL TO SETTLE INTO POSITION
05080 0900 C6 24             LDA B    #36
05085 0902 BD 0C9E           JSR      DELAY
05090                 *PULSE TOP HOLE EJECT SOLENOID FOR 25MS
05095 0905 CE 0086           LDX      #PIA1DB  LOAD ADDRESS AND BIT LOCAT
05100 0908 86 05             LDA A    #5
05105 090A BD 0AD0           JSR      SLNPLS
05110                 *DISABLE TOP HOLE SENSOR FOR 0.5SEC. INITIALIZE
05115                 *WAIT (DECREMENTED BY Z.C.)
05120 090D 43                LDA A    #60
                             STA A    WAIT
05125 090E 39         BYPSHIL RTS

05135                 *NAM THUBPR
05140                 *THIS ROUTINE IS CALLED BY TARMON WHEN THE
05145                 *THUMPER BUMPER SENSOR IS HIT. SCORE IS INCREASED
05150                 *BY 100 A  THE SOLENOID PULSED FOR 25MS.
05155                 *THE ROUTINE IS BYPASSED IF
05160                 *TILT=1
05165 090F 7D 002C THUBPR TST      TILT
05170 0912 26 0D             BNE      ENDTH
05175                 *
05180                 *
05185                 *PULSE SOLENOID
05186                        LDX      #PIA1D8 LOAD ADDRESS AND BIT LOCAT
05186 0917
05188 0919
05189                 *INCREASE SCORE BY 100
05190 091C 86 41             LDA A    #$41
05200 091E BD 0DDC           JSR      SCOREX
05221 0921 39         ENDTH  RTS
```

```
05223                 *NAM RTILT
05224                 *THIS ROUTINE SETS TILT LIGHT AND FLAG AND
05225                 *INHIBITS FLIPPER ACTION. ROUTINE INHIBITS
05226                 *SCORING AND BONUS COLLECTION,THUMPER BUMPED
05227                 *AND SLINGSHOT ACTION THRU THE TILT FLAG.
05228 0922 86 01      RTILT  LDA A    #1 SET TILT FLAG
05229 0924 97 2C             STA A    TILT
05230 0926 86 F6             LDA A    #TILTP1
05231 0928 BD 0C7D           JSR      LPCTRL  LIGHT TILT LAMP.
05232 092B 86 FF             LDA A    #$OFF
05233 092D 97 86             STA A    PIA1DB DISABLE FLIPPERS.
05234 092F 39                RTS


05236                 *NAM RLVSWX
05240                 *THIS ROUTINE IS CALLED BY THE ROLLOVER SWITCH
05245                 *A,B D SUBROUTINE. IT ACCEPTS A SWITCH
05250                 *IDENTIFIER (A,B D), IN THE FORM OF A WORD
05255                 *LOCATION FOR THE CORRES A,B,C,D ROLLOVER
05260                 *LAMP BIT. THE ADDR. IS IN X FROM CALLING
05265                 *PROGRAM.  INCREMENTS THE SCORE BY 1000. BO
05270                 *IS INCREMENTED BY 1000 IF THE CORRESPONDING
                      *ROLLO IS LIT.
05275                 *
05280                 *
05285                 *INCREMENT BONUS BY 1000 IF CORRESPONDING ROLL
05290                 *OVER LAMP IS LIT.ADDRESS OF WORD HOLDING LAMP
                       BIY IN X
05295 0930 5F         RLVSWX CLR B    LOAD BIT LOCATION AND GET B
05300 0931 BD 0D38           JSR      BITRD
05305 0934 24 07             BCC      PYPSWX BRANCH IF NO BONUS
05310 0936 86 10             LDA A    #%00010000 INCREMENT BONUS
05315 0938 97 2A             STA A    ADDEND+1
05320 093A BD 0 B8A          JSR      RBONUS
05325                 *INCREMENT SCORE BY 1000
05330 093D 86 81      BYPSWX LDA A    #$81
05340 093F BD 0DDC           JSR      SCOREX
05345 0942 39                RTS


05355                 *NAM RLVSWD
05360                 *THIS ROUTINE IS ACTIVATED BY THE D ROLLOVER BUTT
05365                 *THE ROUTINE LOADS X WITH THE WORD LOCATION OF ROL
05370                 *OVER SWITCH LAMP D AND CALLS RLVSWX (SUPPLIES
05375                 *THE BIT LOCATION) TO INCREMENT SCORE BY 1000 AND
05380                 *ALSO BONUS IF CORRESPONDING LAMP IS LIT.
05385                 *
05390                 *
05395 0943 CE 001C RLVSWD LDS      #LMPMAT+7   WORD LOCATION OF ROLLOVE
05400                 *                   SW. LMP. D.
05405 0946 20 E8             BRA      RLVSWX


05420                 *NAM RLVSWC
05425                 *THIS ROUTINE IS ACTIVATED BY THE C ROLLOVER BUTT
05430                 *THE ROUTINE LOADS X  WITH THE WORD LOCATION OF ROL
05435                 *OVER SWITCH LAMP C AND CALLS RLVSWX (SUPPLIES
05440                 *THE BIT LOCATION) TO INCREMENT SCORE BY 1000 AND
```

```
06015 09A9 BD 0DDC        JSR      SCOREX
06040 09AC 39      ENDLSL RTS


06050              *NAM OUTHL
06055              *THIS ROUTINE ISCALLED BY TARMON WHEN THE OUTHOLE
06060              *SENSOR IS HIT.THE FLAG OTHLFG,BIT7,IS SET TO ZERO
06065              *TO INDICATE TO THE MAIN PROGRAM THAT THE BALL
                   *HAS EXITED.
06070              *
06075              *
06080 09AD 86 01   OUTHL  LDA A    OTHLFG
                          AND A    #$7F
06085 09AF 97 2D          STA A    OTHLFG THE FLAG IS REST UPON ENTE
06090 09B1 39             RTS



06100              *NAM CHANIK
06105              *THIS ROUTINE IS CALLED BY TARMON WHEN THE 1K CHAN
06110              *SWITCH IS HIT.INCREMENTS SCORE AND BONUS BY 1000
06115              *CALL RLVSW WHICH HAS THE SAME SCORING REQUIREMENT
06120 09B2 7E 0957 CHANIK JMP      RLVSW


06135              *NAM CHANNX
06140              *THIS ROUTINE IS EXECUTED WHENEVER THE LEFT
06145              *OR RIGHT 500 CHANNELS ARE HIT. THE ENTRY POINT
06150              *IS DEPENDENT UPON WHETHER THE LEFT OR RIGHT
06155              *CHANNEL IS HIT. THIS ROUTINE SETS THE SHOOT
06160              *AGAIN LAMP WHEN THE LEFT EXTRA BALL LAMP IS
06165              *SET AND THE LEFT CHANNEL IS HIT OR WHEN THE
06170              *RIGHT EXTRA BALL LAMP IS SET AND THE RIGHT
06175              *CHANNEL IS HIT. SCORE IS INCREMENTED BY 500
06180              *WHENEVER EITHER CHANNEL IS HIT.
06185              *
06190              *
06195              *LOAD ADDRESS OF RIGHT EXTRA BALL LAMP.
06200 09B5 CE 001B CHANNR LDX      #LMPMAT+6
06205 09B8 DF 02          STX      ADDR
06210 09BA 20 03          BRA      CHANNX
06215              *LOAD ADDRESS OF LEFT EXTRA BALL LAMP.
06220 09BC CE 001A CHANNL LDX      #LMPMAT+5
06225              *LOAD BIT POSITION OF RIGHT EXTRA BALL
06230              *LAMP=LEFT
06235 09BF C6 03   CHANNX LDA B    #3
06240              *TEST SELECTED EXTRA BALL LAMP,BIT,IF 1
06245              *THEN LIGHT SHOOT AGAIN LAMP.
06250 09C1 BD 0D38        JSR      BITRD
06255 09C4 24 05          BCC      BYPSET
06260 09C6 86 F5          LDA A    #STAGN1   LIGHT SHOTT AGAIN LIGHT,RE
06265              *                 AFTER BALL IS DELIVERED TO
06270              *                 SHOOTER TIP.
06280 09C8 BD 0C7D        JSR      LPCTRL
06285              *ADD 500 TO SCORE
06290 09CB 86 45   BYPSET LDA A    #$45
06300 09CD BD 0DDC        JSR      SCOREX
06305 09D0 39             RTS
06315              *NAM DROPX
06320              *   THIS ROUTINE IS ACTIVATED THRU TARMON BY
06325              *A HIT ON ANY OF THE A,B,C,OR D DROP TARGET
```

```
06330                 *SWITCHES. THE ROUTINE ACTIVATES THE CORRES.
06335                 *ROLLOVER LAMP AND RESETS THE ASSOC.
06340                 *DROP TARGET LAMP. ADDITIONALLY, THE ROUTINE
06345                 *ADDS 1000 TO THE SCORE AND CHECKS FOR THE
06350                 *DOUBLE BONUS CONDITION(ALL FOUR DROP TARG.
06355                 *HIT). IF DOUBLE BONUS EXISTSTHE DOUBLE
06360                 *BONUS LAMP(DBLBN) AND DOUBLE BONUS FLAG(BMULT)
06365                 *ARE SET.
06370                 *   THE ROUTINE IS ENTERED AT THE POINT
06375                 *CORRES. TO THE TARGET HIT.
06380                 *
06385                 *LOAD DATA FOR DROP TARGET AND ROLLOVER LAMPS.
06390 09D1 86 00      DROPA  LDA A    #DRLPA0
06395 09D3 C6 84             LDA B    #RVLPA1
06400 09D5 20 10             BRA      DROPX
06405 09D7 86 01      DROPB  LDA A    #DRLPB0
06410 09D9 C6 85             LDA B    #RVLPB1
06415 09DB 20 0A             BRA      DROPX
06420 09DD 86 02      DROPC  LDA A    #DRLPC0
06425 09DF C6 86             LDA B    #RVLPC1
06430 09E1 20 04             BRA      DROPX
06435 09E3 86 03      DROPD  LDA A    #DRLPD0
06440 09E5 C6 87             LDA B    #RVLPD1
06445                 *CHANGE LAMPS PER ABOVE DATL.
06450 09E7 BD 0C7D    DROPX  JSR      LPCTRL
06455 09EA 17                TBA
06465 09EB BD 0C7D           JSR      LPCTRL
06470                 *ADD 1000 TO SCORE
06475 09EE 86 81             LDA A    #$81
06485 09F0 BD 0DDC           JSR      SCOREX
06490                 * ACTIVATE DOUBLE BONUS LAMP IF ALL FOUR DROP TARG
06495                 * ARE HIT. RESET BY BONES,LOAD FOUR DROP TARGET
06500                 * LAMP BITS INTO A.
06505 09F3 CE 0018           LDX      #LMPMAT+3   LOAD LAMP ADDRESS AND BI
06510 09F6 5F         AGAIN  CLR B
06515 09F7 BD 0D38           JSR      BITRD  GET SELECTED BIT, ROTATE IN
06520 09FA 46                ROR A
06525 09FB 09                DEX              INC. LAMPMAT ADDR. TO GET N
06530 09FC 8C 0014           CPX      #LMPMAT-1   BRANCH UNTIL 4 BITS LOAD
06535 09FF 26 F5             BNE      AGAIN
06540 0A01 4D                TST A            ARE ALL 4 BITS ZERO?
06545 0A02 26 09             BNE      BYPDA
06550 0A04 86 A2             LDA A    #DBLBN1  SET DOUBLE BONUS LAMP ON.
06560 0A06 BD 0C7D           JSR      LPCTRL
06561 0A09 86 02             LDA A    #$02     SET BONUS MULT
06562 0A0B 97 13             STA A    BMULT
06565 0A0D 39         BYPDA  RTS
06830                 *NAM DRP500
06835                 *THIS ROUTINE IS CALLED BY TARMON WHEN THE 500 POIN
06840                 *DROP TARGETS ARE HIT.THE ROUTINE INCREMENTS THE
06845                 *SCORE BY 500
06850                 *
06855                 *
06860                 *INCREMENT SCORE BY 500
06865 0A0E 86 45      DRP500 LDA A    #$45
06875 0A10 BD 0DDC           JSR      SCOREX
06880 0A13 39                RTS
```

```
06890                 *NAM DRP100
06895                 *THIS ROUTINE IS CALLED BY TARMON WHEN THE 100 DRO
06900                 *TARGETS ARE HIT.
06905                 *
```

```
06910                 *
06915                 *INCREMENT SCORE BY 100
06920 0A14 86 41      DRP100 LDA A    #$41
06930 0A16 BD 0DDC           JSR      SCOREX
06935                 *INCREMENTS BONUS BY 100
06940 0A19 86 01             LDA A    #%00000001
06945 0A1B 97 2A             STA A    ADDEND+1
06950 0A1D BD 0B8A           JSR      RBONUS
06955 0A20 39                RTS


06990                 *NAM QUICK
06995                 *THIS ROUTINE ENERGIZES EITHER THE T.B.,
07000                 *RSLGSHT,OR LSLGSHT SOLENOIDS FOR 75 MS. THE
07005                 *ROUTINE IS ACTIVATED BY A 1 INBIT 7 OF XEDGE+1
07010                 *WHICH SHALL BE LOADED BY RDMAT WHENEVER A 1
07015                 *IS DETECTED AT THE CORRESPONDING SOLENOID SWITCH.
07020                 *THE SWITCH DEBOUNCE ROUTINE IS BYPASSED WHEN
07025                 *LOADING XEDGE+1, BIT 7.THE ROUTINE ALSO CLEARS
07030                 *THIS BIT AFTER THE 75 MS.SOLEN. ACTIVATE
07035                 *TIME.
07040                 *INPUT DATA CONSISTS OF THE BIT POSITION OF THE
07045                 *SOLENOID TO BE OPERATED AND IS INPUT IN BITNUM.
07050                 *
07055                 *
07060 0A21 36         QUICK    PSH A
07065 0A22 96 24               LDA A BITNUM BITNUM HOLDS SOLEN. BIT#.
07070 0A24 CE 0086             LDX  #PIA1DB LOAD SOLEN. WORD LOCATION.
07075 0A27 01
07080 0A28 DB 0AD0             JSR
07085 0A2B C6 06               LDA B  #6 WAIT 50 MS.
07090 0A2D BD 0C9E             JSR  DELAY
07095 0A30 01 01
07100 0A32 01 0101
07105                 *CLEAR BIT 7,XEDGE+1 SINCE THE JOB IS DONE.
07110 0A35 86 7F             LDA A    #$7F
07115 0A37 94 3C             AND A    XEDGE+1
07120 0A39 97 3C             STA A    XEDGE+1
07125 0A3B 32                PUL A
07130 0A3C 39                RTS
0001                  * P R G S U B
0005                  *NAM ZEROCR
10010                 *THIS ROUTINE IS CALLED BY THE Z.C. INTERRUPT AND
10015                 *INITIATES ALL Z.C. RELATED ROUTINES
10020                 *THE ROUTINE:
10025                 * 1)DECREMENTS COUNTERZCCNT FOR THE ROUTINE
10030                 * 2)TESTS AND RESETS WAIT FLAG .5 SEC AFTER IT
10035                 * SET TO GENERATE A DEAD TIME FOR THE TOP HOLE
10040                 * SUBROUTINE
10045                 * 3) GENERATE 1446 US.TIME DELAY FROM Z.C. BEFORE
10050                 *    ENABLING SCR WRITE OPERATION
10055                 * 4)CALLS SCR LAMP TRIGGER ROUTINE WRTLMP
10060                 * 5)READS MOMENTARY SWITCH DATA FROM PLAYFIELD
10065                 *   USING RDMAT
10070 0A3D 7A 0020    ZEROCR DEC       ZCCNT  USED BY SUBROUTINE DELAY
10075                 *
10080                 *
10085                 *HOLD OF ROUTINE USED TO MASK TOP HOLE SENSOR FOR
10090                 *.5 SEC. AFTER SOLENOID OPERATION.DECREMENTS WAIT
10095                 *IF WAIT NOT EQUAL TO ZERO.
10010 0A40 7D 002E
10105 0A43 27 08
10110 0A45 7A 002F
```

```
10115 0A48 26 07
10120 0A4A 7F 002E          LDA A WAIT
                            BEQ RSTCH
                            DEC WAIT
10125 0A4D 86 3C
10130 0A4F 97 2F
10135 0A51 01
10140                 *
10145                 *
10150                 *GENERATE 600US.TIME DELAY FROM Z.C. TO PROVIDE
10155                 *SUFFICIENT VOLTAGE ACROSS THE LAMP DRIVER SCR
10160 0A52 C6 19      RSTCN  LDA B    #25 START 300 US. TIMER (.5MHZ.)
10165 0A54 5A         TIMLP 2   DEC B
10170 0A55 26 FD                BNE   TIMLP2
10175                 *
10180                 *
10185                 *TRIGGER ALL LAMP DRIVER SCR THAT SHOULD BE ON
10190 0A57 BD 0D6F              JSR   WRTLMP
10195                 *
10200                 *
10205                 *READ MOMENTARY SWITCH DATA FROM PLAYFIELD
10220 0A5A BD 0B27              JSR   RDMAT
10225 0A5D 3B                   RTI
10345                 *NAM TARMON
10350                 *TARMON-THIS ROUTINE MONITORS TARGET HITS AS
10355                 *REPRESENTED BY XEDGE(0) THRU XEDGE (2).
10360                 *THE ROUTINE SCANS EACH BIT OF THE FOUR WORDS,
10365                 *JUMPING TO A DESIGNATED SUBROUTINE WHENEVER A BIT
10370                 *IS SET. THE SUBROUTINE ADDRESS ASSOCATED WITH
10375                 *EACH BIT OF EACH WORD IS STORED IN ARRAY SUBTBL.
10380                 *BIT 7 OF XEDGE(2) CORRESPONDS TO THE SUBROUTINE
10385                 *ADDRESS GIVEN AT SUBTBL+46 AND BIT 0 OF XEDGE(0)
10390                 *CORRESPONDS TO SUBTBL(0) NOTE THAT SUBTBL
10395                 *MUST BE LOCATED SUCH THAT THE BINARY ADDITION OF
10400                 *46 TO SUBTBL MUST NOT CAUSE A CARRY INTO THE
10405                 *HIGHER ORDER BYTE.
10410                 *DEFINE SUBROUTINE ADDRESS TABLE SUBTBL.
10415 0A5E 09BC       SUBTBL FDB      CHANNL  LT.500PT.CHANNEL I0,PA0
10420 0A60 099 A             FDB      LSLGST  LT.SLING SHOT      I1,PA0
10425 0A62 09D1              FDB      DROPA   DROP TARGET(A)     I2,PA0
10430 0A64 09D7              FDB      DROPB   DROP TARGET(B)     I3,PA0
10435 0A66 0952              FDB      RLVSWA  ROLL OVER (A)      I4,PA0
10440 0A68 094D              FDB      RLVSWB  ROLL OVER (B)      I5,PA0
10445 0A6A 08F6              FDB      TOPHOL  TOP HOLE(3000PT.)  I6,PA0
10450 0A6C 0AB8              FDB      BYPSUB  I7,PA0
10455 0A6E 09B2              FDB      CHAN1K  1K CHANNEL         I0.PA1
10460 0A70 090F              FDB      THUBPR  THUMPER BUMPER     I1,PA1
10465 0A72 0964              FDB      REBOUN  REBOUND(10PT.)     I2,PA1
10470 0A74 0A14              FDB      DRP100  DROP TARGET(100PT) I3,PA1
10475 0A76 0971              FDB      SPCIAL  SPECIAL            I4,PA1
10480 0A78 0957              FDB      RLVSW   1K ROLL OVER       I5,PA1
10485 0A7A 0A0E              FDB      DRP500  DROP TARGET(500PT) I6,PA1
10490 0A7C 0A21              FDB      QUICK   ------
10495 0A7F 09B5              FDB      CHANNR  RT.500PT.CHANNEL   I0,PA2
10500 0A80 0987              FDB      RSLGST  RT.SLING SHOT      I1,PA2
10505 0A82 09E3              FDB      DROPD   DROP TARGET(D)     I2,PA2
10510 0A84 09DD              FDB      DROPC   DROP TARGET(C)     I3,PA2
10515 0A86 0943              FDB      RLVSWD  ROLL OVER(D)       I4,PA2
10520 0A88 0948              FDB      RLVSWC  ROLL OVER(C)       I5,PA2
10525 0A,A 09AD              FDB      OUTHL   OUT HOLE           I6,PA2
10530 0A8C 0922              FDB      RTILT   TILT               I7,PA2
10575                 *LOAD VALUES FOR INTIAL SUBTBL ENTRY POINT (ENTRY
10580                 *FIRST WORD OF XEDGE TO BE READ, AND FIRST BIT
10585                 *TO BE READ.
10590 0A8E CE 0A8C TARMON LDX   #SUBTBL+46  FIRST SUB. POINTER TABL
10595 0A91 DF 1L          STX   ENTRY
```

```
10600 0A93 CE 0003        LDX      #3      FIRST VALUE TO GET XEDGE+2
10605 0A96 C6 07   WORDLP LDA B    #7
10610              *DISABLE Z.C. INTERRUPT
10615 0A98 86 05          LDA A    #%00000101
10620 0A9A 97 8B          STA A    PIA2CB
10625              *READ XEDGE AND THEM CLEAR.
10627 0A9C A6 3A          LDA A    XEDGE-1,X
10632 0A9E 6F 3A          CLR      XEDGE-1,X
10634              *ENABLE Z.C. INTERR.
10635 0AA0 36             PSH A
10636 0AA1 86 0D          LDA A    #%00001101
10637 0AA3 97 8B          STA A    PIA2CB
10638 0AA5 32             PUL A
10642              *TEST XEDGE WORD AND BYPASS BIT TESTS IF ALL
10643              *BITS = 0.
10644 0AA6 4D             TST A
10645 0AA7 27 1D          BEQ      FAST
10646              *TEST EACH BIT AND GO TO SUB IF 1.
10647 0AA9 4D      BITLP1 TST A
10648 0AAA 2A 0E          BPL      SKIP3
10649 0AAC DF 00          STX      ADDR2   STORE X TEMPORARILY
10650 0AAE DE 1E          LDX      ENTRY   LOAD THE SUBTBL ENTRY POINT
10655 0AB0 EE 00          LDX      0,X     LOAD THE ADDR. OF THE SUBR.
10662 0AB6 33             PUL B
10663 0AB7 32             PUL A
10665 0AB8 DE 00   BYPSUB LDX      ADDR2   RESTORE X
10670              *
10675              *ROTATE NEXT BIT TO N FLAG,DEC. BIT COUNTER AND
10680              *SUBTBL ENTRY POINTER, AND TEST FOR LAST BIT IN WO
10685 0ABA 49      SKIP3  ROL A
10690 0ABB 7A 001F        DEC      ENTRY+1   DECREMENT POINTER BY 2.
10695 0ABE 7A 001F        DEC      ENTRY+1
10700 0AC1 5A             DEC B               BIT COUNTER
10705 0AC2 2A E5          BPL      BITLP1  BRANCH IF ALL BITS NOT READ
10721 0AC4 20 06          BRA      FASTRT
10722 0AC6 86 F0   FAST   LDA A    #$0F0   SUBT. 16 FROM ENTRY+1
10723 0AC8 9B 1F          ADD A    ENTRY+1
10724 0ACA 97 1F          STA A    ENTRY+1
10735              *DEC WORD COUNTER (X), CHECK FOR LAST WORD, AND GO
10740              *TO WORDLP TO CONTINUE.
10745 0ACC 09      FASTRT DEX
10750 0ACD 26 C7          BNE      WORDLP
10755 0ACF 39             RTS
10765              *NAM SLNPLS
10770              *THIS ROUTINE PROVIDES A 25MS PULSE TO THE M ADDRE
10775              *AND BIT LOCATION LOADED INTO X AND A RESPECTIVELY
10785 0AD0 5F      SLNPLS CLR B
10790 0AD1 BD 0D1C        JSR      BITWRT  OPERATE SOLENOID
10795 0AD4 C6 03          LDA B    #3      HOLD FOR 25MS
10800 0AD1 BD 0C9E        JSR      DELAY
10810 0AD9 C6 01          LDA B    #1
10815 0ADB BD 0D1C        JSR      BITWRT
10820 0ADE 39             RTS
10830              *NAM SERIN
10835              * THIS ROUTINE READS SERIAL DATA PRESENTED AT
10840              * PIA2AD7 AND CLOCKS 8 BITS OF DATA TO
10845              *XWD. THE FIRST BIT READ IS LOADED INTO
10850              * MEMORY AT BIT POSITION 7 AND THE LAST INTO BIT 0
10855              *PIA2AC-CA2 IS THE SHIFT REGISTER
10860              * CLOCK SIGNAL AND REQUIRES THAT CRA-5=
10865              *CRA-3=1,CRA-4=0. A &X ARE UNCHANGED
10870              *
10875              *WRITE A ONE TO PIA2CB2 TO ENABLE PARALLEL
10876              *S.R. LOAD.
10877 0ADF 36      SERIN  PSH A
10878 0AE0 86 3D          LDA A    #%00111101
```

```
10879 0AE2 97 8B          STA A    PIA2CB
10880                *150 US. ADDR. SETTLE TIME.
10881 0AE4 C6 0C          LDA B    #12
10882 0AE6 5A        TIME3  DEC B
10883 0AE7 26 FD          BNE      TIME3
10884                *WRITE A ZERO TO ENABLE SERIAL TRANSF.
10885 0AE9 86 35          LDA A    #%00110101
10886 0AEB 97 8B          STA A    PIA2CB
10920                * LOAD PIA1DA7 INTO FLAG C AND THEN TO M(0)<INADDR
10923 0AED C6 07          LDA B    #7
10925 0AEF 96 84     SERLP  LDA A    PIA1DA
10930 0AF1 49             ROL A
10935 0AF2 79 0007        ROL      XWD
10940 0AF5 5A             DEC B
10945 0AF6 2A F7          BPL      SERLP   REPEAT UNTIL ALL 8 BITS HAV
10950                *BEEN STORED AT XWD.
10951                *RESET PIA2CRB TO ENABLE RECEIPT OT ZC
10952 0AF8 86 0D          LDA A    #%00001101
10953 0AFA 97 8B          STA A    PIA2CB
10954 0AFC 32             PUL A
10955 0AFD 39             RTS
10965                *NAM SCRPLS
10970                *THIS SUB. FORMS SCORE (NUP)=SCORE(NUP)+ADDEND
10975                *ADDEND AND NUP ARE RAM VARIABLES THAT SHALL BE
10980                *SET BEFORE EXCUTION. ADDEND CONSISTS OF SIX HALF
10985                *BYTES IN BCS. THE LS HALF BYTE OF ADDEND CORRESPO
10990                *TO THE UNITS DECIMAL LOCATION. ADDEND IS RESET TO
10995                *ZERO AT END OF BCD TO INITIALIZE FOR NEXT SCRPLS
11000                *CALL
11005                *
11010                *
11015                *
11020                *DETERMINE THE STARTING ADDRESS OF SCORE(NUP) AND
11025                *LOAD ITS VALUE TO X.
11030 0AFE           SCRPLS
11031 0AFF BD        0F97   JSR      TASK40  DEBLANK SCORE LOCATIONS.
11032 0B02 96 22            LDA A    NUP
11035 0B04 4A               DEC A
11040 0B05 26 03            BNE      BYPAS1
11045 0B07 CF 0042          LDX      #SCORE1
11050 0B0A 4A        BYPAS1 DEC A
11055 0B0B 26 03            BNE      BYPAS2
11060 0B0D CE 0045          LDX      #SCORE2
11065 0B10 4A        BYPAS2 DEC A
11070 0B11 26 03            BNE      BYPAS3
11075 0B13 CE 0048          LDX      #SCORE3
11080 0B16 4A        BYPAS3 DEC A
11083 0B17 26 03            BNE      NEXT
11085 0B19 CE 004B          LDX      #SCORE4
11090                *CALL THE ADDITION ROUTINE NOW THAT X HAS BEEN
11095                *LOADED WITH THE STARTING ADDRESS OF SCORE(NUP).
11100 0B1C BD 0D41   NEXT   JSR      BCD
11102 0B1F
11103 0B20 BD 0F00          JSR      TASK4   BLANK SCORE LOCATIONS.
11105 0B23 39               RTS
11118                *NAM RDMAT
11121                *THIS ROUTINE IS CALLED BY THE Z.C. INTERRUPT
11124                *SERVICE ROUTINE(ZEROCR) OR THE MAIN AND READS DA
11127                *THE 7 X 8 INPUT MATRIX . THE DATA READ MAY BE
11130                *EITHER OF TWO GROUPS , PLAYFIELD MOMENTARY
11133                *SWITCH DATA OR FIXED DATA FROM CONTROL SWITCHES
11136                *FOR PLAYFIELD = 1 THE ROUTINE READS
11139                *MOMENTARY SWITCH DATA LOCATED AT MATRIX ADDRESS
11142                *01,02,04,08. FOR PLAYFIELD = 0 THE FIXED DATA
11145                *SWITCHES AT 10,20,AND 40, ARE READ. THE MATRIX A
11148                *ARE WRITTEN TO PIA1DA0-6 AND MATRIX WORDS ARE
```

```
11151                 *READ SERIALLY AT PIA1DA7. MOMENTARY DATA IS
11154                 *DE-BOUNCED AND WRITTEN TO XEDGE WHENEVER TWO
11157                 *CONSECUTIVE ONES ARE SAMPLED. THESE BITS ARE NOT
11160                 *RESET TO ZERO BY THIS ROUTINE. FIXED DATA
11163                 *IS WRITTEN DIRECTLY TO XEDGE EXACTLY AS THE DATA
11166                 *IS RECEIVED FROM THE INPUT MATRIX. INPUT DATA
11169                 *REQUIRED IS PLAYFIELD WHICH MUST BE SET BY THE
11172                 *CALLING PROGRAM.
11199                 *TEST PLYFLD AND BRANCH TO FIXED IF 0 ELSE
11202                 *DO MOMENTARY.
11203 0B24 03         BITTBL FCB      3,4,2
      0B25 04
      0B26 02
11205 0B27 96 10      RDMAT  LDA A    PLYFLD
11208 0B29 27 4A             BEQ      FIXED
11211                 *INITIALIZE ROUTINE FOR READING MOMENTARY
11214                 *PLAYFIELD SWITCH DATA
11217 0B2B CE 0004           LDX      #4
11220 0B2E 86 08             LDA A    #%00001000
11223                 *READ INPUT WORD TO XWD
11226 0B30 97 84      MOMLP  STA A    PIA1DA
11229 0B32 BD 0ADF           JSR      SERIN
11232 0B35 D6 07             LDA B    XWD
11235                 *GENERATE REPEAT (DEFINE BIT POSITIONS THAT
11238                 *HAVE REPEATED THEIR PREVIOUS STATE)
11241 0B37 E8 32             EOR B    LSTXWD-1,X
11242 0B39 53                COM B
11244 0B3A D7 0C             STA A    REPEAT
11247                 *FOR THOSE BITS WHICH DID REPEAT, ENTER THE
11250                 *REPEATED VALUE TO XST
11253 0B3C D4 07             AND B    XWD
11256 0B3E D7 09             STA B    XST
11259                 *FOR THOSE BITS WHICH DID NOT REPEAT, RETAIN
11262                 *THE PREVIOUS VALUE OF XST
11265 0B40 D6 0C             LDA B    REPEAT
11268 0B42 53                COM B
11271 0B43 E4 36             AND B    LSTXST-1,X
11274 0B45 DA 09             ORA B    XST
11277 0B47 D7 09             STA B    XST
11280                 *WRITE 1 TO XEDGE FOR THOSE POSITIONS THAT
11283                 *HAVE CHANGED FROM 0 IN LSTXST TO 1 IN XST
11286 0B49 E6 36             LDA B    LSTXST-1,X
11289 0B4B 53                COM B
11292 0B4C D4 09             AND B    XST
11293 0B4E EA 3A             ORA B    XEDGE-1,X
11295 0B50 E7 3A             STA B    XEDGE-1,X WRITE FINISHED XEDGE TO
11298                 *TEST TO DETERMINE IF T.B.,LSLGSHT, OR RSLGSHT
11299                 *CONTROL SWITCH IS A 1.  IF YES THEN SET
11300                 *XEDGE +I,BIT 7=1,BYPASSING THE DEBOUNCE
11301                 *ROUTINE. BIT 7 IS A FLAG TO TARMON FOR
11302                 *A SOLENOID PULSE. LOAD THE BIT LOCATION OF THE
11303                 *DETECTED SOLEN. TO BITNUM FOR USE BY QUICK
11304                 *(SOLEN ROUTINE CALLED BY TARMON).
11305                 *
11306                 *
11307                 *TEST FOR A 1 AT TB, LSLGSHT, OR RSLGSHT SWITCH
11308                 * =1.
11309 0B52 8C 0004           CPX      #4
11310 0B55 27 10             BEQ      NOSOLN
11311 0B57 D6 07             LDA B    XWD
11312 0B59 56                ROR B
11313 0B5A56                 ROR B
11314 0B5B 24 0A             BCC      NOSOLN BRA IF CONTROL SWT.<>1
11315 0B5D C6 80             LDA B    #$80 SET BIT 7 OF XEDGE+1=1.
11316 0B5F DA 3C             ORA B    XEDGE+1
11317 0B61 D7 92             STA B    XEDGE+1
```

```
11318                 *LOAD BITNUM WITH BIT POS. OF SOLEN. COIL
11319                 *THAT IS TO BE ACTIVATED.
****ERROR 210 1-1,X                          0F74:   CPX #3        8C 00 03
11302 0B63 1E 0F            LDA B    BITTBL-1,X     REQ PIS2      27 0A
11321 0B65 14 01            STA B    BITNUM         CPX #2        8C 00 02
11322 0B67 01         NOSOLN NOP                    REQ B154      27 C9
11323                 *RETAIN THE XWD               CPX #1        18C 00 01
11324 0B68 D6 07            LDA B    XWD            REQ B153      27 08
11325 0B6A E7 32            STA B    LSTXWD-B152    LDA B#2       C6 02
11326                 *RETAIN XST      1,X          BRA LOAD      20 06
11327 0B6C D6 09            LDA B    XST     B154   LDA B#4       C6 04
11328 0B6F E7 36            STA B    LSTXST01,X     BRA LOAD      20 02
                                             B153   LDA B#3       C6 03
11329                 *DEC X AND SHIFT ADDR
11330 0B70 09               DEX              LOAD STA B BITNUM D7 24
11331 0B71 44               LSR A
11332 0B72 22 BC            BHI      MOMLP          JMP 0B67 7E  0B 67
11333 0B74 39               RTS
11334                 *INITIALIZE ROUTINE FOR READING FIXED DATA
11337 0B75 CE 0007 FIXED    LDX      #7
11340 0B78 86 40            LDA A    #%01000000
11343                 *READ IMPUT WORD TO XWD
11346 0B7A 97 84   FIXLP    STA A    PIA1DA
11349 0B7C BD 0ADF          JSR      SERIN
11352 0B7F D6 07            LDA B    XWD
11355 0B81 E7 3A            STA B    XEDGE-1,X
11358 0B83 09               DEX
11361 0B84 44               LSR A
11364 0B85 81 08            CMP A    #%00001000
11367 0B87 26 F1            BNE      FIXLP
11370 0B89 39               RTS
11450                 *NAM RBONUS
11455                 *THIS ROUTINE IS USED TO ADD THE AMOUNT OF THE BON
11460                 *INCREMENT TO BONUS. THE ROUTINE FORMS BONUS=BONUS
11465                 *+ADDEND WHERE ADDEND IS SET PRIOR TO EXECUTION.
11470                 *ADDEND CONSISTS OF SIX HALF BYTES IN BCD.  THE LS
11475                 *BYTE OF ADDEND CORRESPONDS TO THE UNITS DECIMAL
11480                 *LOCATION. ADDEND IS RESET TO ZERO AT END OF BCD T
11485                 *INITIALIZE FOR NEXT EXECUTION. THE BONUS VALUE IS
11490                 *CHECKED AFTER EACH ENTRY AND SPCLP (SPECIAL LAMP)
11495                 *=1 IF BONUS => 15,000.
11496                 *THE ROUTINE LIGHTS THE LEFT AND RIGHT EXTRA BALL
11498                 *SCORES => 8000. LEFT ON EVEN SCORES AND RIGHT ON
11500                 *BOTH LAMPS ARE ENABLED FOR => 15,000.
11502                 *THE MAXIMUM BONUS VALUE IS LIMITED TO 15,000
11504                 *
11506                 *
11508                 *LOAD BONUS STARTING ADDRESS AND INCREMENT BONUS
11510 0B8A CE 0025 RBONUS LDX       #BONUS
11512 0B8D BD 0D41          JSR      BCD
11514                 *TEST BONUS FOR VALUE => 15,000. IF YES LIMIT BON
11516                 *ENABLE SPECIAL LAMP, AND ENABLE BOTH LEFT AND RI
11518                 *EXTRA BALL LAMPS.
11520 0B90 96 27            LDA A    BONUS+2
11522 0B92 27 14            BEQ      LESS15K
11524 0B94 86 50            LDA A    #$50
11526 0B96 91 26            CMP A    BONUS+1
11528 0B98 2A 0E            BHI      LESS15K
11530 0B9A 86 F4            LDA A    #SPCLP1 LIGHT SPECIAL LAMP.
11532 0B9C BD 0C7D          JSR      LPCTRL
11534 0B9F 86 50            LDA A    #$50  SET BONUS 10E3=5
11536 0BA1 97 26            STA A    BONUS+1
11538 0BA3 86 B5            LDA A    #LXBLP1 LIGHT LEFT EXTRA BALL LAMP
11540 0BA5 BD 0C7D          JSR      LPCTRL
11542                 *LIGHT LEFT OR RIGHT EXTRA BALL LAMPS FOR BONUS>
11544 0BA8 96 27   *LESS 15         LDA A  BONUS+2
```

```
11546 0BAA 26 06          BNE      EVENX
11548 0BAC 96 26          LDA A    BONUS+1
11550 0BAE 81 80          CMP A    #$80
11552 0BB0 2B 1B          BMI      ENDENS
11554                *IS BONUS 1000 EVEN OR ODD AND LIGHT EXTRA BALL L
11556 0BB2 48        EVENX ASL A
11558 0BB3 48              ASL A
11560 0BB4 48              ASL A
11562 0BB5 2B 0C           BMI      ODD
11564 0BB7 86 B5     EVEN  LDA A    #LXBLP1
11566 0BB9 BD 0C7D         JSR      LPCTRL
11568 0BBC 86 36           LDA A    #RXBLP0
11570 0BBE BD 0C7D         JSR      LPCTRL
11572 0BC1 20 0A           BRA      ENDBNS
11574 0BC3 86 B6     ODD   LDA A    #RXBLP1
11576 0BC5 BD 0C7D         JSR      LPCTRL
11578 0BC8 86 35           LDA A    #LXBLP0
11580 0BCA BD 0C7D         JSR      LPCTRL
11582                *CALL BONUS LAMP DISPLAY
11584 0BCD BD 0E7C ENDBNS JSR       BONDSP
11586 0BD0 39              RTS
11591                *NAM RAMZR
11592                *THIS ROUTINE CLEARS ALL RAM MEM.AT X AND
11593                *BELOW TO ZERO. X IS LOADED BY THE CALLER.
11594 0BD1 6F 00     RAMZR CLR      0,X
11595 0BD3 09              DEX
11596 0BD4 26 FB           BNE      RAMZR
11597 0BD6 6F 00           CLR      0,X
11598 0BDB 39              RTS
11610                *NAM NXTPLY
11615                *THIS ROUTINE PREPARES THE GAME FOR THE NEXT PLAYE
11620                *AFTER THE PREVIOUS PLAYER HAS COMPLETED HIS TURN.
11625                *THE ROUTINE LIGHTS THE FOUR DROP TARGET LAMPS,
11630                *EXTINGUISHES THE ASSOCIATED ROLLOVER LAMPS, AND
11640                *RESETS THE TILT FLAG AND LAMP,ENABLES FLIPPER
11641                *ACTION AFTER TILT, RESETS SPECIAL LAMP,
11645                *RESET EXTRA BALL LAMPS.
11650                *RESET ROLLOVER LAMPS & LIGHT DROP TARGET LMPS.
11653 0BD9 CE 001C NXTPLY LDX      #LMPMAT+7     LOAD WORD LOCATION
11655 0BDC 4F              CLR A                LOAD BIT POSITION
11657 0BDD 5F              CLR B                LOAD BIT VALUE
11660 0BDE BD 0D1C LOOPLP JSR      BITWRT       BITWRT RETURNS A,B,X UNCHAN
11663 0BE1 8C 0019         CPX      #LMPMAT+4     ALL ROLLOVRS. COMPLETED
11665 0BE4 26 02           BNE      BYPAS5
11667 0BE6 C6 01           LDA B    #1           CHANGE BIT VALUE TO 1 FOR D
11670 0BE8 09        BYPAS5 DEX
11673 0BE9 8C 0014         CPX      #LMPMAT-1     DRP.TSRG. &ROLLVRS. COMP
11675 0BEC 26 F0           BNE      LOOPLP       REPEAT UNLESS COMPLETED.
11700                *RESET TILT LAMP,TILT FLAG AND ENABLE FLIPPER
11701 0BEE 86 76           LDA A    #TLTLP0
11702 0BF0 BD 0C7D         JSR      LPCTRL
11703 0BF3 7F.002C         CLR      TILT
11704 0BF6 86 FC           LDA A    #$0FC
11705 0BF8 97 86           STA A    PIA1DB
11706                *RESET SPECIAL LAMP.
11707 0BFA 86 74           LDA A    #SPCLP0
11708 0BFC BD 0C7D         JSR      LPCTRL
11709                *RESET L&R EXTRA BALL LAMPS.
11715 0BFF 86 35           LDA A    #LXBLP0
11720 0C01 BD 0C7D         JSR      LPCTRL
11725 0C04 86 36           LDA A    #RXBLP0
11730 0C06 BD 0C7D         JSR      LPCTRL
11735 0C09 39              RTS
11785                *NAM MATCHK
11790                *THIS ROUTINE COMPARES THE SCORES OF ACTIVE PLAYER
11795                *WITH MATCH AND THE FREE GAME THRESHOLD(FREEGM)
```

```
11800                 *CREDIT IS INCREMENTED FOR EACH MATCH AND EACH
11805                 *SCORE>=FREEGM,ENABLES MATCH DISPLAY (RESET MAIN)
11810                 *
11815                 *FORM ADDRESS OF SCORE (NPLAY).
11820                 *THE COMPUTED VALUE IS PLACED IN ADDR. ADDR=
11825                 *<SCORE>-3+3*NPLAY.
11830 0C0A            MATCHK
11831 0C0B BD         0F97   JSR      TASK40  DEBLANK ALL SCORE LOC.
11832 0C0E 96 23             LDA A    NPLAY
11835 0C10 48                ASL A
11840 0C11 9B 23             ADD A    NPLAY
11845 0C13 8B 3F             ADD A    #SCORE1-3
11850                 *LOAD COMPUTED ADDR. TO X AND MATCH TO A
11855 0C15 7F 0002           CLR      ADDR
11857 0C1A DE 02      MTCHLP LDX      ADDR
11865 0C1C 96 28             LDA A    MATCH
11870                 *TEST FOR MATCH; INC CREDIT & PULSE KNOCKER
11872 0C1E A1 00             CMP A    0,X
11874 0C20 26 0F             BNE      FGMCHK
11876 0C22 C6 01             LDA B    #1      INC CREDIT
11878 0C24 DB 4E             DAA
11882 0C27 D7 4E             STA B    CREDIT
11884 0C29 CE 0086           LDX      #PIA1DB        PULSE KNOCKER
11886 0C2E BD 0AD0           JSR      SLNPLS
11895                 *NOW THAT MATCH HAS BEEN CHECKED, CHECK SAME PLAYER
11900                 *SCORE AGAINST THE FREE GAME THRESHOLD.
11905                 *
11910                 *LOAD TEMP WITH THE 1000 PLACE OF SCORE, SETTING
11915                 *THE 10000 PLACE TO ZERO
11920 0C31 DE 02      FGMCHK LDX      ADDR   RESTORE X
11922 0C33 E6 01             LDA B    1,X
11925 0C35 54                LSR B
11930 0C37 54                LSR B
11935 0C37 54                LSR B
11940 0C38 54                LSR B
11945 0C39 D7 1D             STA B    TEMP
11950                 *LOAD A WITH THE 1000 PLACE OF THRESHOLD,
11955                 *MASKING THE 10000 PLACE TO ZERO
11960 0C3B 86 0F             LDA A    #%00001111
11965 0C3D 94 3F             AND A    XEDGE+4 (FREEGM)
11970                 *COMPARE THRESHOLD-SCORE (1000 PLACE)
11975 0C3F 91 1D             CMP A    TEMP
11980 0C41 24 0A             BCC      END1
11985                 *TEST FOR A 1 IN 10,000 PLACE TO BORROW FROM
11986                 *AND DO IF YES
11988 0C43 86 F0             LDA A    #$0F0
12000 0C45 94 3F             AND A    XEDGE+4        (FREEGM)
12002 0C47 4D                TST A
12004 0C48 27 0F             BEQ      END2
12006 0C4A 4A                DEC A
12008 0C4B 84 0F             AND A    #$0F MASK EXTRA BITS FROM SUBT.
12010                 *LOAD 10000 PLACE OF SCORE
12015 0C4D E6 02      END1   LDA B    2,X
12020 0C4F 58                ASL B
12025 0C50 58                ASL B
12030 0C51 58                ASL B
12035 0C52 58                ASL B
12040 0C53 D7 1D             STA B    TEMP
12045                 *COMPARE THRESHOLD-SCORE (10000 PLACE)
12050 0C55 91 1D             CMP A    TEMP
12055 0C57 22 11             BHI      NXTSCR
12060                 *INC. CREDIT
12065 0C59 86 01      END2   LDA A    #1
12070 0C5B 9B 4E             ADD A    CREDIT
12075 0C5D 19                DAA
12076 0C5E 97 4E             STA A    CREDIT
```

```
12077 0C60 CE 0086        LDX      #PIA1DB       PULSE KNOCKER
12078 0C63 86 07          LDA A    #7
12079 0C65 BD 0AD0        JSR      SLNPLS
12080 0C68 DE 02          LDX      ADDR   RESTORE X
12081                *DEC X TO LOCATION OF NEXT SCORE TO BE COMPARED WI
12085                *MATCH AND TEST FOR LAST SCORE CHECK COMPLETED.
12090 0C6A 09        NXTSCR DEX
12095 0C6B 09             DEX
12100 0C6C 09             DEX
12102 0C6D DF 02          STX      ADDR
12105 0C6F 8C 003F        CPX      #SCORE1-3
12110 0C72 26 A6          BNE      MTCHLP        DROP THRU AFTER SCORE1
12111                *ENABLE MATCH DISPLAY
12112 0C74 96 28          LDA A    MATCH
12113 0C76 97 50          STA A    MATCHD
12114 0C78
12115 0C79 BD 0F00        JSR      TASK4  BLANK ALL SCORE LOC.
12116 0C7C 39             RTS
12125                *NAM LPCTRL
12130                *THIS ROUTINE IS USED TO TURN LAMPS ON AND OFF. TH
12135                *INPUT DATA IS A CONTROL WORD STORED IN A BY
12140                *THE CALLING PROGRAM. THE CONTROL WORD FORMAT:
12145                *        BIT      FUNCTION
12150                *        0-2      POS OFFSET FROM LMPMAT(DECODER LE
12155                *        3        DISREGARDED BY LPCTRL
12160                *        4-6      LMP BIT POSITION(DECODER NO.)
12165                *        7        1 EQUALS LAMP ON
12170                *
12175                *        B IS UNCHANGED
12180                *
12200                *READ LMPMAT OFFSET VALUE AND ADD TO <LMPMAT>
12202 0C7D 37        LPCTRL PSH B
12203 0C7E 5F             CLR B
12204 0C7F 97 1D          STA A    TEMP
12205 0C81 86 07          LDA A    #%00000111    MASK
12210 0C83 94 1D          AND A    TEMP
12215 0C85 8B 15          ADD A    #LMPMAT
12220                *LOAD <LMPMAT> + OFFSET TO X
12223 0C87 7F 0002        CLR      ADDR
12225 0C8A 97 03          STA A    ADDR+1
12230 0C8C DE 02          LDX      ADDR
12235                *LOAD THE LAMP CONDITION, 1/0, INTO B.
12240 0C8E 79 001D        ROL      TEMP
12245 0C91 59             ROL B
12250                *LOAD THE LMPMAT BIT LOCATION CODE INTO A.
12255 0C92 86 E0          LDA A    #%11100000    MASK
12260 0C94 94 1D          AND A    TEMP
12265 0C96 49             ROL A
12270 0C97 49             ROL A
12275 0C98 49             ROL A
12280 0C99 49             ROL A
12283 0C9A 33
12285 0C9B 7E 0D1C        JSR      BITWRT
                          PUL B
                          RTS
12300                *NAM DELAY
12310                *DELAY(SUBROUTINE)-THIS SUBROUTINE CREATES A
12315                *DELAY OF 8.33N,+8.33,-0MS. THE NUMBER OF DELAY
12320                *PERIODS N SHALL BE ENTERED INTO B PRIOR TO EXECUT
12325                *
12330                *
12335 0C9E D7 20     DELAY  STA B    ZCCNT
12340 0CA0 D6 20     TIMLP  LDA B    ZCCNT
12345 0CA2 26 FC            BNE      TIMLP
12350 0CA4 39               RTS
```

```
12360                 *NAM CNMON
12365                 *THIS ROUTINE MONITORS COIN CHUTE 1 AND COIN CHUTE
12370                 *AND INCREMENTS CREDIT AS DEFINED BY THE INPUT
12375                 *DATA SWITCH SETTINGS,THESE DATA SWITCHS PERMIT
12380                 *TWO VARIABLES TO BE ASSOCATED WITH EACH SWITCH.
12385                 *THE VARIABLES ARE GAMES1,WHICH DEFINES THE NUMBER
12390                 *OF CREDITS ISSUED WHEN THE NO. OF COINS ENTERED
12395                 *EQUALS THE SECOND VARIABLE,COINS1.ADDITIONALLY,
12400                 *THE ROUTINE MONITORS THE RESET BUTTON AND
12405                 *INCREMENTS NO. OF PLAYERS IF CREDIT AND NPLAY
12410                 *ARE OK.THE EXIT TO NEWGAM IS USED WHENEVER THE
12415                 *RESET SWITCH IS SENSED AFTER THE FIRST BALL HAS
12420                 *BEEN PLAYED AND CREDIT>0.
12425                 *THE ROUTINE READS CNBIT1,CNBIT2,COINS1,
12430                 *COINS2,GAMES1,GAMES2,AND CREDIT FROM XEDGE
12435                 *
12440                 *MONITOR COIN CHUTES AND GIVE CREDITS A/R
12445                 *READ CNBIT1 AND INCREMENT CNCNT1 IF PRESENT.
12450 0CA5 D6 3E   CNMON  LDA B    XEDGE+3
12455 0CA7 2A 1A          BPL      BYPCN1   BRANCH IF COIN BIT 0
12460 0CA9 7C 0030        INC      CNCNT1
12465                 *TEST CNCNT1 AND CREDIT=CREDIT+GAMES1 IF CNCNT1
12470                 *=COINS1.
12465 0CAC 86 38          LDA A    #%00111000    MASK FOR COINS1
12480 0CAF 94 40          AND A    XEDGE+5
12481 0CB0 44             LSR A
12482 0CB1 44             LSR A
12483 0CB2 44             LSR A
12485 0CB3 91 30          CMP A    CNCNT1
12490 0CB5 26 0C          BNE      BYPCN1   BRANCH IF CNCNT1><COINS1
12495 0CB7 86 07          LDA A    #%00000111    MASK TO LOAD GAMES1
12500 0CB9 94 40          AND A    XEDGE+5
12505 0CBB 9B 4E          ADD A    CREDIT
12510 0CBD 19             DAA
12513 0CBE 97 4E          STA A    CREDIT
12515                 *RESET THE CHUTE1 COIN COUNTER
12520 0CC0 7F 0030        CLR      CNCNT1
12525                 *READ CNBIT2 AND INCREMENT CNCNT2 IF PRESENT
12530 0CC3 59      BYPCN1 ROL B
12535 0CC4 2A 1A          BPL      BYPCN2
12540 0CC6 7C 0032        INC      CNCNT2
12545                 *TEST CNCNT2 AND CREDIT=CREDIT+GAMES2
12550                 *IF CNCNT2=COINS2
12555 0CC9 86 38          LDA A    #%00111000    MASK FOR COINS2
12560 0CCB 94 41          AND A    XEDGE+6
12561                     LSR A
12562 0CCE 44             LSR A
12563 0CCF 44             LSR A
12565 0CD0 91 32          CMP A    CNCNT2   BRANCH IF CNCNT2><COIN1
12566 0CD2 26 0C          BNE      BYPCN2
12570 0CD4 86 07          LDA A    #%0000011     MASK FOR GAMES2
12575 0CD6 94 41          AND A    XEDGE+6
12580 0CD8 9B 4E          ADD A    CREDIT
12585 0CDA 19             DAA
12587 0CDB 97 4E          STA A    CREDIT
12590                 *RESET CHUTE2 COIN COUNTER
12595 0CDD 7F 0032        CLR      CNCNT2
12597                 *CLEAR CNBIT1,CNCBIT2,AND RESET FROM XEDGE(3)
12598                 *SINCE THIS DATA NOT NEEDED.
12599 0CE0 7F 003E BYPCN2 CLR      XEDGE+3
12600                 *MONITOR GAME RESET AND INCREMENT NPLAY AS REQD.
12605                 *RESET AND CREDIT OK?
12610 0CE3 59             ROL B
12615 0CE4 2A 35          BPL      ENDCNM BRANCH IF RESET<>1
12620 0CE6 7D 004E        TST      CREDIT
12625 0CE9 27 30          BEQ      ENDCNM
```

```
12645
12650
12655 0CFB
12660 0CEB
12665 0CF0
12670 0CF3
12675
12680 0CF5
12685                *TEST FOR RESET RECEIVED AFTER SECOND BALL
12690                *STARTED AND BRANCH TO NEWGAM IF SO.
12695 0CF8 96 21     SMEGME LDA A    BIP
12700 0CFA 81 02            CMP A    #2
12705 0CFC 2A 1D            BPL      GONWGM
12710                *TEST THAT NPLAY < 4 AND BYPASS IF NOT
12715 0CFE 96 23            LDA A    NPLAY
12720 0D00 81 04            CMP A    #4
12725 0D02 27 17            BEQ      ENDCNM
12730                *INC NPLAY,CHIME1--,CREDIT,RESET GM.OVR.LMP
12735 0D04 7C 0023          INC      NPLAY
12736 0D07 BD 0EDC          JSR      LIGHTS LDX #PIA2DB CHIME 100
12738 0D0C BD 0AD0          JSR      SLNPLS
12740 0D0F 86 99            LDA A    #$99
12742 0D0F 86 99            ADD A    CREDIT
12743 0D13 19               DAA
12744 0D14 97 4E            STA A    CREDIT
12745 0D16 36 77            LDA A    #GMOVRO
12755 0D18 BD 0C7D          JSR      LPCTRL
12760 0D18 39        ENDCNM RTS
                     GONWGM TSX
                            DEX
                            LDX

12737 0D0A 86 05            LDA A    #5
12770                *NAM BITWRT
12775                *THIS ROUTINE WRITES A BIT TO MEMORY WITHOUT ALTER
12780                *ADJACENT BITS.  INPUT DATA IS WORD ADDRESS(X)
12785                *BIT POSITION (A),AND NEW BIT VALUE(B)
12790                *X,B,AND A ARE UNCHANGED AFTER EXEC.
12800 0D1C D7 1D     BITWRT STA B    TEMP   STORE NEW BIT VALUE
12801 0D1E 36               PSH A
12802                       PSH B
12803 0D20 84 07            AND A    #%00000111    MASK OFF ANY SUPERFLOWS
12806                *BITS IN A (BIT POSITION)
12812                *GENERATE MASK TO SET SELECTED BIT IN ORIGINAL
12815                *WORD TO ZERO. SIMULTANEOUSLY SHIFT NEW BIT VALUE
12818                *(0 OR 1) IN TEMP TO SELECTED BIT POSITION.
12821 0D22 C6 01            LDA B    #%00000001
12824 0D24 4C               INC A    INC.BIT POSITION FOR LOOPIN
12827 0D25 4A        MSKLP  DEC A    DEC. BIT POSITION INDICATOR
12830 0D26 27 06            BEQ      MKSET  SKIP SHIFT OPERATION IF BIT
12833 0D28 58               ASL B           SHIFT MASK BIT
12836 0D29 78 001D          ASL      TEMP   SHIFT POSITION OF NEW BIT V
12839 0D2C 20 F7            BRA      MSKLP  RETURN TO MSKLP TO DEC. POS
12842                *                 COUNTER & TEST IF NEXT SHIFT REQ.
12845                *MASK AND NEW BIT IN CORRECT POSITION
12848                *COMP. MASK AND SET SELECTED BIT POS.IN SEL.
12851                *WORD TO ZERO.
12852 0D2E 53        MSKSET COM B
12854 0D2F E4 00            AND B    0,X
12857                *SET SELECTED BIT TO THE VALUR SPECIFIED BY THE
12860                *SHIFTED TEMP BIT.
12863 0D31 DA 1D            ORA B    TEMP
12866                *WRITE MODIFIED WORD BACK TO MEM.
12869 0D33 E7 00            STA B    0,X
12872                *RESTORE BIT POSITION TO A.
```

```
12874 0D35 33                PUL B
12875 0D36 32                PUL A
12880 0D37 39                RTS
12905                 *NAM BITRD
12910                 *SHIFT A SPECIFIED BIT(BIT) IN M<X>
12915                 *TO THE CARRY FLAG POSITION.INPUTS REQUIRED
12920                 *ARX BIT(0-7) IN B AND ADDR. TO BE READ
12925                 *PRIOR TO EXECUTION, THE VALUE OF B IS ALTERED
12930                 *BUT X AND A ARE UNCHANGED
12935 0D38 36         BITRD  PSH A
12940                 *
12845 0D39 A6 00             LDA A    0,X
12950 0D3B 44         SHFTLP LSR A
12955 0D3C 5A                DEC B
12960 0D3D 2A FC             BPL      SHFTLP
12965 0D3F 32                PUL A
12970 0D40 39                RTS
12980                 *NAM BCD
12983                 *THIS SUBR. ADDS TWO OPERANDS THAT ARE EACH IN BCD
12985                 *AND CONSIT OF 3 BYTES. THIS FIRST OPERAND P HAS
12990                 * STARTING ADDRESS PASSED THRU X WHILE THE SECOND
12995                 *OPERAND Q HAS A STARTING ADDRESS OF ADDEND. BOTH
13000                 *P&Q MUST BE DEFINED BEFORE EXECUTION AND THE RESU
13005                 *P&Q IS RETURNED TO M<X>. THE LSBOF Q (UNITS) SHA
13010                 *NORMALLY BE ZERO, HOWEVER A 2 OR 1 MAY BE ENTERED
13015                 *IN THIS CASE THE ROUTINE IS FOR ESHORTENED TO A 2
13020                 *1 BYTE ADDITION PROCESS. Q IS RESET TO ZERO AFTER
13025                 *THE OPERATION.
13030                 *THE OPERATION. THE ADDITION DOES NOT TAKE
13035                 *PLACE IF TILT=1.
                             THE ROUTINE ALSO SETS BIT 0 OF OTGLFG TO ZERO
13040                 *CHECK TILT AND SKIP
13045                 *ADDITION PROCESS IF SET.
13050 0D41 7D 002C BCD       TST      TILT
13055 0D44 26 20             BNE      RSTADD
12050                 *LOAD THE UNITS HALF BYTE OF THE LSB OF Q TO B TO
13065                 *CHECK FOR THE FORESHORTENED 2 OR 1 BYTE ADDITION
13070                 *OPTION
13075 0D46 C6 0F             LDA B    #%00001111
13080 0D48 D4 29             AND B    ADDEND
13085                 *CLEAR C AND ADD FIRST BYTE
13090 0D4A 0C                CLC
13095 0D4B 96 29             LDA A    ADDEND
13100 0D4D AB 00             ADD A    0,X
13105 0D4F 19                DAA
13110 0D50 A7 00             STA A    0,X
13115                 *CHECK FOR ADDITON OPTION
13120 0D52 5A                DEC B
13125 0D53 27 11             BEQ      RSTADD
13130                 *ADD SECOND BYTE
13135 0D55 96 2A             LDA A    ADDEND+1
13140 0D57 A9 01             ADC A    1,X
13145 0D59 19                DAA
13150 0D5A A7 01             STA A    1,X
13155                 *CHECK FOR ADDITION OPTION
13160 0D5C 5A                DEC B
13165 0D5D 27 07             BEO      RSTADD
13170                 *ADD THIRD BYTE
13175 0D5F 96 2B             LDA A    ADDEND+2
13180 0D61 A9 02             ADC A    2,X
13185 0D63 19                DAA
13190 0D64 A7 02             STA A    2,X
13195                 *RESET Q TO ZERO
13200 0D66 CE 0003 RSTADD    LDX      #3
13205 0D69 6F 28   LOOP2     CLR      ADDEND-1,X
13210 0D6B 09                DEX
```

```
13215 0D6C 26 FB          BNE
                  *RESET BIT 0 OF OTHLFG. SET BY MAIN
                          LDA A    OTHLFG
                          AND A    #$FE
                          STA A    OTHLFG
13220 0D6E 39             RTS
13225             *NAM WRTLMP
13230             *THIS SUB. WRITES THE LAMP MATRIX LMPMAT TO
13235             *PIA2. THE OUTPUT DATA IS FORMATTED FOR
13240             *USE BY 8 CHANNEL DEMULTIPLEXERS.
13245             *
13250             *
13255             *
13260             *INITIALIZE X (LMPMAT OFFSET) AND DECADD (DECODER
13265             *ADDRESS DATA)
13270 0D6F CE 0007 WRTLMP LDX      #7
13275 0D72 86 07          LDA A    #7
13280 0D74 97 31          STA A    DECADD
13285             *PREPARE DRIVER ADDRESS DATA SUCH THAT PIA2DB3
13290             *-B7 ARE NOT CHANGED WHEN ADDRESS DATA IS WRITTEN
13295             *TO B0-B2.
13300 0D76 C6 F8  OUTLP   LDA B    #%11111000
13305 0D78 D4 8A          AND B    PIA2DB
13310 0D7A DA 31          ORA B    DECADD  B CONTAINS PREPARED ADDR.DA
13315             *PREPARE COMPLEMENTED LAMP DATA WORD FROM LMPMAT
13320 0D7C A6 15          LDA A    LMPMAT,X
13325 0D7E 43             COM A            A CONTAINS COMP. LAMP DATA
13330 0D7F 36             PSH A            STORE
13335             *DISABLE ALL LMP. DRIVERS IN PREP. FOR NEW
13340             *ADDR DATA
13345 0D80 86 FF          LDA A    #$FF
13350 0D82 97 88          STA A    PIA2DA
13355             *WRITE NEW DECODER ADDRESS DATA PREPARED ABOVE.
13360 0D84 D7 8A          STA B    PIA2DB
13365             *WRITE NEW COMPLEMENTED LMP.DATA.
13370 0D86 33             PUL B
13375 0D87 D7 88          STA B    PIA2DA
13380             *DECREMENT LMPMAT OFFSET AND DRIVER ADDRESS DATA
13385 0D89 09             DEX
13390 0D8A 7A 0031        DEC      DECADD
13395             *RETURN TO OUTLP IF NOT LAST DRIVER ADDR. ELSE
13400             *RETURN
13405 0D8D 2A E7          BPL      OUTLP
13410 0D8F 39             RTS
13420             *NAM NEWDGT
13425             *
13430             *THIS INTERRUPT ROUTINE IS ACTIVATED BY THE 360
13435             *HZ.DISPLAY TIMER ON PIA3CA1. THE ROUTINE SENDS
13440             *BCD DATA REPRESENTING THE DISIRED DISPLAY
13445             *CHARACTER TO EACH OF FIVE DISPLAYS. DISPLAYS
13450             *1-4 CORRESPOND TO THE PLAYERS SCORES.
13455             *DISPLAY 5 RECEIVES CREDIT  DATA FOR
13460             *DIGITS 1&2 AND MATCH DATA FOR 5&6. THE FIRST
13465             *TIME THE PROGRAM IS EXECUTED,FIVE BYTES OF BCD
13470             *DATA ARE FED TO THE FIVE DIFFERENT DISPLAY
13475             *MODULES.THE BCD DATA IS FOR DIGIT 6 OF EACH
13480             *DISPLAY.ON FOLLOWING EXECUTIONS THE BCD DATA
13485             *IS FOR DIGIT 5,4,3 ECT.AFTER THE EXECUTION
13490             *THAT TRANSMITS THE DATA FOR DIGIT 1 THE DIGIT
13495             *COUNTER IS SET TO 6.NOTE THAT INITIALIZATION
13500             *OF THE ROUTINE IS ACCOMPLISHED AS THE SYSTEM
13505             *COMES FROM RESET.XSTART&SHFTG=0,
13510             *XSTART+1=14 AND DGTADD=6.
13515             *
13520             *
13525             *OUTPUT DATA FOR CURRENT DIGIT ADDRESS TO EACH
```

```
13530                 *OF FIVE DISPLAY ADDRESSES BEGINNING WITH DISP.
13535                 *ADDR.=5.DGTADD=DIGIT ADDR.
13540                 *
13545 0D90 C6 05      NEWDGT LDA B    #5       INIT.DISPLAY NO. COUNTER
13550 0D92 DE 51             LDX      XSTART  LOAD OFFSET FROM<SCORE1>
13555                                         OF THE RAM WORD.
13560                 *THIS SECTION OBTAINS BCD DATA FROM SCORE1,2
13565                 *3,4,MATCH,AND CREDIT FOR TRANSMISSION
13570                 *TO THE DISPLAYS. INPUTS ARE THE NO. OF THE
13575                 *DISP.(B), THE DIGIT NO.(DGTADD) FOR WHICH THE
13580                 *DATA IS REQUIRED AND THE DISTANCE FROM
13585                 *THE BASE ADDRESS<SCORE1> OF THE WORD CONTAIN.
13590                 *THE DATA(X). THE HALF BYTE OUTPUT CONTAINING
13595                 *THE BCD DATA IS PLACED IN THE M.S. HALF BYTE
13600                 *OF A WITH ZERO IN THE LOWER ORDER FOUR BITS.
13605                 *MEMORY MUST BE ARRANGED SEQUENTIALLY WITH
13610                 *SCORE1 AT THE LOWEST NEMERICAL ADDRESS AND
13615                 *SCORE4+2 LOCATED AT SCORE1+11, MATCH MUST
13620                 * BE LOCATED AT SCORE1+12 AND CREDIT AT SCORE1+14
13625                 *
13630                 *
13635 0D94 A6 42      DSPLP  LDA A    SCORE1,X    READ RAM WORD CONT. BCD D
13640                 *TEST  SHFTFG TO DETERMINE IF DESIRED BCD
13645                 *DATA IS IN LOWER ORDER BITS OF RAM WORD
13650                 *SHFTFG INDICATES WHETHER THE CURRENT  DIGIT
13655                 *ADDRESS IS ODD(BCD DATA IN LOWER ORDER BITS)
13660                 *OR EVEN (DATA IN HIGHER ORDER BITS).
13665                 *
13670 0D96 7D 0053           TST      SHFTFG
13675                 *SHIFT RAM WORD LEFT IF DATA IN LOWER ORDER
13680                 *BITS,ELSE MASK OFF LOWER ORDER BITS.
13685 0D99 27 04             BEQ      SKPASL
13690 0D9B 48                ASL A
13695 0D9C 48                ASL A
13700 0D9D 48                ASL A
13705 0D9E 48                ASL A
13710 0D9F 84 F0      SKPASL AND A    #%11110000
13715                 *BCD DATA NOW LOCATED IN HIGHER ORDER BITS
13720                 *OF A.LOWER ORDER 4 BITS ARE ZERO
13725                 *OUTPUT DISPLAY NO. TO L.E. DECODER(PIA3D0-3)
13730 0DA1 D7 90             STA B    PIA3DA
13735                 *OUTPUT BCD DATA TO DISPLAYS (PIA3DA4-7)
13740 0DA3 9A 90             ORA A    PIA3DA
13745 0DA5 97 90             STA A    PIA3DA
13746 0DA7 84 F0             AND A    #%11110000
13747 0DA9 97 90             STA      PIA3DA
13750 0DAB 09                DEX              DEC.COUNTERS IN PREPARATION
13755                 *                     FOR NEXT DISPLAY ADDR
13760 0DAC 09                DEX
13765 0DAD 09                DEX
13770 0DAE 5A                DEC B            B HOLDS THE DISPLAY ADDR.
13775 0DAF 26 E3             BNE      DSPLP   CONTINUE LOOPING UNTIL ALL
13780                 *                     DISPLAYS ARE LOADED
13785                 *
13790                 *ALL 5 DISPLAYS ARE LOADED WITH BCD INFO.
13795                 *SEND CODE FOR BLANKING PULSE TO LATCH ENABLE
13800                 *DECODER (OUTPUT LEAD 7)VIA PIA3DA0-3.
13805                 * RETAIN BCD DATA ON PIA3DA4-7.
13810 0DB1 86 07             LDA A    #7
13815 0DB3 9A 90             ORA A    PIA3DA
13820 0DB5 97 90             STA A    PIA3DA
13825                 *OUTPUT DIGIT ENABLE CODE TO DIGIT
13830                 *SELECT DECODER VIA PIA3DA0-3.
13835                 *
13840 0DB7 86 0F             LDA A    #$0F
13841 0DB9 97 90             STA A    PIA3DA
```

```
13842 0DBB 86 08          LDA A    #8
13845 0DBD 9B 4F          ADD A    DGTADD  DIGIT ADDR.CODE FORMED
13850 0DBF 97 90          STA A    PIA3DA
13855                *
13860                *DO HOUSEKEEPING IN PREPARATION FOR THE NEXT
13865                *TIME THIS ROUTINE IS EXECUTED
13870 0DC1 96 53          LDA A    SHFTFG
13875 0DC3 27 03          BEQ      BYPDEC
13880 0DC5 7A 0052        DEC      XSTART+1
13885 0DC8 73 0053 BYPDEC COM      SHFTFG
13890 0DCB 7A 004F        DEC      DGTADD
13895                *IF EACH OF THE SIX DIGITS HAS BEEN SCANNED
13900                *THEN RESET TO DIGIT NO.6.
13905 0DCE 96 4F          LDA A    DGTADD
13910 0DD0 26 08          BNE      BYPRES
13915 0DD2 86 06          LDA A    #6
13920 0DD4 97 4F          STA A    DGTADD
13925 0DD6 86 0E          LDA A    #14
13930 0DD8 97 52          STA A    XSTART+1    RESET OFFSET FRM.SCORE1
13935 0DDA 3B        BYPRES RTI
15005                *NAM SCOREX
15015                *SCOREX IS A SUBROUTINE WHICH IS CALLED
15020                *TO ADD THE DESIGNATED TARGET OR BONUS
15025                *VALUE TO THE CURRENT PLAYER'S CORE.
15030                *THE ROUTINE SORTS THE TARGET OR BONUS
15035                *VALUE INTO INCREMENTAL MULTIPLES OF
15040                *TEN, ONE-HUNDRED, & ONE-THOUSAND.
15045                *CONCURRENTLY, THE APPROPRIETE CHIME
15050                *IS SOUNDED WITH EACH INCREMENT.
15055                *ARGUMENTS FOR THE ROUTINE:
15060                *THE APPROPRIATE SCORING CODEWORD IS
15065                *LOADED INTO ACCUM "A" JUST PRIOR
15070                *TO THE CALL. THE CODEWORD CONSISTS
15075                *OF A BCD# IN THE LOW ORDER 1/2 BYTE,
15080                *WHICH CORRESPONDS TO THE INCREMENTAL MULTIPLIER.
15085                *BIT#7=1 INDICATES THOUSANDS;
15090                *BIT#6=1 INDICATES HUNDREDS;
15095                *BITS 6&7 INDICATES TENS.
15100                *SCOREX USES RAM VARIABLES "QLOOP","CHIME",
15105                *"SCRWRD", AND A ONE BYTE CONSTANT "GETLO".
15110                *SCOREX CALLS "DELAY","SLNPLS","SCRPLS",
15115                *ALSO USES RAM VAR "ADDEND"
15120 0DDB 0F        GET LO FCB       $0F
15125 0DDC 7D 002C SCOREX TST         TILT
15126 0DDF 26 3F          BNE      KAREN
15127 0DE1 16             TAB               SAVE CODEWRD IN B
15130 0DE2 F4 0DDB        AND B    GETLO    PICK OFF LO-ORD MULTIPLIER
15135 0DE5 D7 08          STA B    QLOOP    SAVE MULTIPLIER
15140 0DE7 49             ROL A             SHIFT B7 INTO CARRY
15145 0DE8 25 11          BCS      N1000    C=1 MEANS A K
15150 0DEA 49             ROL A             GET B6 IN CARRY
15155 0DEB 25 07          BCS      N100     C=1 MEANS A 100
15160 0DED 86 04   N10    LDA A    #$04     SETUP FOR 10'S CHIME
15165 0DEF CE 1000        LDX      #$1000   PREP FOR SCRPLS
15170 0DF2 20 0C          BRA      VICKI    DO IT
15175 0DF4 86 05   N100   LDA A    #$05     PREP4 CHIME
15180 0DF6 CF 0001        LDX      #$0001   PREF4 SCRPLS
15185 0DF9 20 05          BRA      VICKI
15190 0DFB 86 06   N1000  LDA A    #$06     PREP4 CHIME
15195 0DFD CE 0010        LDX      #$0010   PREP4 SCRPLS
15200 0E00 97 04   VICKI  STA A    CHIME    SAVE CHIME BIT #
15205 0E02 DF 05          STX      SCRWRD   SAVE CURRENT SCOREWORD
15210 0E04 96 04   SUSIE  LDA A    CHIME    PREP4 SLNPLS BIT#
15215 0E06 CE 008A        LDX      #PIA2DB M IN X
15220 0E09 BD 0AD0        JSR      SLNPLS
15225 0E0C DE 05          LDX      SCRWRD   PREP4 SCRPLS
```

```
15230 0E0E DF 29          STX      ADDEND
15235 0E10 BD 0AFE        JSR      SCRPLS   INCREMENT SCORE
15240 0E13 7A 0008        DEC      QLOOP
15245 0E16 27 07          BEQ      KAREN    QLOOP=0 MEANS DONE
15250 0E18 C6 10          LDA B    #$10     NOT ZERO MEANS DELAY; RETRY
15255 0E1A BD 0C9E        JSR      DELAY
15260 0E1D 20 E5          BRA      SUSIE    DONE WAITING; DO MORE
15265 0E1F 39      KAREN  RTS               THATS ALL FOLKS
15505              INAM BONES
15510              *BONES IS A SUBROUTINE WHICH INCREMENTALLY ADDS
15515              *THE BONUS POINTS TO THE CURRENT PLAYER'S SCORE
15520              *THIS ROUTINE IS CALLED AFTER THE BALL EXITS.
15525              *ARGUMENTS FOR THE ROUTINE ARE:
15530              *******
15535              *BONUS+1, BONUS+2, AND BMULT
15540              *BONUS+2 IS A 1-BYTE RAM VARIABLE CONTAINING
15545              ***THE BCD# OF 10K'S IN THE LOW-ORDER BITS
15550              *"BONUS+1" IS A 1-BYTE RAM VAIABLE WHICH CONTAINS
15555              ***THE BCD# OF 1K'S IN THE HI-ORDER, AND THE BCD#
15560              ***OF 100'S IN THE LO-ORDER BITS
15565              *"BMULT" IS A 1-BYTE RAM VARIABLE WHICH CONTAINS
15570              ***THE CURRENT BONUS MULTIPLIER IN THE LO-ORDER.
15575              *THIS ROUTINE CALLS "SCOREX", WHICH DOES THE
15580              *SCORING AND CHIMING.
15585              *UPON EXIT, THE ROUTINE INITIALIZES THE BONUS
15590              *TO "BMULT" =1, NAD 1K OF BONUS
15595 0E20 86 F0   BONES  LDA A    #$F0     SETUP BIT MASK
15600 0E22 94 26          AND A    BONUS+1  GET # OF 1K'S IN HI-ORDER
15605 0E24 27 24          BEQ      LPASO
15610 0E26 D6 13   ALPHA  LDA B    BMULT    LOAD PAS COUNTER=BMULT
15615 0E28 D7 14          STA B    PCOUNT
15620 0E2A C6 10          LDA B    #$10     PREP FOR DECREMENT
15625 0E2C 10             SBA               DECREMENT # OF 1K'S
15630 0E2D 97 26          STA A    BONUS+1  RESTORE TO RAM
15633 0E2F BD 0E7C        JSR      BONDSP   GO UPDATE THE DISPLAY
15635 0E32 86 81   QAGAIN LDA A    #$81     PREP4 SCOREX AT 1K
15645 0E34 BD 0DDC        JSR      SCOREX
15650 0E37 7A 0014        DEC      PCOUNT   DECREMENT PASSCOUNT
15651 0E3A 27 07          BEQ      HOWIE    GO SETUP LONG DELAY
15652 0E3C C6 10          LDA B    #$10     DO SHORT DELAY
15653 0E3E BD 0C9E        JSR      DELAY
15654 0E41 20 EF          BRA      QAGAIN   DO MORE
15655 0E43 C6 25   HOWIE  LDA B    #$25     LONG DELAY
15665 0E45 BD 0C9E        JSR      DELAY    GO DO IT
15670 0E48 20 D6          BRA      BONES    GO BACK AND CHECK FOR MORE
15675 0E4A 96 27   LPASO  LDA A    BONUS+2  GET # OF 10K'S
15680 0E4C 26 12          BNE      TOMB
15685 0E4E CE 1000        LDX      #$1000   PREP4 INTIAL BONUS
15690 0E51 DF 26          STX      BONUS+1  DO IT
15695 0E53 86 01          LDA A    #$01     PREP FOR INITIAL BMULT
15700 0E55 97 13          STA A    BMULT    DO IT
15702 0E57 BD 0E7C        JSR      BONDSP   UPDATE IT
15703 0E5A 86 22          LDA A    #DBLBNO
15704 0E5C BD 0C7D        JSR      LPCTRL
15705 0E5F 39             RTS               RETURN FROM SUB
15710 0E60 7A 0027 TOMB   DEC      BONUS+2  BORROW A 10K
15715 0E63 86 A0          LDA A    #$A0     SET UP 1K'S
15720 0E65 97 26          STA A    BONUS+1  RESTORE
15725 0E67 20 B7          BRA      BONES    DO SOME MORE
16005              *NAM BONDSP    BONUS DISPLAY
16010              *BONDSP IS A ROUTINE WHICH EXAMINES THE CONTENTS O
16015              *"BONUS+1" & "BONUS+2", AND MAKES THE APPROPRIATE
16020              *BIT CHANGES IN LAMP MATRIX.  BONDSP SHOULD BE
16025              *CALLED WHENEVER A BONUS SCORING UPDATE OCCURS.
16030              ****TABLE ASSIGNMENTS
```

```
16035 0E69 23      TABE2  FCB      $23,$24,$25,$26,$27,$30,$31,$32,$33,
      0E6A 24
      0E6B 25
      0E6C 26
      0E6D 27
      0E6E 30
      0E6F 31
      0E70 32
      0E71 33
      0E72 B4
16040 0E73 10      TABE3  FCB      $10,$11,$12,$13,$14,$15,$16,$17,$A0
      0E74 11
      0E75 12
      0E76 13
      0E77 14
      0E78 15
      0E79 16
      0E7A 17
      0E7B A0
16045              ****
16050              *DO BONUS 100'S (TABE2)
16055 0E7C CE 0E69 BONDSP LDX      #TABE2  PREP4 ABSUB THIS TABLE
16060 0E7F C6 0F          LDA B    #$0F    GET # OF 100'S FROM BONUS+1
16065 0E81 D4 26          AND B    BONUS+1 100'S IN B; PREP4 TABSUB
16067 0E83 5C             INC B
16070 0E84 BD 0EA6        JSR      TABSUB  DO IT
16075              *DO BONUS 1K'S (TABE3)
16080 0E87 96 26          LDA A    BONUS+1 GET # OF 1K'S
16085 0E89 BD 0EA1        JSR      GETHI   IN "B"
16090 0E8C 16             TAB              PREP4 TABSUB
16095 0E8D CE 0E73        LDX      #TABE3  PREP4 TABSUB THIS TABLE
16100 0E90 BD 0EA6        JSR      TABSUB  DO IT
16105              *DO 10K'S OF BONUS
16110 0E93 96 27          LDA A    BONUS+2 GET # OF 10K'S IN BONUS
16115 0E95 27 04          BEQ      EX32    IF ZERO, TURN OFF
16120 0E97 86 A1          LDA A    #$A1    NOT ZERO, TURN ON
16125 0E99 20 02          BRA      EX32A
16130 0E9B 86 21   EX32   LDA A    #$21    OFF
16135 0E9D BD 0C7D EX32A  JSR      LPCTRL  DOIT
16140 0EA0 39             RTS
16334              *NAM GETHI
16335              *GETHI IS A SUBROUTINE WHICH TAKES THE HIGH-ORDER
16340              *BITS OF "A" AND SHIFTS THEM TO LOW-ORDER, INSERTI
16345              *HI-ORDER ZEROS.  RESULT STORED IN "A".
16350 0EA1 44      GETHI  LSR A
16355 0EA2 44             LSR A
16360 0EA3 44             LSR A
16365 0EA4 44             LSR A
16370 0EA5 39             RTS
16405              *NAM TABSUB
16410              *TABSUB IS A ROUTINE WHICH TAKES A NUMBER IN "B"
16415              *AND A TABLE REFERENCED BY X, AND TURNS ON
16420              *THE LAMP ASSOCATED WITH B & X, WHILE TURNING
16425              *OFF ALL OTHER LAMPS IN THIS TABLE. "X" CONTAINS
16430              *THE STARTING ADDRESS OF THE CURRENT TABLE;
16435              *"B" CONTAINS THE NTH ENTRY TO BE SWITCHED ON
16440              *THE LAST WORD OF THE CURRENT TABLE MUST HAVE
16445              *BIT 7=1; ALL OTHER ENTRIES BIT 7=0.  THE BALANCE
16450              *OF THE WORDS CONTAINS THE WORD# &BIT# THIS CODEWO
16455 0EA6 DF 11   TABSUB STX      ADDOFF  SAVE START ADDRESS
16460 0EA8 D7 0B          STA B    DESIRD  SAVE DESIRED ENTRY POSITION
16465 0EAA C6 01          LDA B    #$01    START WITH ENTRY 1
16470 0EAC D7 0A          STA B    CURENT  SAVE IT (CURENT ENTRY)
16475 0EAE D6 0B   KPASA  LDA B    DESIRD  COMPARE DESIRED ENTRY
16480 0EB0 D1 0A          CMP B    CURENT  WITH CURENT ENTRY
16485 0EB2 27 06          BEQ      GTON    SAME, THEN GO TURN ON
```

```
16490 0EB4 86 7F   GTOFF  LDA A    #$7F     MASK OFF BIT 7=0
16495 0EB6 A4 00          AND A    X        FOR THIS CODEWORD*
16500 0EB8 20 04          BRA      EX7A     DO LPCTRL
16505 0EBA 86 80   GTON   LDA A    #$80     PUT A 1 IN BIT 7
16510 0EBC AA 00          ORA A    X        FOR THIS CODEWORD ON
16515 0EBE BD 0C7D EX7A   JSR      LPCTRL   GO CHANGE MATRIX
16520 0EC1 DE 11          LDX      ADDOFF   EXAMINE CURENT CODEWORD
16525 0EC3 E6 00          LDA B    X        FOR END OF TABLE
16530 0EC5 2B 08          BMI      GUDBYE   MINUS MEANS DONE
16535 0EC7 08             INX               SET UP NXT CODEWRD  ADDRESS
16540 0EC8 DF 11          STX      ADDOFF   IN ADDOFF
16545 0ECA 7C 000A        INC      CURENT   PREP4 NXT ENTRY CHECK
16550 0ECD 20 DF          BRA      KPASA    DO NEXT ENTRY
16555 0ECF 39      GUDBYE RTS
17140              *NAM LIGHTS
17145              *ACTIVATE THE CORRECT BITS IN LMPMAT TO ILLUMINAT
17150              *PLAYERS AND NO. OF PLAYER UP,AND BALL IN PLAY NO
17155              *
17160              *
17165              *ILLUMINATE THE NUMBER OF PLAYERS BASED UPON THE
17170              *LOAD TABLE OF LAMP CODEWORDS
17175 0ED0 44      TNPLAY FCB       PLY1NO,PLY2NO,PLY3NO,PLY4N1
      0ED1 45
      0ED2 46
      0ED3 C7
17177 0ED4 40      TNUP   FCB       UP1LP0,UP2LP0,UP3LP0,UP4LP1
      0ED5 41
      0ED6 42
      0ED7 C3
17178 0ED8 62      TBIP   FCB       BIPL10,BIPL20,BIPL30,BIPL40,BIPL51
      0ED9 63
      0EDA 64
      0EDB E5
17180              *LOAD INPUT PARAMETERS FOR TABSUB
17190 0EDC D6 23   LIGHTS LDA B     NPLAY  LOAD NO. OF ON LIGHT.
17195 0EDE CE 0ED0        LDX       #TNPLAY STARTING ADDRESS
17200 0EE1 BD 0EA6        JSR       TABSUB LIGHT LAMPS
17205              *
17210              *ILLUMINATE NO. OF PLAYER UP
17225              *LOAD INPUT PARAMETERS FOR TABSUB
17235 0EE4 D6 22          LDA B     NUP     NO. OF PLAYER THAT IS UP
17240 0EE6 CE 0ED4        LDX       #TNUP   STARTING ADDRESS
17245 0EE9 BD 0EA6        JSR       TABSUB
17250              *LIGHT BALL IN PLAY LAMP
17260              *LOAD INPUT VALUES
17270 0EEC D6 21          LDA B     BIP
17275 0EEE CE 0ED8        LDX       #TBIP
17280 0EF1 BD 0EA6        JSR       TABSUB
17285 0EF4 39             RTS
17295              *NAM SLAM
17300              *INHIBIT FLIPPERS,THUMPER BUMPER,SLINGSHOT
17305              *INHIBIT SCORE & BONUS COLLECTION
17310              *LIGHT GAME OVER LAMP
17315              *DELAY 30 SEC. AND RESTART AT NEWGAM
17320              *
17325 0EF5 BD 0922 SLAM   JSR       RTILT
17330 0EF8 86 F7          LDA A     #GMOVR1
17335 0EFA BD 0C7D        JSR       LPCTRL
17340 0EFD 20 F6          BRA       SLAM
17345 0EFF 39             RTS
17475 0F00 CE 004B TASK4  LDX       #SCORE4
17477 0F03 8D 10          BSR       DOIT
17480 0F05 CE 0048 TASK3  LDX       #SCORE3
17482 0F08 8D 0B          BSR       DOIT
17490 0F0A CE 0045 TASK2  LDX       #SCORE2
17492 0F0D 8D 06          BSR       DOIT
```

```
17495 0F0F CE 0042 TASK1  LDX      #SCORE1
17497 0F12 8D 01          BSR      DOIT
17498 0F14 39             RTS
17499 0F15 24 06   DOIT   BCC      DBLANK
17500 0F17 86 00   BLANK  LDA A    #$00
17505 0F19 C6 FF          LDA B    #$FF
17510 0F1B 20 04          BRA      SANDR    SANDR SEARCHES AND REPLACES
17515 0F1D 86 FF   DBLANK LDA A    #$FF
17520 0F1F C6 00          LDA B    #$00
17525 0F21 97 0D   SANDR  STA A    SEARCH   SAVE SEARCH WORD
17530 0F23 D7 0E          STA B    REPLCE   SAVE REPLACE WORD
17535 0F25 08             INX               SETUP CURRENT SCORE FOR MS
17540 0F26 08             INX
17545 0F27 86 02          LDA A    #$02     DO ONLY 2 BYTES (MS 4 DIGIT
17550 0F29 97 0F          STA A    DISPLY   SAVE IT
17555 0F2B 86 F0   HIORD  LDA A    #$F0     SEE IF HIORDER OF SEARCH =
17560 0F2D 16             TAB               HIORDER OF THIS WORD. NOT =
17565 0F2E A4 00          AND A    X        MEANS NO ACTION: SO EXIT
17570 0F30 D4 0D          AND B    SEARCH
17575 0F32 11             CBA
17580 0F33 26 21          BNE      ADIOS
17585 0F35 A6 00   REPHI  LDA A    X        SAME: REPLACE HIORDER THIS
17590 0F37 84 0F          AND A    #$0F     WITH REPLACEMENT VALUE
17595 0F39 D6 0E          LDA B    REPLCE
17600 0F3B C4 F0          AND B    #$F0
17605 0F3D 1B             ABA
17610 0F3E A7 00          STA A    X
17615 0F40 86 0F   LOORD  LDA A    #$0F     NOW CHECK LOORDER THIS WORD
17620 0F42 16             TAB               WITH LOORDER SEARCH WORD
17625 0F43 A4 00          AND A    X        NOT = MEANS EXIT
17630 0F45 D4 0D          AND B    SEARCH
17635 0F47 11             CBA
17640 0F48 26 0C          BNE      ADIOS
17645 0F4A 96 0E   REPLO  LDA A    REPLCE   SAME: REPLACE HI & LO WITH
17650 0F4C A7 00          STA A    X        REPLACEMENT WORD.
17655 0F4E 7A 000F        DEC      DISPLY
17660 0F51 27 03          BEQ      ADIOS
17665 0F53 09             DEX
17670 0F54 20 D5          BRA      HIORD    GO BACK FOR MORE IF NOT DON
17675 0F56 39      ADIOS  RTS
20001              * B A C K
20002              *INTERRUPT TARGETS
20003              *
20005              *
20020              *
20055              *
20060              *
20065              *
20070              *HARDWARE INTERR. SERVICE ROUTINE-THIS ROUTINE
20075              *IDENTIFIES THE ACTIVE INTERRUPT PORT AND TRANSFER
20080              *CONTROL TO AN APPROPRIATE ROUTINE. THE PORTS CHEC
20100 0F57 96 91   HWINT  LDA A    PIA3CA
20105 0F59 2A 05          BPL      Z1       CALL NEWDGT IF CRA7=1
20110 0F5B 96 90          LDA A    PIA3DA   CLEAR CRA7
20115 0F5D 7E 0D90        JMP      NEWDGT
20120 0F60 96 8B   Z1     LDA A    PIA2CB
20125 0F62 2A 06          BPL      Z2       CALL SLAM IF CRB7=1
20130 0F64 96 8A          LDA A    PIA2DB   CLEAR CRB6&7
20135 0F66 0E             CLI               PERMIT NEW INTERRUPTS
20140 0F67 7E 0EF5        JMP      SLAM
20145 0F6A 49      Z2     ROL A
20150 0F6B 2A 06          BPL      Z3       CALL ZEROCR IF CRB6=1
20155 0F6D 96 8A          LDA A    PIA2DB   CLEAR CRB6&7
20160 0F6F 0E             CLI               PERMIT NEW INTERRUPTS
20165 0F70 7E 0A3D        JMP      ZEROCR
20170 0F73 3B      Z3     RTI
```

```
20187                 *
20200                 *
20201                 *
20210                 *INTERRUPT VECTORS
20215                 *   SOFTWARE INTERRUPT VECTOR
20220 0FFA                ORG      $0FFA
20230                 *    HARDWARE INTERRUPT VECTOR
20235 0FF8                ORG      $0FF8
20240 0FF8 0F57           FDB      HWINT
20245                 *   RESTART INTERRUPT VECTOR
20250 0FFE                ORG      $0FFE
20255 0FFE 0800           FDB      BEGROM
20256                     END
```

SYMBOL TABLE

| | | | | | | | | | |
|---|---|---|---|---|---|---|---|---|---|
| ADDEND | 0029 | ADDOFF | 0011 | ADDR | 0002 | ADDR2 | 0000 | ADIOS | 0F56 |
| AGAIN | 09F6 | ALPHA | 0E26 | BCD | 0D41 | BEGROM | 0800 | BEGSTK | 005A |
| BIP | 0021 | BIPL10 | 0062 | BIPL11 | 00E2 | BIPL20 | 0063 | BIPL21 | 00E3 |
| BIPL30 | 0064 | BIPL31 | 00E4 | BIPL40 | 0067 | BIPL41 | 00E5 | BIPL50 | 0066 |
| BIPL51 | 00E6 | BITLP1 | 0AA9 | BITNUM | 0024 | BITRD | 0D38 | BITTBL | 0B24 |
| BITWRT | 0D1C | BL010 | 0023 | BL011 | 00A3 | BL01K0 | 0010 | BL01K1 | 0090 |
| BL020 | 0024 | BL021 | 00A4 | BL02K0 | 0011 | BL02K1 | 0091 | BL030 | 0025 |
| BL031 | 00A5 | BL03K0 | 0012 | BL03K1 | 0092 | BL040 | 0026 | BL041 | 00A6 |
| BL04K0 | 0013 | BL04K1 | 0093 | BL050 | 0027 | BL051 | 00A7 | BL05K0 | 0014 |
| BL05K1 | 0094 | BL060 | 0030 | BL061 | 00B0 | BL06K0 | 0015 | BL06K1 | 0095 |
| BL070 | 0031 | BL071 | 00B1 | BL07K0 | 0016 | BL07K1 | 0096 | BL080 | 0032 |
| BL081 | 00B2 | BL08K0 | 0017 | BL08K1 | 0097 | BL090 | 0033 | BL091 | 00B3 |
| BL09K0 | 0020 | BL09K1 | 00A0 | BL100 | 0034 | BL101 | 00B4 | BL10K0 | 0021 |
| BL10K1 | 00A1 | BLANK | 0F17 | BMULT | 0013 | BONDSP | 0E7C | BONES | 0E20 |
| BONUS | 0025 | BYPAS1 | 0B0A | BYPAS2 | 0B10 | BYPAS3 | 0B16 | BYPAS5 | 0BE8 |
| BYPCN1 | 0CC3 | BYPCN2 | 0CE0 | BYPDA | 0A0D | BYPDEC | 0DC8 | BYPRES | 0DDA |
| BYPSET | 09CB | BYPSHL | 090E | BYPSPL | 0986 | BYPSUB | 0AB8 | BYPSWX | 093D |
| CHAN1K | 09B2 | CHANNL | 09BC | CHANNR | 09B5 | CHANNX | 09BF | CHIME | 0004 |
| CNCNT1 | 0030 | CNCNT2 | 0032 | CNMON | 0CA5 | COINS | 0879 | CREDIT | 004E |
| CURENT | 000A | DBLANK | 0F1D | DBLBN0 | 0022 | DBLBNI | 00A2 | DECADD | 0031 |
| DELAY | 0C9E | DESIRD | 000B | DGTADD | 004F | DISPLY | 000F | DOIT | 0F15 |
| DRLPA0 | 0000 | DRLPA1 | 0080 | DRLPB0 | 0001 | DRLPB1 | 0081 | DRLPC0 | 0002 |
| DRLPC1 | 0082 | DRLPD0 | 0003 | DRLPD1 | 0083 | DROPA | 09D1 | DROPB | 09D7 |
| DROPC | 09DD | DROPD | 09E3 | DROPX | 09E7 | DRP100 | 0A14 | DRP500 | 0A0E |
| DSPLP | 0D94 | END1 | 0C4D | END2 | 0C59 | ENDBNS | 0BCD | ENDCNM | 0D1B |
| ENDLSL | 09AC | ENDRSL | 0999 | ENDTH | 0921 | ENTRY | 001E | EVEN | 0BB7 |
| EVENX | 0BB2 | EX32 | 0E9B | EX32A | 0E9D | EX7A | 0EBE | FAST | 0AC6 |
| FASTRT | 0ACC | FGMCHK | 0C31 | FIXED | 0B75 | FIXLP | 0B7A | GETHI | 0EA1 |
| GETLO | 0DDB | GMOVR0 | 0077 | GMOVR1 | 00F7 | GNILL0 | 00E7 | GNILL1 | 0067 |
| GTOFF | 0EB4 | GTON | 0EBA | GUDBYE | 0ECF | HIORD | 0F2B | HOWIE | 0E43 |
| HWINT | 0F57 | KAREN | 0E1F | KPASA | 0EAE | LESS15 | 0BA8 | LIGHTS | 0EDC |
| LMPMAT | 0015 | LOOP2 | 0D69 | LOOPLP | 0BDE | LOORD | 0F40 | LPAS0 | 0E4A |
| LPCTRL | 0C7D | LSLGST | 099A | LSTXST | 0037 | LSTXWD | 0033 | LXBLP0 | 0035 |
| LXBLP1 | 00B5 | MATCH | 0028 | MATCHD | 0050 | MATCHX | 0C0A | MOMLP | 0B30 |
| MONMOD | 08C2 | MSKLP | 0D25 | MSKSET | 0D2E | MTCHLP | 0C1A | MTLP00 | 0050 |
| MTLP01 | 00D0 | MTLP10 | 0051 | MTLP11 | 00D1 | MTLP20 | 0052 | MTLP21 | 00D2 |
| MTLP30 | 0053 | MTLP31 | 00D3 | MTLP40 | 0054 | MTLP41 | 00D4 | MTLP50 | 0055 |
| MTLP51 | 00D5 | MTLP60 | 0056 | MTLP61 | 00D6 | MTLP70 | 0057 | MTLP71 | 00D7 |
| MTLP80 | 0060 | MTLP81 | 00E0 | MTLP90 | 0061 | MTLP91 | 00E1 | N10 | 0DED |
| N100 | 0DF4 | N1000 | 0DFB | NEWBAL | 0896 | NEWDGT | 0D90 | NEWGAM | 085A |
| NEWPYR | 089C | NEXT | 0B1C | NOSCR | 0889 | NOSOLN | 0B67 | NPLAY | 0023 |
| NUP | 0022 | NXTPLY | 0BD9 | NXTSCR | 0C6A | NXTTIM | 0A51 | ODD | 0BC3 |
| OTHLFG | 002D | OUTHL | 09AD | OUTLP | 0D76 | PCOUNT | 0014 | PIA1CA | 0085 |
| PIA1CB | 0087 | PIA1DA | 0084 | PIA1DB | 0086 | PIA2CA | 0089 | PIA2CB | 008B |
| PIA2DA | 0088 | PIA2DB | 008A | PIA3CA | 0091 | PIA3CB | 0093 | PIA3DA | 0090 |
| PIA3DB | 0092 | PLY1N0 | 0044 | PLY1N1 | 00C4 | PL2N0 | 0045 | PLY2N1 | 00C5 |
| PLY3N0 | 0046 | PLY3N1 | 00C6 | PLY4N0 | 0047 | PLY4N1 | 00C7 | PLYFLD | 0010 |
| QAGAIN | 0E32 | QLOOP | 0008 | QUICK | 0A21 | RAMZR | 0BD1 | RBONUS | 0B8A |
| RDMAT | 0B27 | REBOUN | 0964 | REPEAT | 000C | REPHI | 0F35 | REPLCE | 000E |

| | | | | | | | | | |
|---|---|---|---|---|---|---|---|---|---|
| REPLO | 0F4A | RESRAM | 0048 | RLVSW | 0957 | RLVSWA | 0952 | RLVSWB | 094D |
| RLVSWC | 0948 | RLVSWD | 0943 | RLVSWX | 0930 | RSLGST | 0987 | RSTADD | 0D66 |
| RSTCN | 0A4D | RTILT | 0922 | RVLPA0 | 0004 | RVLPA1 | 0084 | RVLPB0 | 0005 |
| RVLPB1 | 0085 | RVLPC0 | 0006 | RVLPC1 | 0086 | RVLPD0 | 0007 | RVLPD1 | 0087 |
| RXBLP0 | 0036 | RXBLP1 | 00B6 | SANDR | 0F21 | SCORE1 | 0042 | SCORE2 | 0045 |
| SCORE3 | 0048 | SCORE4 | 004B | SCOREX | 0DDC | SCRPLS | 0AFE | SCRWRD | 0005 |
| SEARCH | 000D | SERIN | 0ADF | SERLP | 0AEF | SHFTFG | 0053 | SHFTLP | 0D3B |
| SHTAG | 08A2 | SKIP3 | 0ABA | SKPASL | 0D9F | SLAM | 0EF5 | SLNPLS | 0AD0 |
| SMEGME | 0CF8 | SPCIAL | 0971 | SPCLP0 | 0074 | SPCLP1 | 00F4 | STAGN0 | 0075 |
| STAGN1 | 00F5 | SUBTBL | 0A5E | SUSIE | 0E04 | TABE2 | 0E69 | TABE3 | 0E73 |
| TABSUB | 0EA6 | TARMON | 0A8E | TASK1 | 0F0F | TASK2 | 0F0A | TASK3 | 0F05 |
| TASK4 | 0F00 | TBIP | 0ED8 | TEMP | 001D | THUBPR | 090F | TILT | 002C |
| TIME3 | 0AE6 | TIMLP | 0CA0 | TIMLP2 | 0A54 | TLTLP0 | 0076 | TLTLP1 | 00F6 |
| TNPLAY | 0ED0 | TNUP | 0ED4 | TOMB | 0E60 | TOPHOL | 08F6 | UP1LP0 | 0040 |
| UP1LP1 | 00C0 | UP2LP0 | 0041 | UP2LP1 | 00C1 | UP3LP0 | 0042 | UP3LP1 | 00C2 |
| UP4LP0 | 0043 | UP4LP1 | 00C3 | VICKI | 0E00 | WAIT | 002E | WAITCN | 002F |
| WORDLP | 0A96 | WRTLMP | 0D6F | XEDGE | 003B | XST | 0009 | XSTART | 0051 |
| XWD | 0007 | Z1 | 0F60 | Z2 | 0F6A | Z3 | 0F73 | ZCCNT | 0020 |
| ZEROCR | 0A3D | | | | | | | | |

TOTAL ERRORS 1

We claim as our Invention:

1. A pinball machine having visual indicators and a playing field with a plurality of ball responsive switches and a digital computer means, including one or more input ports and output ports, for receiving input signals in response to said ball responsive switches through an input port, for supplying switch address signals corresponding to selected ball responsive switches through an output port, and for supplying output signals corresponding to selected visual indicators through an output port in response to the input signals, said machine further comprising a first control circuit including interface means having an output port and an input port and being operatively connected to the ball responsive switches for supplying switch addressing test signals to said selected switches in response to the computer means switch address signals and for supplying switch input signals from select switches to said input port, and a second control circuit separate from said first control circuit having an output port and being operatively connected to the visual indicators for supplying visual indicator address signals and visual indicator data signals to activate said visual indicators in response to the computer means visual indicator output signals.

2. The machine of claim 1 wherein the ball responsive switches are operably connected as a plurality of sets of switches in a matrix, said first control circuit having a multiple bit data bus operably connected to an output port of the interface means with each line of the data bus being connected to a set of switches in the matrix and the switches being operably connected to the input port of the interface means, and means for placing an addressing test signal on each of the data lines so that an addressing test signal placed on a data line is conducted by the closed switches of the set of switches connected thereto and received as data by the input port whereby data identifying the closed switches is supplied to said computer means.

3. A pinball machine according to claim 1 further including at least one manually operated switch mounted on said pinball machine operably connected to said computer means and at least one actuating solenoid, said computer means for further receiving input signals in response to said manually operated switch and for supplying output signals to activate the solenoid.

4. A pinball machine according to claim 1 wherein said computer means comprises a microprocessor for storing said input signals, controlling said output signals and addressing said ports.

5. A pinball machine according to claim 4 wherein said computer means further comprises a memory means in which the microprocessor stores the input signals.

6. A pinball machine according to claim 4 wherein said microprocessor includes a source of timing signals.

7. A pinball machine according to claim 5 wherein said memory means comprises a random access memory.

8. A pinball machine according to claim 4 wherein said computer means further comprises a memory means for storing instructions for controlling the microprocessor wherein the microprocessor controls the output signals in response to the input signals and the instructions stored in the memory means.

9. A pinball machine according to claim 8 wherein said memory means comprises a read only memory.

10. A pinball machine according to claim 8 wherein said memory means comprises a programmable read only memory.

11. A pinball machine according to claim 4 wherein said interface means further comprises a peripheral interface adapter having said ports through which the input signals to and output signals from said microprocessor pass.

12. A pinball machine according to claim 1 wherein said visual indicators include scoring display means comprising digital display devices, said computer means having means for supplying output signals corresponding to selected digits in response to said input signals.

13. A pinball machine according to claim 12 including binary coded decimal decoder means operably connected between said digital display means and the digit output signal means.

14. A pinball machine according to claim 1 further having a plurality of solenoids for moving the ball on the playfield, said computer means further having means for supplying output signals corresponding to selected solenoids, said machine further comprising a plurality of solenoid driver circuits operably connected between said computer means and said solenoids to activate said solenoids with one of said solenoid driver circuits connected to each of said solenoids.

15. A machine according to claim 14 further comprising a second interface means, operably connected between said driver circuits and the solenoid signal means, separate from the first control circuit interface means and having an output port for supplying solenoid activation signals to the solenoid driver circuits in response to the computer means solenoid output signals.

16. A pinball machine according to claim 1 further having coin operated switch means, said computer means having means for receiving and storing input signals in response to said coin operated switch means, and for supplying output signals corresponding to the stored input signals.

17. The machine of claim 1 wherein said second control circuit includes a second interface means having said control circuit output ports through which the visual indicator address and data signals pass and said second control circuit further comprises decoder means for decoding said visual indicator address signals to supply said visual indicator data signals to said selected visual indicators and said visual indicators having switching means associated therewith for maintaining associated visual indicators in an on or off condition in response to the decoded address signals and visual indicator data signals.

18. The machine of claim 17 wherein a plurality of said visual indicators have controlled rectifiers respectively associated therewith for conducting power to illuminate the visual indicators, said machine further having a plurality of decoders, each having multiple input lines operably connected to a control circuit address port, multiple output lines, each operably connected to a controlled rectifier, and an enable line operably connected to a control circuit data output port, each decoder being responsive to a visual indicator data signal from the second interface means to decode the visual indicator address signals supplied by said second interface means and provide a signal on an output line to a controlled rectifier in accordance with the address signal, whereby a particular visual indicator for each addressed decoder may be illuminated.

19. The machine of claim 17 wherein the visual indicators include multiple digit score indicators, and the machine comprises a third control circuit having means for supplying score indicator address signals and score indicator data signals in response to the visual indicator output signals.

20. The machine of claim 19 wherein the means for supplying score indicator address and data signals includes a third interface means having one or more output ports separate from said second interface means through which the score indicator address and data signals pass.

21. The machine of claim 1 wherein said visual indicators include a plurality of multiple digit score indicators, each having digit enable inputs and data inputs, and the machine comprises a third control circuit having an output port for supplying latch enable address signals, an output port for supplying digit enable address signals operably connected to the digit enable inputs of the multiple digit score indicators, and an output port for supplying binary score data signals; said machine having a plurality of decoder/latches each having multiple input lines operably connected to the binary score data output port, a latch enable line operably connected to the latch enable output port and multiple output lines operably connected to the data inputs of a score indicator, each of said decoder/latches being responsive to a latch enable signal from said latch enable output port to decode the binary score signals supplied by the binary score output port and supply latched signals representative of a particular digit to a score indicator, whereby latched data representing a digit to be displayed in accordance with the binary score data signals is supplied to a multiple digit score indicator by a particular decoder/latch in accordance with the latch enable signals for a particular digit position in accordance with the digit enable signals.

22. A pinball machine having a playing field with a plurality of ball responsive switches and indicator lights, a digital computer comprising means for supplying switch address signals corresponding to selected ball responsive switches, means for receiving input signals in response to said ball responsive switches and means for supplying output signals corresponding to selected indicator lights in response to said input signals, and a plurality of controlled switches respectively associated with said indicator lights for conducting power to illuminate the lights, said means for supplying output signals having an output port for supplying indicator light data signals and an output port for supplying indicator light address signals, said machine further having a plurality of decoders each having multiple input lines operably connected to the address signal output port, multiple output lines each being operably connected to a controlled switch, and an enable line operably connected to the data signal output port, each of said decoders being responsive to a data signal from the data signal output port to decode the address signals from the address signal output port and provide a signal to a controlled switch in accordance with the address from the address signal output port whereby a selected indicator light may be illuminated, and said machine further having control means including interface means having an output port and an input port and being operatively connected to the ball responsive switches for supplying switch addressing test signals to said selected switches in response to the computer means switch address signals and for supplying switch input signals from said selected switches to said input port.

* * * * *

UNITED STATES PATENT AND TRADEMARK OFFICE

CERTIFICATE OF CORRECTION

PATENT NO. : 4,198,051

DATED : April 15, 1980

INVENTOR(S) : Marion Frank Bracha and William Harmon Englehardt

It is certified that error appears in the above—identified patent and that said Letters Patent is hereby corrected as shown below:

Column 3, line 41, change "92" to --91--.

Column 4, line 11, change "illutrated" to --illustrated--.

Column 4, line 26, change "801" to --80ℓ--.

Column 4, line 38, change "Tumper" to --Thumper--.

Signed and Sealed this

*Eighteenth* Day of *November 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,198,051

DATED : April 15, 1980

INVENTOR(S) : Marion Frank Bracha and William Harmon Englehardt

It is certified that error appears in the above—identified patent and that said Letters Patent is hereby corrected as shown below:

Column 3, line 41, change "92" to --91--.

Column 4, line 11, change "illutrated" to --illustrated--.

Column 4, line 26, change "801" to --80ℓ--.

Column 4, line 38, change "Tumper" to --Thumper--.

Signed and Sealed this

*Eighteenth* Day of *November 1980*

[SEAL]

*Attest:*

SIDNEY A. DIAMOND

*Attesting Officer*

*Commissioner of Patents and Trademarks*